US006955204B1

(12) United States Patent
Gilbert et al.

(10) Patent No.: US 6,955,204 B1
(45) Date of Patent: Oct. 18, 2005

(54) PARTITION SYSTEM

(75) Inventors: Richard R. Gilbert, S. Barrington, IL (US); Ed Y. Wu, Willowbrook, IL (US); John M. Jepsen, Grayslake, IL (US)

(73) Assignee: Iceberg Enterprises, LLC, Glendale Heights, IL (US)

( * ) Notice: Subject to any disclaimer, the term of this patent is extended or adjusted under 35 U.S.C. 154(b) by 0 days.

(21) Appl. No.: 10/158,721

(22) Filed: May 30, 2002

(51) Int. Cl.[7] ..... A47G 5/00

(52) U.S. Cl. ..... 160/135; 160/351; 52/656.4

(58) Field of Search ..... 160/135, 201, 160/232, 235, 229.1, 187, 267, 351; 52/239, 656.4, 36.1; 156/64, 212

(56) References Cited

U.S. PATENT DOCUMENTS

| | | | | |
|---|---|---|---|---|
| 297,491 | A | | 3/1884 | Booth |
| 1,666,507 | A | | 4/1928 | Puffe |
| 3,463,218 | A | | 8/1969 | Cannon et al. |
| 3,537,200 | A | | 11/1970 | Buss |
| 3,695,330 | A | | 10/1972 | Hasbrouck |
| 3,779,176 | A | | 12/1973 | Piretti |
| 3,792,551 | A | * | 2/1974 | Hallas ..... 49/463 |
| 3,809,142 | A | * | 5/1974 | Bleeker ..... 160/135 |
| 3,814,033 | A | | 6/1974 | Rudat et al. |
| 3,834,093 | A | | 9/1974 | Tacke et al. |
| 3,913,292 | A | | 10/1975 | Braekkan |
| 4,021,973 | A | | 5/1977 | Hegg et al. |
| 4,149,352 | A | | 4/1979 | Allen |
| 4,278,145 | A | * | 7/1981 | Eade et al. ..... 181/30 |
| 4,294,498 | A | * | 10/1981 | Van Luit ..... 312/245 |
| 4,489,121 | A | | 12/1984 | Luckanuck |
| 4,573,605 | A | | 3/1986 | Udell |
| 4,621,404 | A | * | 11/1986 | Browning ..... 29/463 |
| 4,640,658 | A | | 2/1987 | Webb, Jr. |
| 4,644,725 | A | * | 2/1987 | Schijf ..... 52/463 |

(Continued)

FOREIGN PATENT DOCUMENTS

| | | | | |
|---|---|---|---|---|
| DE | 3535834 | * | 4/1987 | ..... 160/135 X |
| GB | 2117423 | * | 10/1983 | ..... 160/135 |

*Primary Examiner*—Bruce A. Lev
(74) *Attorney, Agent, or Firm*—Leydig, Voit & Mayer, Ltd.

(57) ABSTRACT

A partition system which includes a hollow body, plastic panel, a connector link member, a plurality of inserts for the panel, a trim element for mounting to the panel, a leveling member for adjusting the orientation of the panel relative to a floor surface, a friction ring for cooperative engagement with the connector link member, and a plurality of fasteners for mounting the inserts, the connector link member, and the trim element to the panel. The panel can include a first face surface, a second face surface, a pair of opposing ends, a top surface, a bottom surface, and a shear wall wherein the first and second face surfaces are connected together. The panel can be formed in a blow-molding process. A pair of connector link members can be joined together to define a connector link assembly for joining a pair of panels together. The connector link assembly is adapted to allow the joined panels to be oriented with respect to each other over a range of angles.

93 Claims, 45 Drawing Sheets

U.S. PATENT DOCUMENTS 4,653,638 A 3/1987 Lackner et al.
4,743,281 A * 5/1988 Kennedy et al. ..... 55/493
4,762,379 A 8/1988 Beam et al.
4,901,896 A 2/1990 Speer
4,906,015 A 3/1990 LaCroix
4,991,365 A * 2/1991 Jackson ..... 52/126.6
4,995,144 A * 2/1991 Gateley ..... 16/261
5,004,133 A 4/1991 Wyers
5,038,983 A 8/1991 Tomososki
5,115,893 A 5/1992 Terkildsen
5,134,828 A 8/1992 Baur
5,181,822 A 1/1993 Allsop et al.
5,308,182 A 5/1994 Lampert
5,313,751 A 5/1994 Wittler
5,327,682 A * 7/1994 Holtz ..... 49/463
5,354,164 A 10/1994 Goss et al.
5,363,612 A 11/1994 Erickson
5,426,900 A 6/1995 Springer
5,450,694 A 9/1995 Goranson et al.
5,478,040 A 12/1995 Rellingr et al.
5,486,391 A 1/1996 Tyner
5,502,930 A 4/1996 Berkette et al.
5,507,999 A * 4/1996 Copsey et al. ..... 264/545
5,540,026 A 7/1996 Gartland
5,544,436 A * 8/1996 Lefkowitz ..... 40/124.2
5,546,718 A 8/1996 Way
5,570,971 A 11/1996 Rixen et al.
5,586,702 A 12/1996 Sadler
5,642,593 A 7/1997 Shieh
5,690,260 A 11/1997 Aikins et al.
5,706,624 A 1/1998 Lipson
5,779,035 A 7/1998 Marrelli et al.
5,789,057 A 8/1998 Naitou et al.
5,794,959 A 8/1998 Scheef, Jr.
5,810,542 A 9/1998 Ostrander
5,857,510 A * 1/1999 Krupke et al. ..... 160/201
5,921,046 A 7/1999 Hammond, Jr.
5,935,282 A * 8/1999 Lin ..... 55/385.6
5,966,777 A * 10/1999 Jantschek ..... 16/354
6,007,290 A 12/1999 Schulz et al.
6,039,227 A 3/2000 Stark
6,041,846 A * 3/2000 Langlois ..... 160/201
6,122,951 A 9/2000 Arbesman
6,129,371 A 10/2000 Powell
6,145,688 A 11/2000 Smith
6,179,184 B1 1/2001 Belinky et al.
6,257,559 B1 * 7/2001 Mouri ..... 256/26
6,272,779 B1 8/2001 Seiber et al.
6,282,847 B1 * 9/2001 Mangelsen et al. ..... 52/36.1
6,305,455 B1 * 10/2001 Wendel ..... 160/135
6,574,837 B2 * 6/2003 Jantschek ..... 16/371
6,599,055 B2 * 7/2003 Auer et al. ..... 403/381
2002/0043349 A1 * 4/2002 Rigby et al. ..... 160/135
2003/0221798 A1 * 12/2003 Hunt et al. ..... 160/135

* cited by examiner 102
181
105
370
331
384
382
380

104
540
540
512
560
532
540
508
536
540
532
34
34
522
526
527
520
514
500
501
532
526
532
524
527
541
541
104
509
537
541
540
541
540
512
104

41
41
131
541
504
104
541
640
102
130
149
166
540
540
164
167
512

43
43
522
166
164
167
149
102
532
464
526
527
464
532
121

131
526
527
102
130
166
164
167
149
122
642

110
728
722
724
52
52
732
736
708
730
704

901
915
900

922
931
59
915
913
911
901
934
932
900
912
914
930
922
59

PARTITION SYSTEM

FIELD OF THE INVENTION

This invention pertains to a partition system and, more particularly, to a partition system including a panel and a connector for connecting panels at variable orientations.

BACKGROUND OF THE INVENTION

Office spaces are often configured to include cubicles and other types of workstations defined by partition walls. Non-load bearing partition systems are typically constructed of metal framing with a substrate of core material, such as fiberboard, and a covering, such as a fabric material. Connector systems for these partition panels typically include a straight connector for joining two panels along a single plane and a right angle bracket for joining two panels at a right angle relative to each other.

Blow-molded products have many attractive features, such as, reasonable part price, low tooling costs, and fast product development, for example. In addition, a blow-molded product can be designed to have molded-in structural integrity.

Designing a double-walled, extrusion blow-molded product can include various challenges. For example, one obstacle confronted by the designer is to achieve a design that yields a flat product such as a panel or shelving. The traditional technique to produce a flat panel is to use "tip-to-tip" spot welding wherein welded elements, known as "weld cones," meet near the parting plane and weld together to provide a spot weld. Such a welding arrangement does little to prevent the side walls of the panel from buckling. The situation can be worsened in situations where the parting line is asymmetrically defined or where material is distributed unevenly between cavity and core sides. Consequently, panels so constructed can tend to curve like a banana even when the head tool has been carefully profiled.

The present invention is directed toward providing a partition system with a blow-molded, flat panel that is economically produced.

BRIEF SUMMARY OF THE INVENTION

The invention provides a partition system including a hollow body, plastic panel that can be made by a blow-molding process. A connector link member is provided to join two panels together. One connector link member can be mated with a second connector link member to define a connector link assembly. A friction ring can be provided to facilitate the mounting of the connector link assembly to the panel. A plurality of inserts can be provided, each being mountable to a recess in the panel. A trim element can be mated with a second trim element to define a trim assembly useful for providing a finished appearance to the panel. A leveling member can be mounted to the panel and used to adjustably position the orientation of the panel. A plurality of fasteners can also be provided. The fasteners can be used in combination to mount the connector link member, the trim element, and the inserts to the panel. The partition system can include a plurality of one or more components described herein.

The partition system can be used to define one or more wall portions that can define a cubicle or other workstation. The partition system is modular in nature and can be used to provide a variety of wall configurations.

Connector link assemblies are mounted to the partition panels in the connector ports. The connector link assemblies allow the user to install a pair of partition panels in any of a range of configurations relative to each other, such as a planar configuration or at an acute, obtuse or right angle with respect to each other. The connector link assemblies can be adjusted to the desired orientation by use of a screwdriver, for example.

To achieve a flat, warp-free panel, an offset tack-off welding arrangement can be provided. The offset, tack-off welding arrangement is provided by pairs of cooperating welding elements disposed on each half mold portion. A first welding element is disposed on the first mold portion such that when the first and second mold portions are brought together the first welding element extends from the first mold portion along a molding axis beyond the parting line. A second welding element is disposed on the second mold portion such that when the first and second mold portions are brought together the second welding element extends from the second mold portion along the mold axis beyond the parting line. The first and second elements are configured such that they define an overlap zone along the mold axis wherein both elements are found when the first and second mold portions are brought together. The two weld elements are offset from each other to allow the first and second mold portions to be brought together.

During the blow molding of the panel, the offset, cooperating weld elements can be brought together to "shear" the parison therebetween while both walls of parison are still in a molten stage to thereby weld to each other. The welded shear connection can be a surface-to-surface weld or a linear-to-linear weld. Neighboring surfaces from two opposite weld elements which are substantially parallel to each other yield a surface-to-surface weld. Otherwise, the neighboring surfaces define a linear-to-linear weld.

These and other features and advantages of the present invention will become apparent to one of ordinary skill in the art upon reading the detailed description, in conjunction with the accompanying drawings, provided herein.

DETAILED DESCRIPTION OF THE INVENTION

Figure 1:
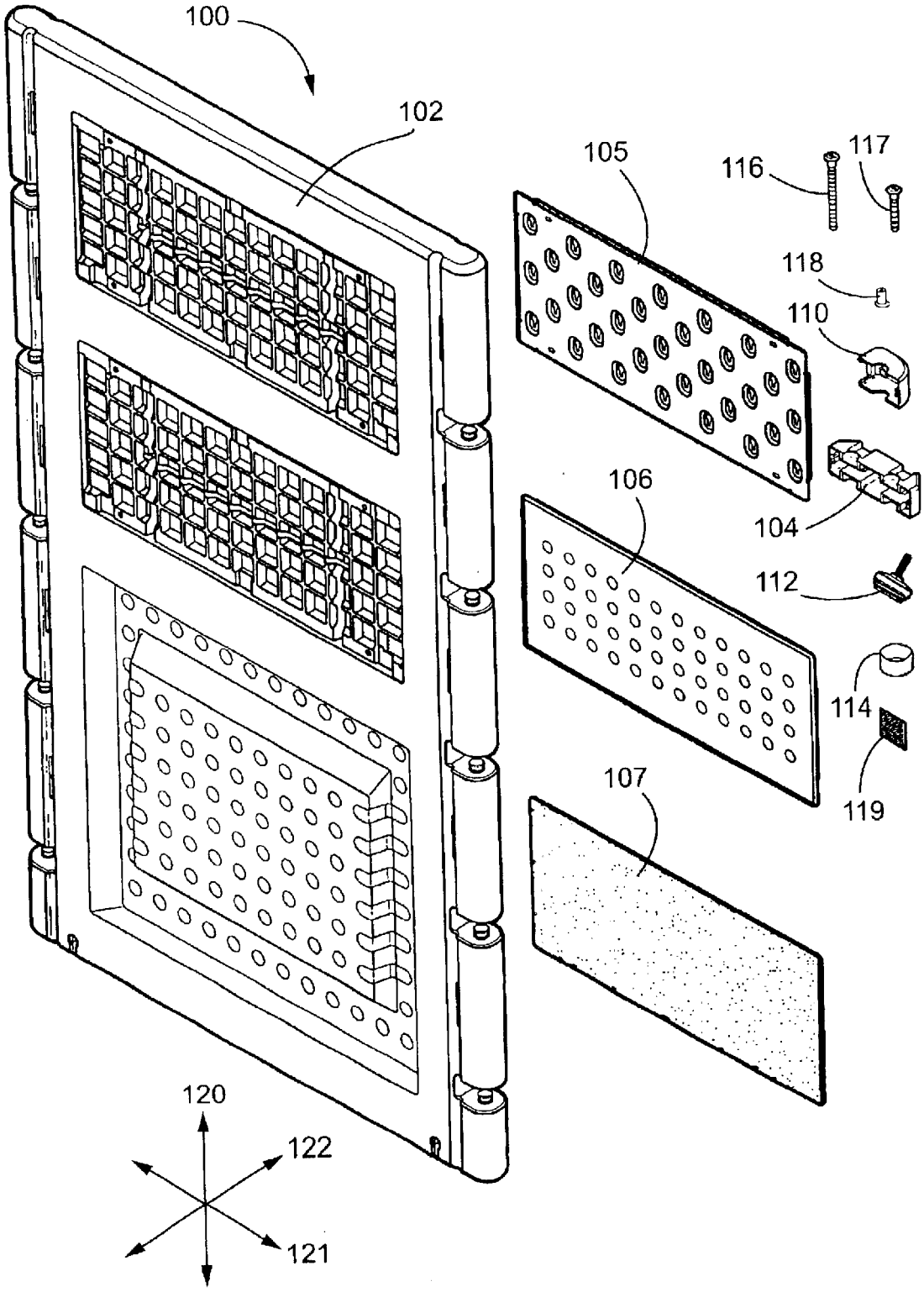
FIG. 1 is a perspective view of a partition system according to the present invention.

Turning now to the drawings, there is shown in FIG. 1 an illustrative partition system 100. The partition system 100 includes a hollow body, plastic panel 102, a connector link member 104, a plurality of inserts 105, 106, 107, a trim element 110, a leveling member 112, a friction ring 114, and a plurality of fasteners 116, 117, 118, 119. The fasteners 116, 117, 118, 119 can be used in combination to mount the connector link member 104, the trim element 110, and the inserts 105, 106, 107 to the panel 102. The partition system 100 can include a plurality of one or more components described herein. The components depicted in FIG. 1 are not shown to scale.

The panel 102 defines a vertical axis 120, a horizontal axis 121, and a transverse axis 122. The axes are mutually perpendicular to each other.

Figure 2:
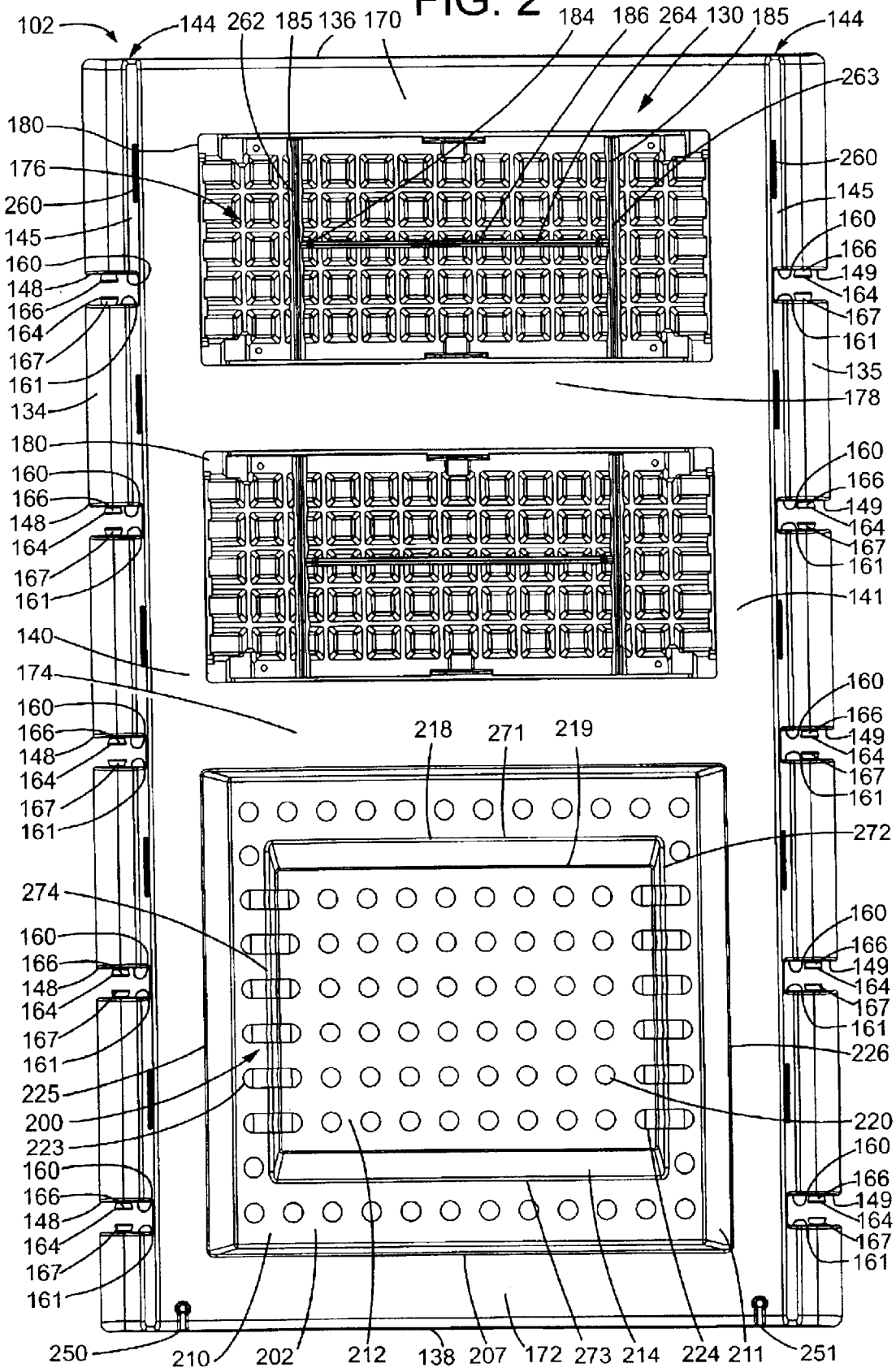
FIG. 2 is a front elevational view of a panel of the partition system of FIG. 1.
Figure 3:
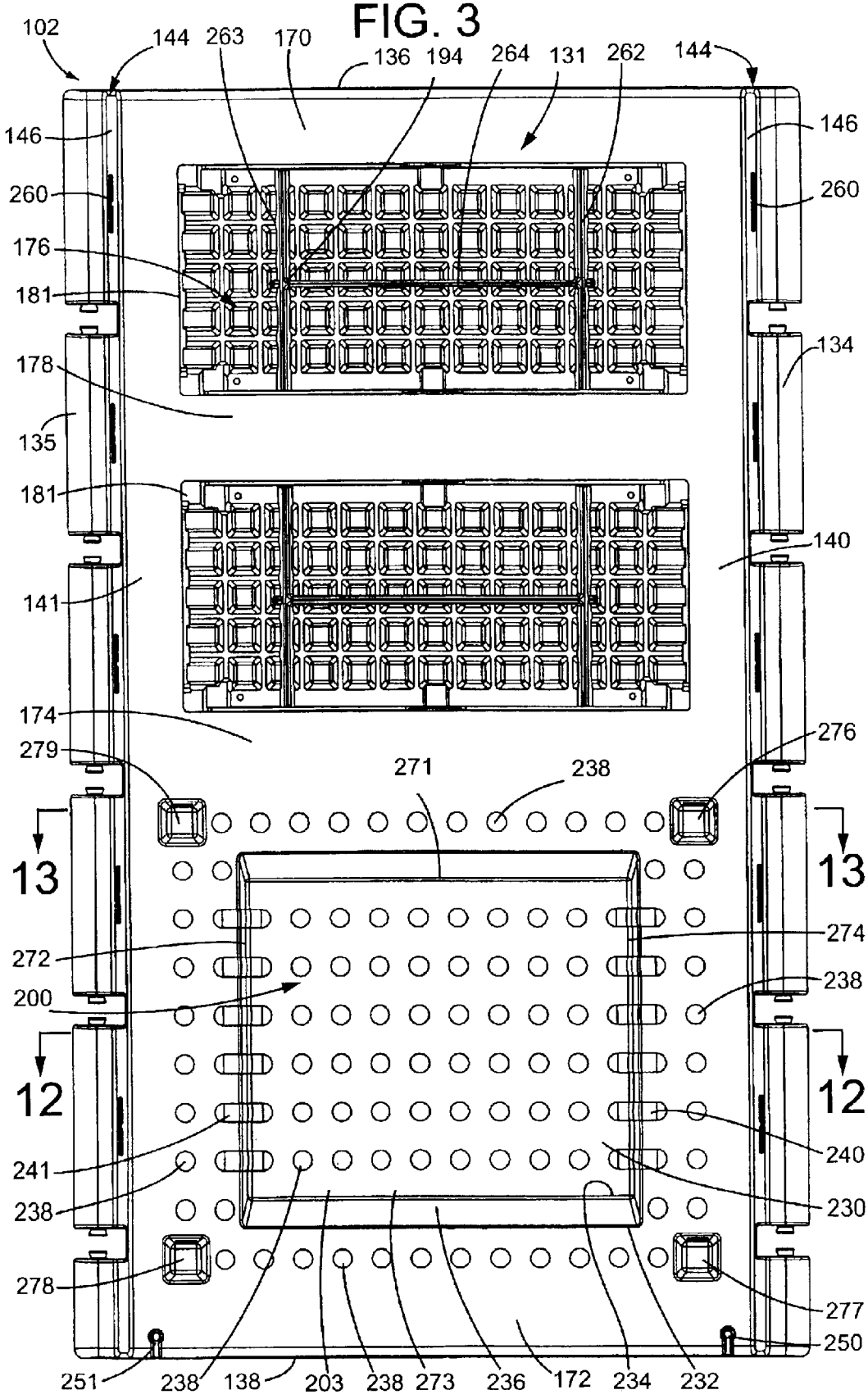
FIG. 3 is a rear elevational view of the panel of FIG. 2.

Referring to FIGS. 2 and 3, the panel 102 includes a first face 130, a second face 131, a first end 134, a second end 135, a top 136, and a bottom 138. The panel 102 includes first and second stiles 140, 141 in predetermined, spaced relationship to each other. Each stile 140, 141 includes a necked portion 144, having a pair of opposing, concave grooves 145, 146 extending substantially along the entire vertical length of the stile.

Referring to FIG. 2, the first and second stiles 140, 141 terminate at the first and second ends 134, 135, respectively, in a curved, convex surface, which is interrupted at regularly-spaced intervals by a plurality of connector ports 148, 149, respectively. The connector ports 148, 149 can be provided to allow the panel 102 to be joined to a second panel in a variety of configurations by use of the connector link member. Each connector port 148, 149 includes an upper surface 160 and a lower surface 161. The panel 102 includes a plurality of connecting elements 164 corresponding to the plurality of connector ports 148, 149. The connecting elements 164 are respectively disposed in the corresponding plurality of connector ports 148, 149. Each connecting element 164 includes a pair of posts 166, 167, which respectively project from the upper and lower surfaces 160, 161 of the connector ports 148, 149. Each post 166, 167 includes a tapered circumferential sidewall. To facilitate the use of the connector link member to join two panels together, the connector ports 148 of the first end 134 can be respectively aligned with the connector ports 149 of the second end 135.

The illustrative panel 102 includes five connecting ports 148, 149 respectively disposed at each end 134, 135. In other embodiments, the number and position of the connecting ports can vary. In the embodiment illustrated, the ends each include the same number of connector ports. In other embodiments, the ends can have different numbers of connector ports.

Referring to FIGS. 2 and 3, a top rail 170 and a bottom rail 172 extend horizontally between the stiles 140, 141. A body rail 174, disposed between the top rail 170 and the bottom rail 172 and substantially parallel thereto, extends horizontally between the stiles 140, 141.

To allow for one or more of the inserts to be removably mounted to the panel, the panel 102 can include an insert portion 176. The stiles 140, 141, the body rail 174, and the top rail 170 bound the insert portion 176. The insert portion 176 can be adapted to receive one or more inserts. An insert rail 178, disposed between the body rail 174 and the top rail 170 and substantially parallel thereto, can be provided to define a pair of recesses on each face. Referring to FIG. 2, the first face 130 of the panel 102 includes a pair of first recesses 180. Each first recess 180 can be configured to receive any one of the inserts shown in FIG. 1 therein. Referring to FIG. 3, the second face 131 of the panel 102 includes a pair of second recesses 181. Each second recess 181 is substantially the same size as the first recess. The second recess 181 can be configured to receive any one of the inserts shown in FIG. 1 therein.

Referring to FIG. 2, each of the first recesses 180 includes an H-shaped groove 184 having a pair of legs 185 in space relation to each other and substantially parallel to the stiles 140, 141 of the panel 102 and a transverse cross-piece 186, which is substantially parallel to the insert rail 178. Referring to FIG. 3, each of second recesses 181 includes a second H-shaped groove 194, which is substantially similar to first H-shaped groove of the first recess except that the second groove 194 is slightly smaller than the first groove such that the second groove 194 fits within the first groove.

In other embodiments, the insert rail can be omitted. In yet other embodiments, a plurality of insert rails can be provided.

Referring to FIGS. 2 and 3, to provide the panel with an aesthetically-pleasing appearance on both faces of the panel, the panel 102 can include a field portion 200. The stiles 140, 141, the body rail 174, and the bottom rail 172 bound the field portion 200. The field portion 200 of the panel 102 includes a first wall surface 202 disposed on the first face 130 and a second wall surface 203 disposed on the second face 131. The first and second wall surfaces 202, 203 are configured to present a generally aesthetically-pleasing appearance on both the first face 130 and the second face 131. The elements found on the wall surfaces 202, 203 can all be configured in a desired pattern to increase the aesthetic appearance of both the first face 130 and the second face 131.

Referring to FIG. 2, the first wall surface 202 includes an exterior perimeter edge 207, a recessed, perimeter section 210 being a maximum distance along the transverse axis from the first face 130, and a first beveled section 211 extending between the perimeter edge 207 and the perimeter section 210. The first beveled section 211 adjoins the stiles 140, 141, the body rail 174, and the bottom rail 172 at the perimeter edge 207. The first wall surface 202 includes a field section 212 which is disposed relatively closer to the first face 130 along the transverse axis than the perimeter section 210.

The perimeter section 210 and the field section 212 are joined together by a second beveled section 214 extending therebetween. The perimeter section 210 includes an interior edge 218 which defines an area. The field section 212 includes an exterior edge 219 which defines a second area. The second area is smaller than the first area such that the second beveled section 214 extends from the interior edge 218 of the perimeter section toward the exterior edge 219 of the field section in an inward fashion.

The first wall surface 202 includes a plurality of protrusions 220 disposed on the perimeter section 210 and the field section 212 in a generally, regular pattern. In this case, the protrusions 220 are disposed in an array. The first wall surface 202 also includes a first plurality 223 of passage areas and a second plurality 224 of passage areas adjacent first and second sides 225, 226 of the first wall surface 202, respectively. The passage areas 223, 224 are disposed in columns, respectively. Each passage area 222 extends between the perimeter section 210 and the field section 212, traveling over the second beveled section 214.

Referring to FIG. 3, the second wall surface 203 includes a recessed field section 230, which is offset from the second face 131 of the panel 102 toward the first face 130. The first and second stiles 140, 141, the bottom rail 172, and the body rail 174 define an exterior perimeter 232 of the second wall surface 203. The exterior perimeter 232 delineates a third area. The field section 230 of the second wall surface 203 has an exterior edge 234 that defines a fourth area. The fourth area is smaller than the third area. A beveled section 236 extends from the exterior perimeter 232 of the second wall surface 203 to the exterior edge 234 of the field section 230 to join the field section 230 to the second face 131 of the panel 102.

The body rail 174 and the bottom rail 172 include a plurality of protrusions 238. The portion of the first and second stiles 140, 141 between the body rail 174 and the bottom rail 172 each include a plurality of protrusions 238. The field section 230 of the second wall surface 203 includes a plurality of protrusions 238 disposed in a columnar array. A first plurality of passage areas 240 extends between the first stile 140 and the field section 230 of the second wall surface 203, traveling over the beveled section 236 of the second wall surface 203. A second plurality of passage areas 241 extends between the second stile 141 and the field section 230 of the second wall surface 203, traveling over the beveled section 236 of the second wall surface 203.

Referring to FIGS. 2 and 3, to adjustably receive two leveling members, the panel 102 can include first and second leveler-receiving structures 250, 251 disposed in the bottom 138 of the panel 102 adjacent the first and second ends 134, 135, respectively.

Referring to FIGS. 2 and 3, to achieve a substantially flat, warp-free panel, an offset tack-off welding arrangement can be provided. The panel 102 can include a plurality of weld sections wherein the first and second surfaces are connected together by an offset shear wall to increase the structural rigidity of the panel 102. The offset shear wall can be formed by an offset configuration of weld elements during a blow-molding process, for example. The panel 102 includes a plurality of end offset tack-off welds 260 disposed in both necked portions 144 of the panel 102. Each necked portion 144 includes, in this embodiment, five end offset welds 260, which are in alternating relationship with the connector ports 148, 149 of the respective end 134, 135. Each end offset weld 260 includes an offset shear wall having a surface-to-surface shear connection.

The first grooves 184 of the first recesses 180 respectively cooperate with the second grooves 194 of the second recesses 181 to define a plurality of recess offset tack-off welds 262, 263, 264. For each cooperating first and second groove 184, 194, three recess offset welds are defined corresponding to the two legs and the cross-piece of each groove 184, 194. Each recess offset weld 262, 263, 264 includes an offset shear wall having a surface-to-surface shear connection.

The first and second wall surfaces 202, 203 of the field portion 200 cooperate together to define a plurality of field offset tack-off welds 271, 272, 273, 274. In this case, four such field offset welds are defined. Each field offset weld 271, 272, 273, 274 includes an offset shear wall having a surface-to-surface shear connection.

Referring to FIG. 3, a plurality of stile offset tack-off welds 276, 277, 278, 279 can also be provided to increase the structural rigidity of the panel 102. In this case, four such stile offset welds are provided. The stile offset welds 276, 277, 278, 279 are respectively disposed adjacent the intersections of the first stile 140 and the body rail 174, the first stile 140 and the bottom rail 172, the second stile 141 and the bottom rail 172, and the second stile 141 and the body rail 174. Each stile offset weld 276, 277, 278, 279 includes an offset shear wall having a linear-to-linear shear connection.

Referring to FIGS. 4–10, an enlarged portion of the panel 102 is depicted which shows the interior of the panel 102 in the area of an exemplary end offset weld 260 in the necked portion 144 and an exemplary recess offset weld 263 defined by a pair of opposing first and second recesses 180, 181.

Figure 4:
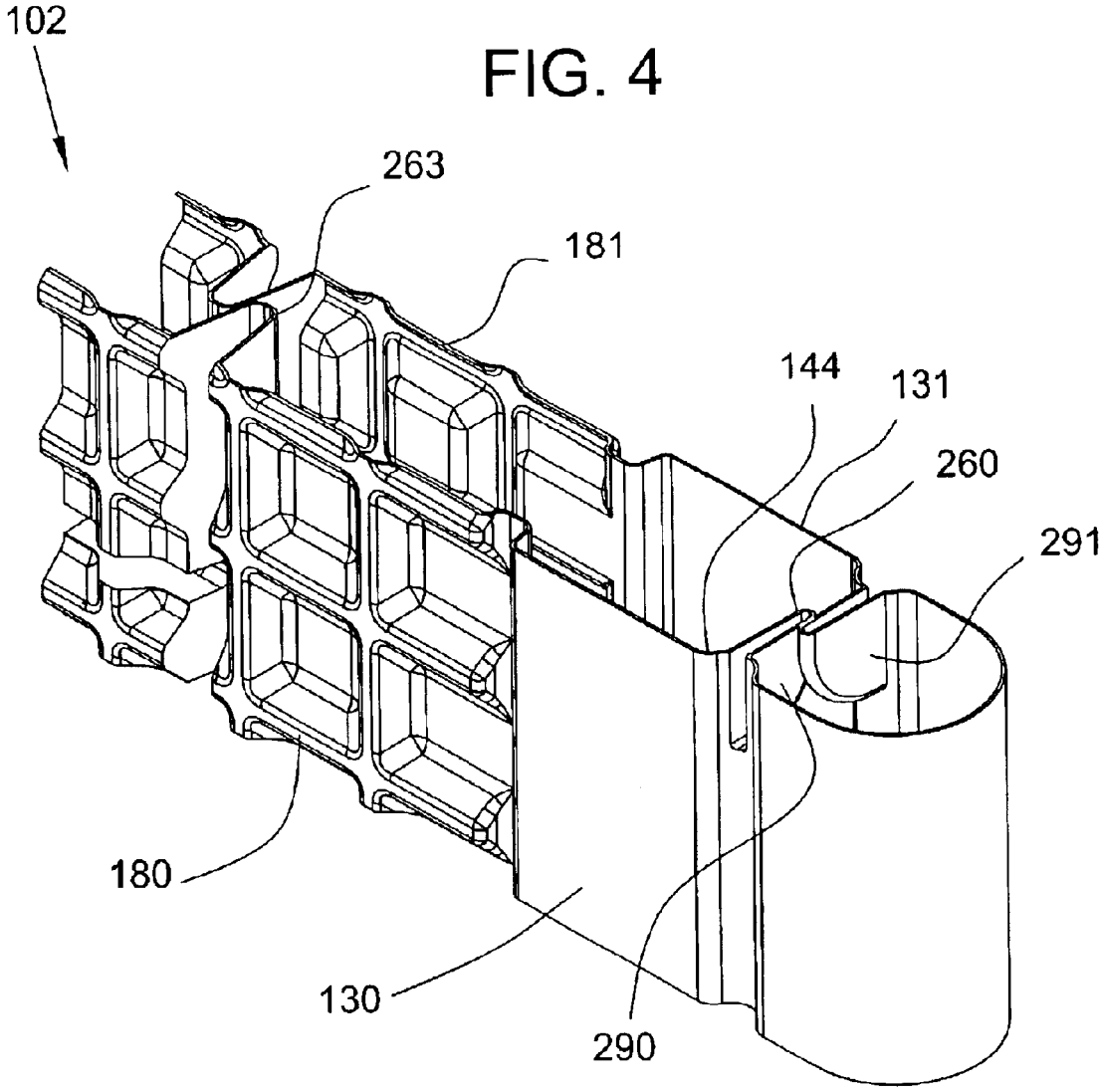
FIG. 4 is a fragmentary, broken away, perspective view, of the panel of FIG. 2.
Figure 5:
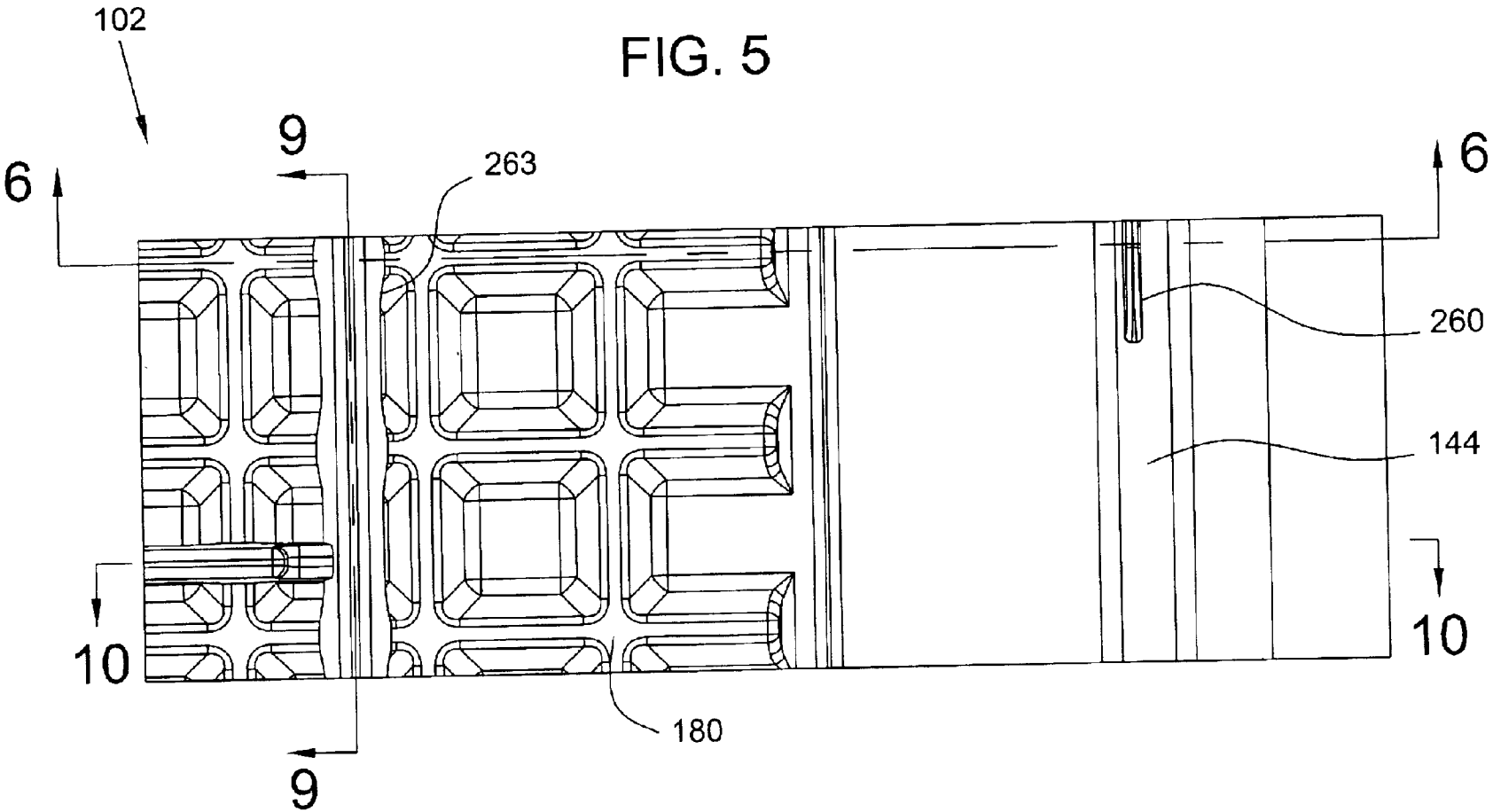
FIG. 5 is a front elevational view of the panel as in FIG. 4.
Figure 6:
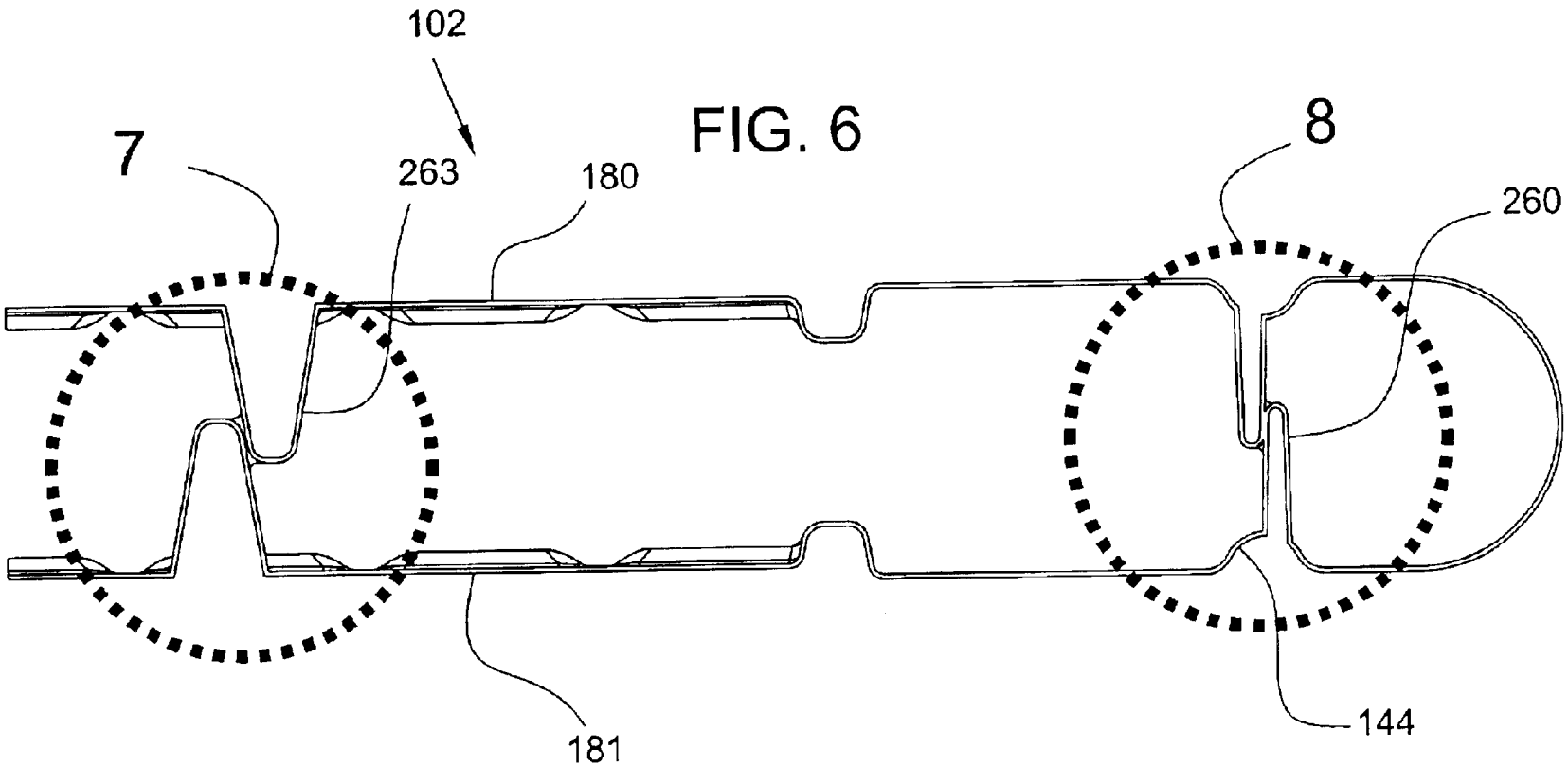
FIG. 6 is a cross-sectional view taken along line 6 in FIG. 5.
Figure 8:
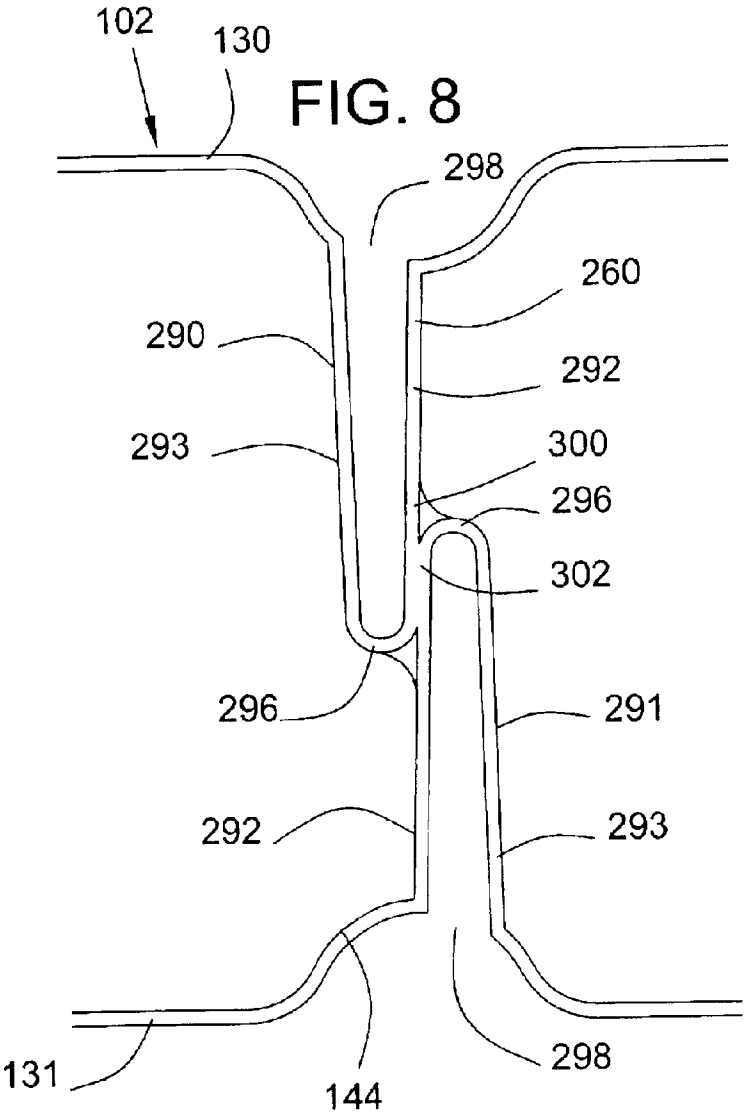
FIG. 8 is an enlarged, detail view taken view from FIG. 6.

Referring to FIG. 4, the end offset weld includes 260 a pair of generally semi-circular cavities 290, 291, which project toward each other from the first and second faces, 130, 131, respectively. Referring to FIG. 8, each cavity 290, 291 includes a pair of sidewalls 292, 293, an end surface 296 therebetween, and an opening 298 defined by the sidewalls 292, 293 and opening to the respective face 130, 131 of the panel 102 from which the cavity 290, 291 extends. The first sidewalls 292 of the first and second cavities 290, 291 define an offset shear wall 300. The first sidewalls are adjacent to each other and are disposed such that at least a portion of each sidewall is contiguous with the other sidewall and integral therewith. The cooperating sidewalls 292 of the first and second cavities 290, 291 are substantially parallel to each other, thereby providing the offset shear wall with a surface-to-surface shear connection 302. Each end surface 296 is curved, having a generally semi-circular cross section.

Figure 7:
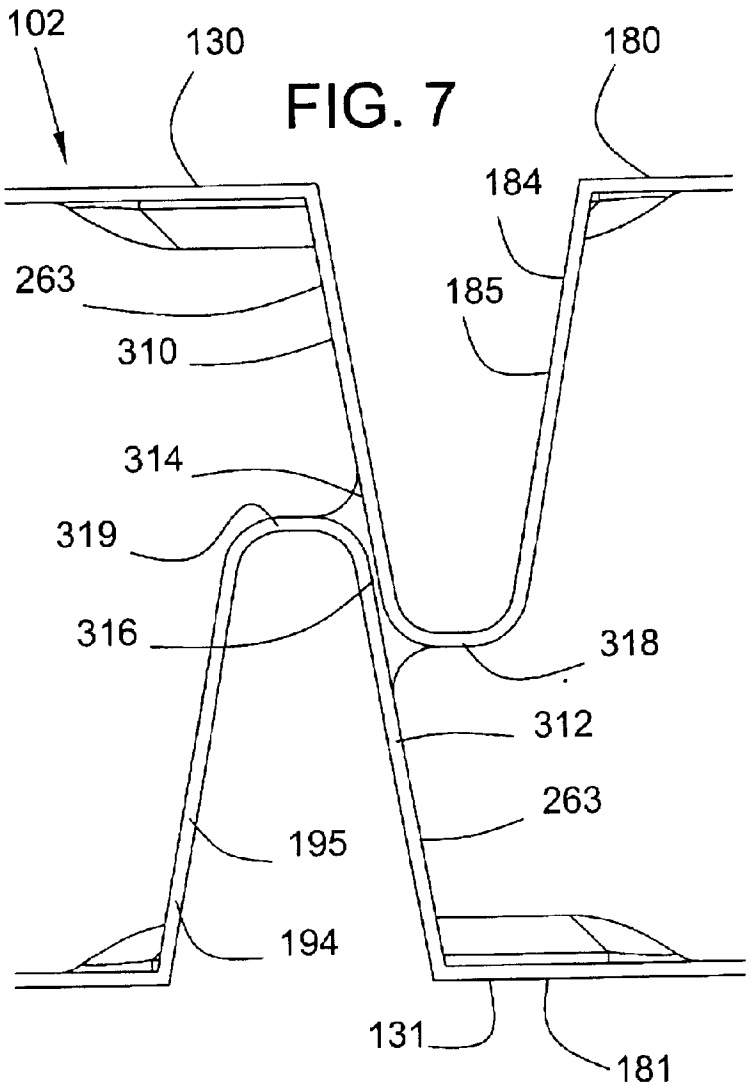
FIG. 7 is an enlarged, detail view taken view from FIG. 6.

Referring to FIG. 7, the recess offset weld 263 is shown. The second legs 185, 195 of the first and second grooves 184, 194, respectively, are adjacent to each other and are in contacting relation with each other similar to the first and second cavities of the end offset weld 260, as shown in FIG. 8. Referring to FIG. 7, the leg 185 of the first groove 194 extends from the first face 130 toward the second face 131. The leg 195 of the second groove 194 extends from the second face 131 toward the first face 130. A sidewall 310, 312 of each leg is disposed in integral, contacting relation, at least over a portion thereof, with the sidewall of the opposing leg. The contiguous sidewalls 310, 312 of the legs 185, 195 define an integral shear wall 314 that extends between the first face 130 and the second face 131. The cooperating sidewalls 310, 312 of the legs are substantially parallel to each other, thereby providing the offset shear wall 314 with a surface-to-surface shear connection 316.

Respective end surfaces 318, 319 of the legs 185, 195 are both slightly elongated having a portion of which with a relatively linear cross section. The recess offset weld 263 extends longitudinally along the entire length of the legs.

The other recess offset welds 262, 264 can be constructed in the same fashion.

Figure 9:
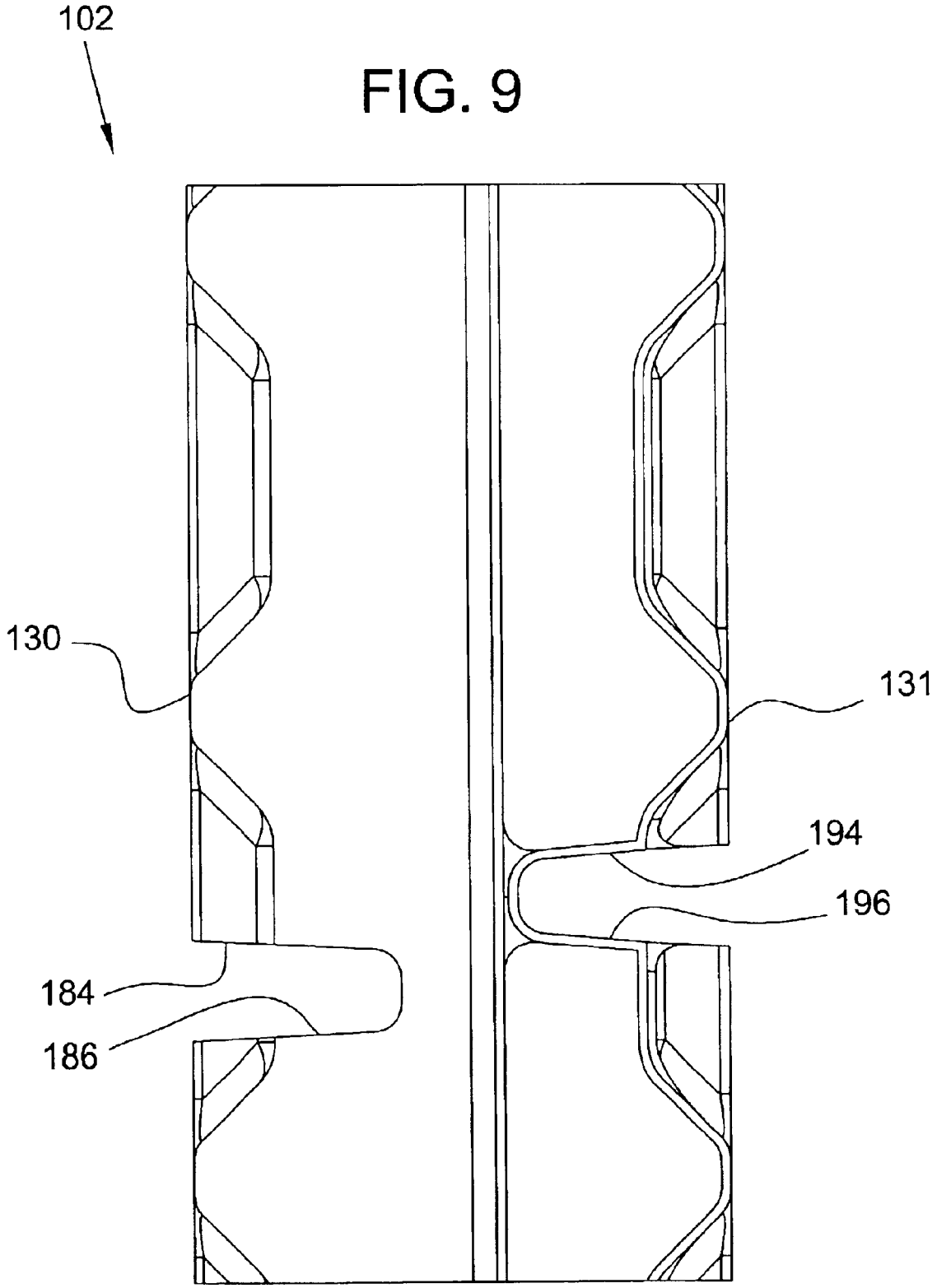
FIG. 9 is a cross-sectional view taken along line 9—9 in FIG. 5.
Figure 10:
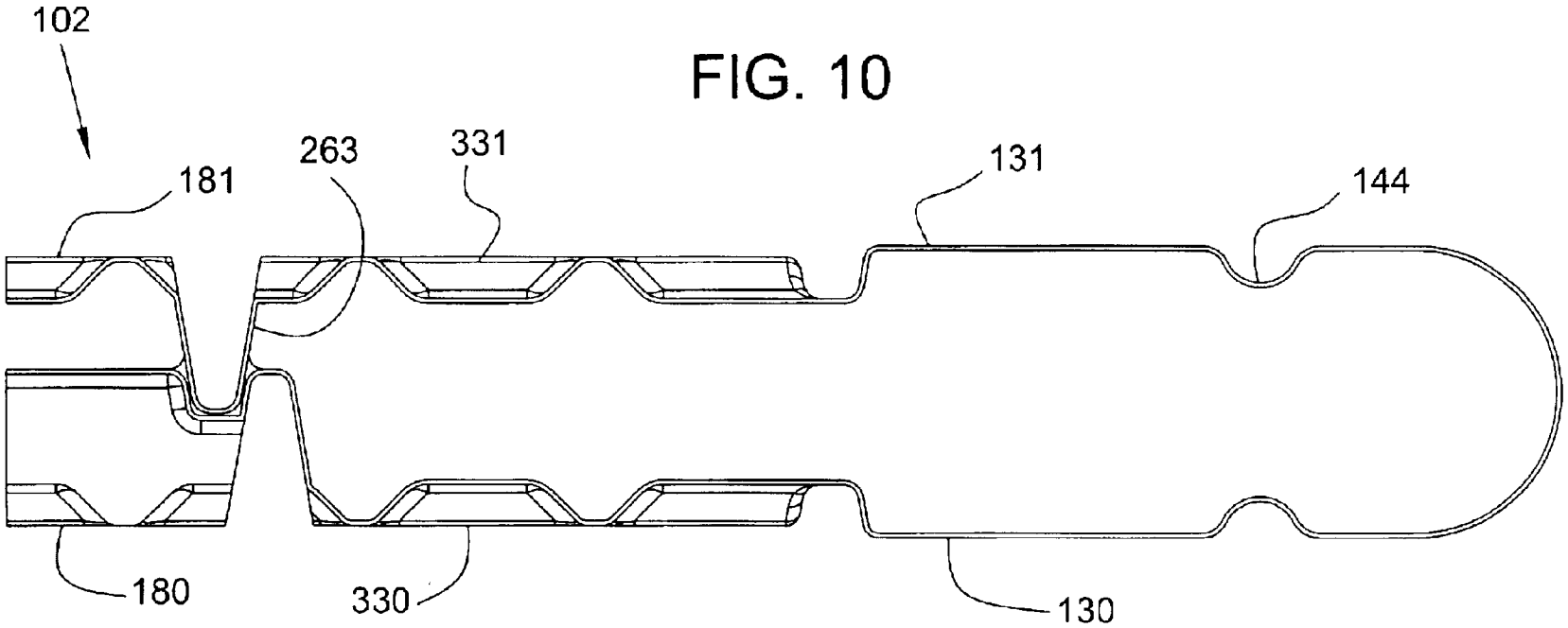
FIG. 10 is a cross-sectional view taken along line 10—10 in FIG. 5.

Referring to FIG. 9, the cross pieces 186, 196 of the first and second grooves 184, 196 extend from the first and second faces 130, 131, respectively, toward each other. The cross piece 196 of the second groove is closer to the top rail relative to the cross piece 186 of the first groove. Referring to FIG. 10, waffle surfaces 330, 331 of the first and second recesses 180, 181 extend from the first and second face, 130, 131, respectively, toward each other.

Figure 11:
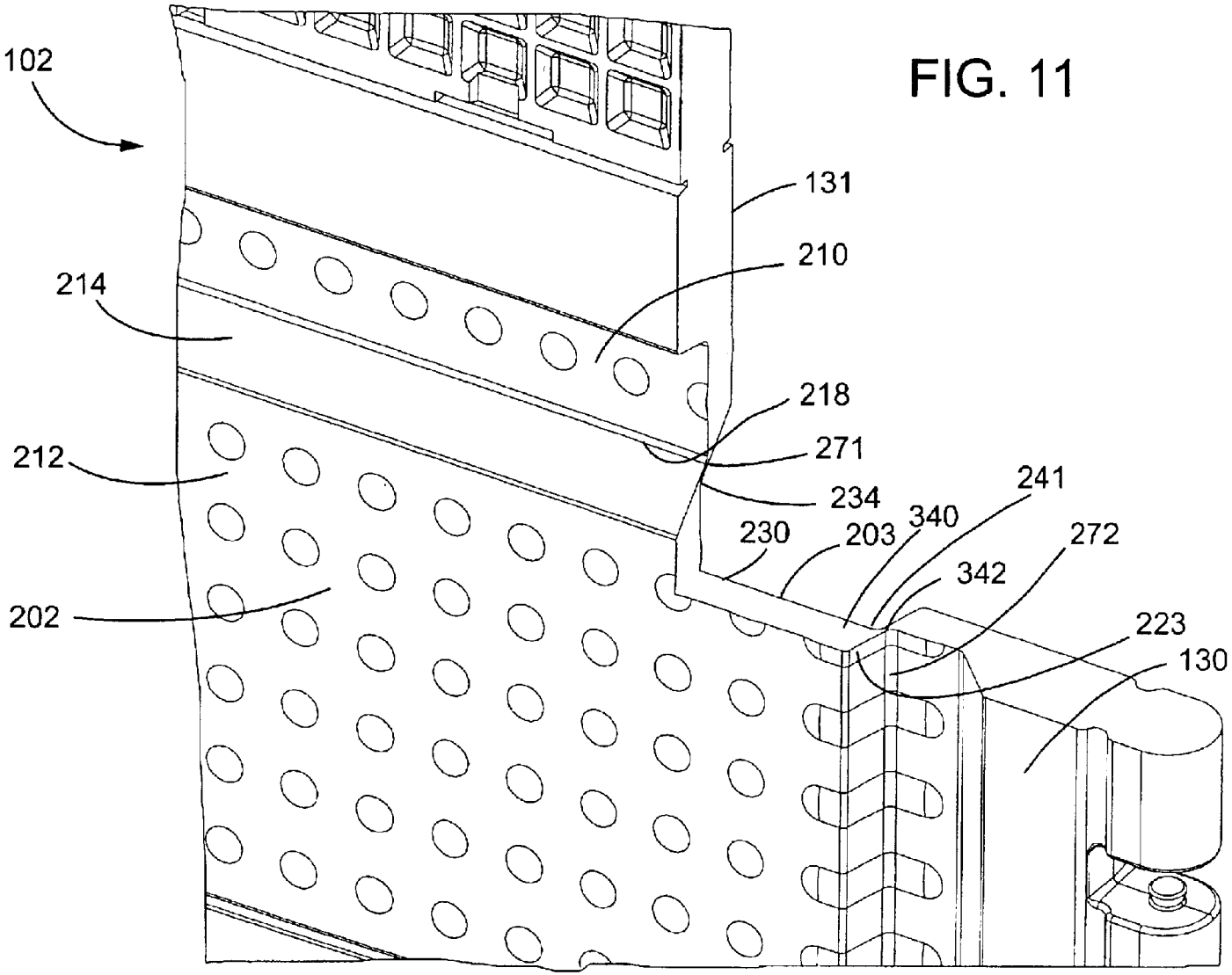
FIG. 11 is a fragmentary, broken away, perspective view of the panel of FIG. 2.
Figure 12:
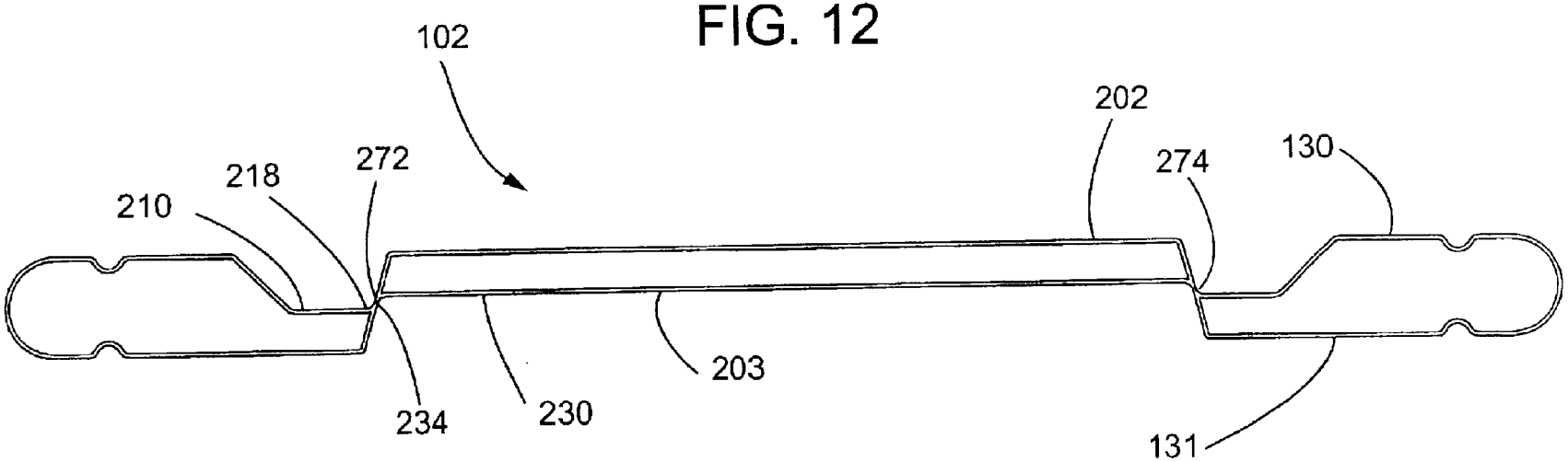
FIG. 12 is a cross-sectional view taken along line 12—12 in FIG. 3.

Referring to FIGS. 11 and 12, the second wall surface 203 nests within the first wall surface 202. The wall surfaces 202, 203 extend from the respective faces 130, 131 toward each other. The nested arrangement defines the field offset welds 271, 272, 274 each with a shear wall defined by the interior edge 218 of the perimeter section 210 of the first wall surface 202 and the exterior edge 234 of the field section 230 of the second wall surface 203. The shear walls each have a surface-to-surface shear connection.

Referring to FIG. 11, the field sections 212, 230 of the first and second wall surfaces 202, 203 define a chamber 340 therein. The second plurality of passage areas 223 of the first wall surface 202 and the first plurality of passage areas 241 of the second wall surface 203 respectively cooperate to define a corresponding plurality of passageways 342 for allowing air to flow between the chamber 340 and the stiles of the panel 102. The passageways 342 facilitate the manufacture of the panel by a blow-molding process by providing a way for air to enter the chamber 340 to shape the material into the desired form. The passageways 340 separate segments of the field offset welds 272, 274, shown in FIG. 12.

Figure 13:
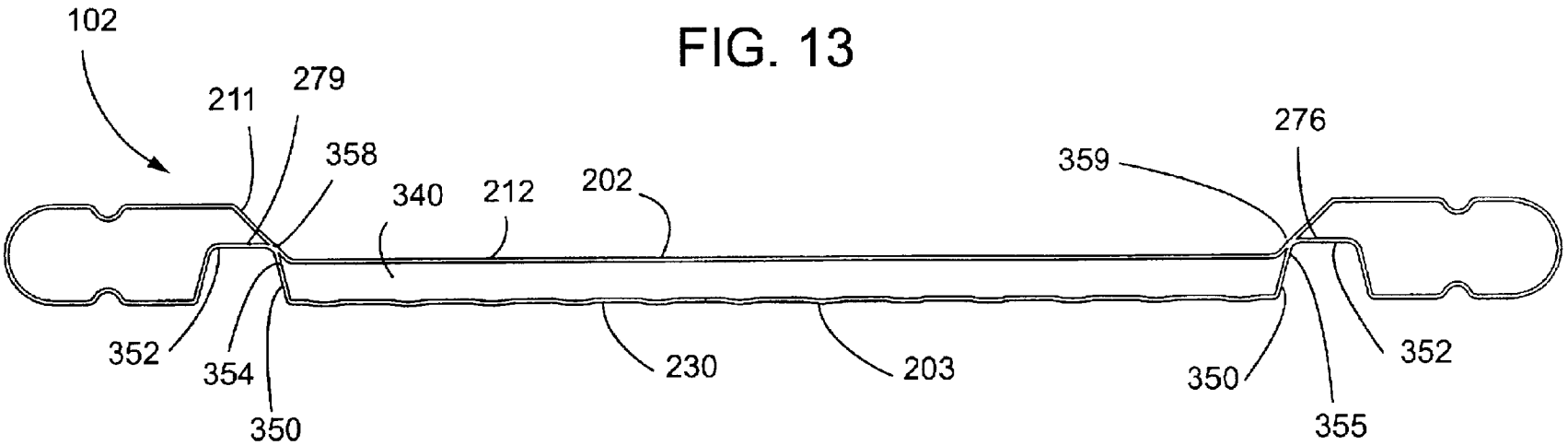
FIG. 13 is a cross-sectional view taken along line 13—13 in FIG. 3.

Referring to FIG. 13, a pair of exemplary stile offset tack-off welds 276, 279 is shown. The first beveled section 211 of the first wall surface 202 is in integral, contacting relation with a sidewall 350 of a pocket 352 of each stile weld 276, 279 to define a respective offset shear wall 354, 355 therebetween. The face and the edge are not substantially parallel to each. The offset shear wall 354, 355 of each stile offset weld includes a respective linear-to-linear shear connection 358, 359.

Figures 14, 15, 16:
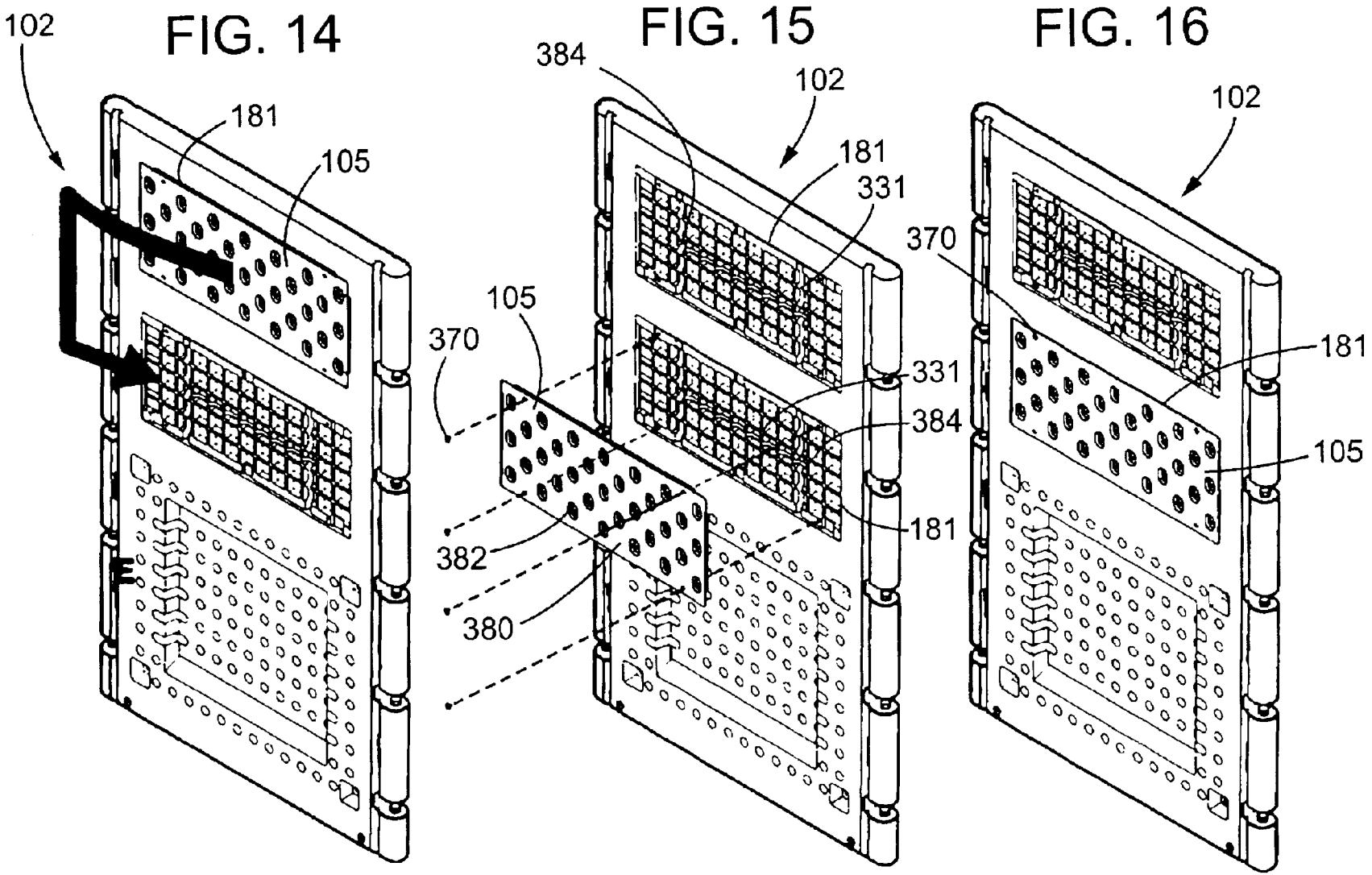
FIG. 14 is a perspective view of the panel and an accessory insert of the partition system of FIG. 1.
FIG. 15 is an exploded view of the panel and the accessory insert of FIG. 14.
FIG. 16 is a perspective view of the panel and the accessory insert of FIG. 14 with the accessory insert mounted to the panel in another configuration.
Figure 17:
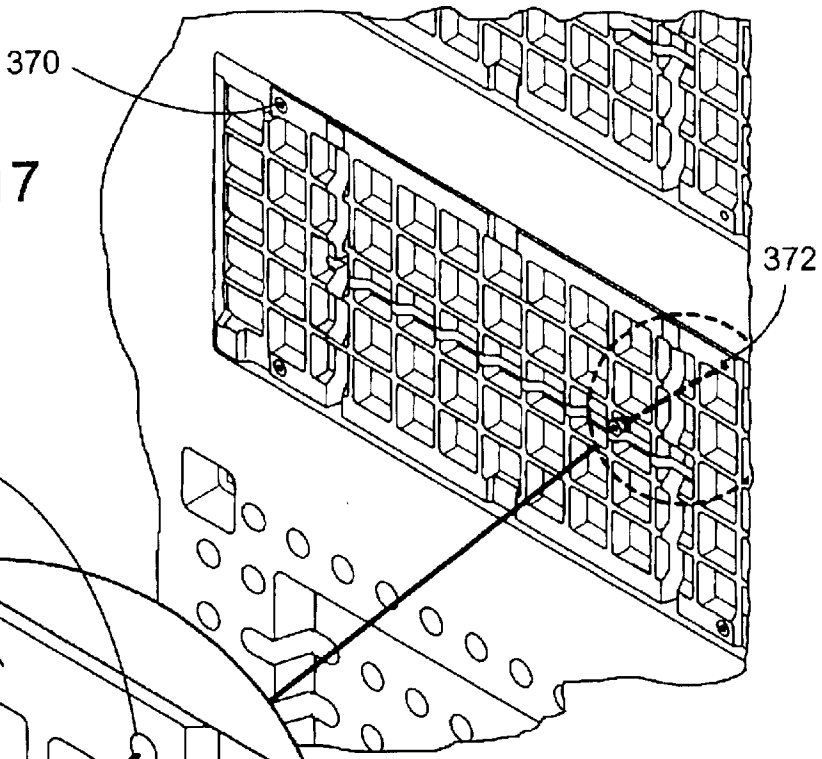
FIG. 17 is an enlarged, fragmentary perspective view of the panel of FIG. 15.
Figure 18:
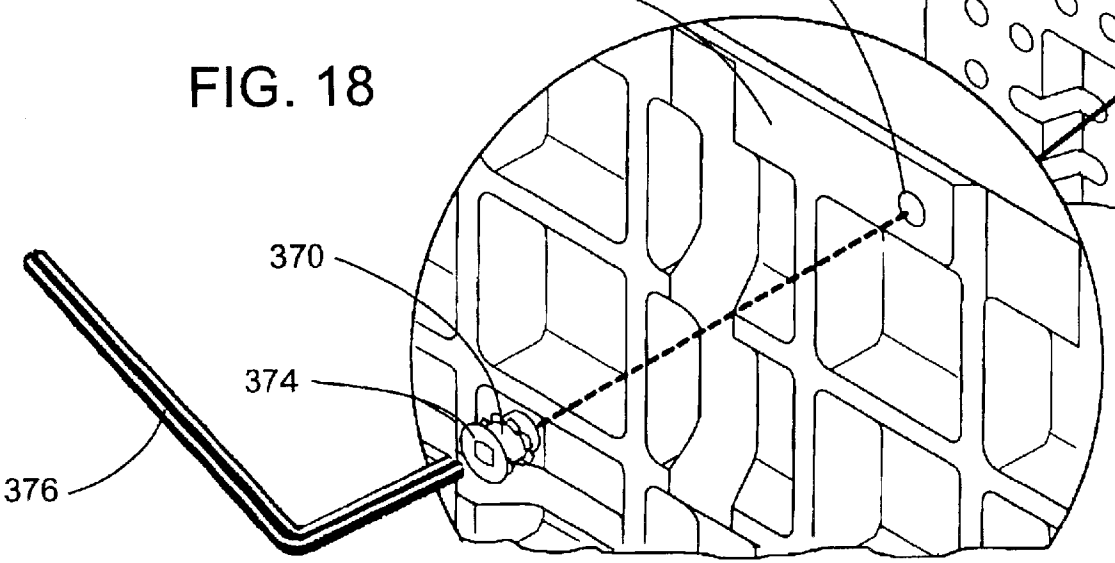
FIG. 18 is an enlarged, exploded detail view taken from FIG. 17.

The panel can be made from material that is dent and scratch resistant. The panel can comprise plastic, preferably high-density polyethylene (HDPE), for example. In other embodiments, the panel can comprise any suitable material, such as a thermoplastic, including low-density polyethylene (LDPE), polypropylene, or polyvinyl chloride (PVC), for example. The panel can be made by a blow-molding process, for example FIGS. 14–16 depict the accessory insert 105. Referring to FIG. 14, the accessory insert 105 is mounted to the panel 102, being disposed in the uppermost second recess 181. The accessory insert 105 is configured to be mountable to the panel 102 within either of the first recesses. Referring to FIG. 15, the accessory insert 105 can be removed from the uppermost second recess 181 and reinstalled in the lower second recess 181, being mounted thereto by a plurality of fasteners 370, as shown in FIG. 16. Referring to FIG. 17, each recess can include a plurality of mounting holes 372 for receiving the fastener 370 therein to releasably retain the accessory insert. Referring to FIG. 18, the fastener 370 can include a head portion 374 having a slot adapted for use with a "hex key" driver 376 to mount the fastener 370 to the mounting hole 372 of the panel 102.

Referring to FIG. 15, the accessory insert 105 can include an accessory surface 380 having a plurality of apertures 382 therethrough. Each recess includes the waffle surface 331 that defines an array of depressions 384. The apertures 382 of the accessory insert 105 can be configured such that when the insert is mounted to one of the recesses, each aperture 382 aligns with one of the depressions 384. The apertures 382 are configured to accommodate one or more accessories each having a retention member operably engageable with the aperture to support the accessory from the accessory insert 105. The accessory can be a coat hook, a shelf, a phone mount, or an organizer, for example. One or more apertures can support the accessories.

The accessory insert 105 can comprise metal, such as steel, or any other suitable material.

Figure 19:
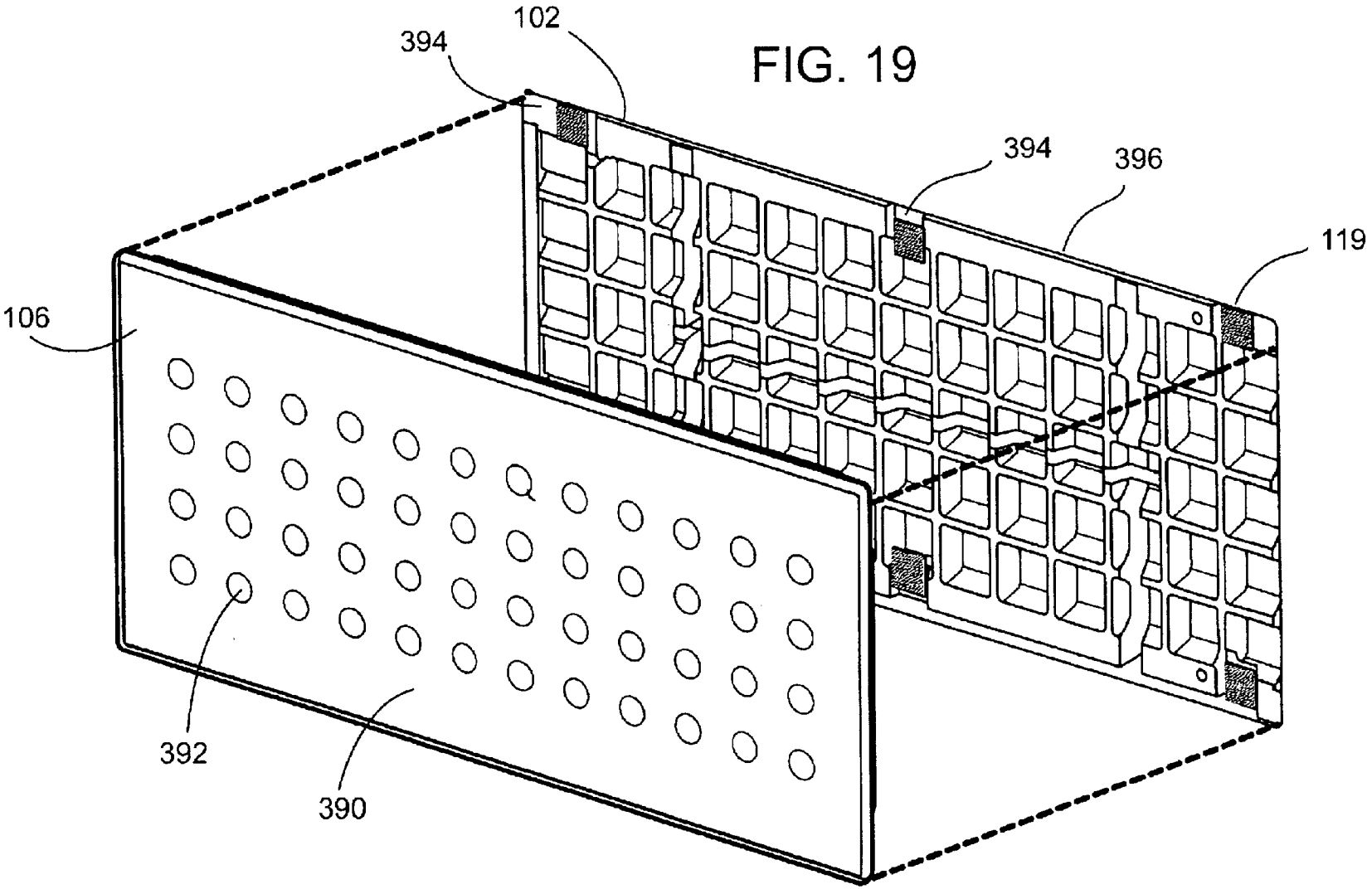
FIG. 19 is a fragmentary, enlarged, exploded view of a tack insert and a panel of the partition system of FIG. 1.

Referring to FIG. 19, the tack insert 106 can be mounted to any one of the recesses of the panel 102. The tack insert 106 is substantially the same size as the accessory insert. The tack insert 106 can include a tack surface 390 for releasably retaining a tack. The tack surface 390 can include a plurality of circular dimples 392 disposed in an array. Each recess can include a plurality of lands 394 disposed around a perimeter 396 of the recess in spaced relation to each other. Each land 394 is configured to receive the hook and loop fastener 119, which can be mounted thereto by an adhesive backing. The hook and loop fastener 119 can have a counterpart piece mounted to the tack insert 106 which is aligned to matingly engage with the fastener 119 mounted to the recess. In the alternative, the tack insert 106 can be mounted directly to the fastener 119 mounted to the recess.

The tack insert can be made from any suitable material, such as closed-cell foam, for example.

Figure 20:
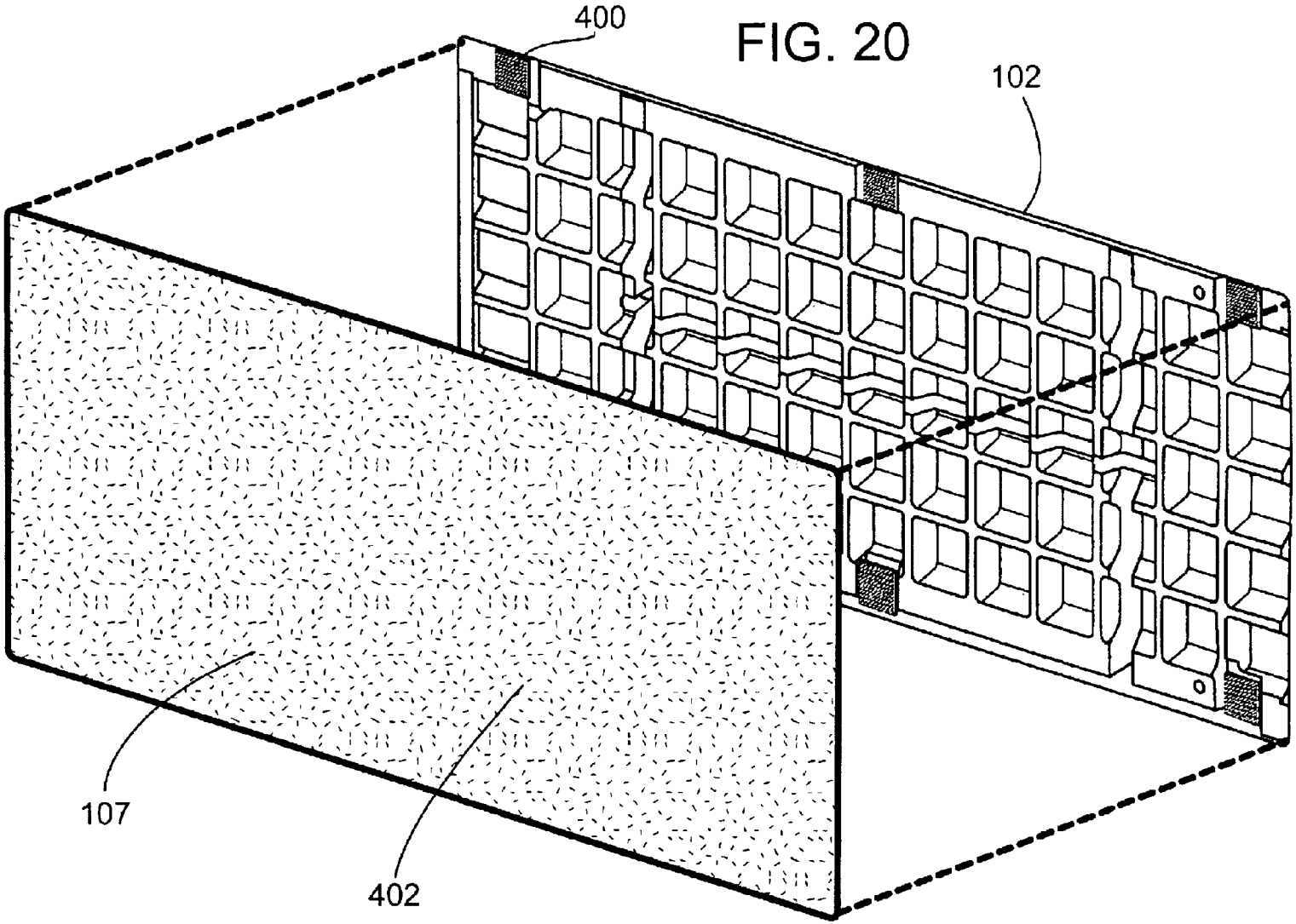
FIG. 20 is a fragmentary, enlarged, exploded view of a inlay insert and a panel of the partition system of FIG. 1.
Figure 23:
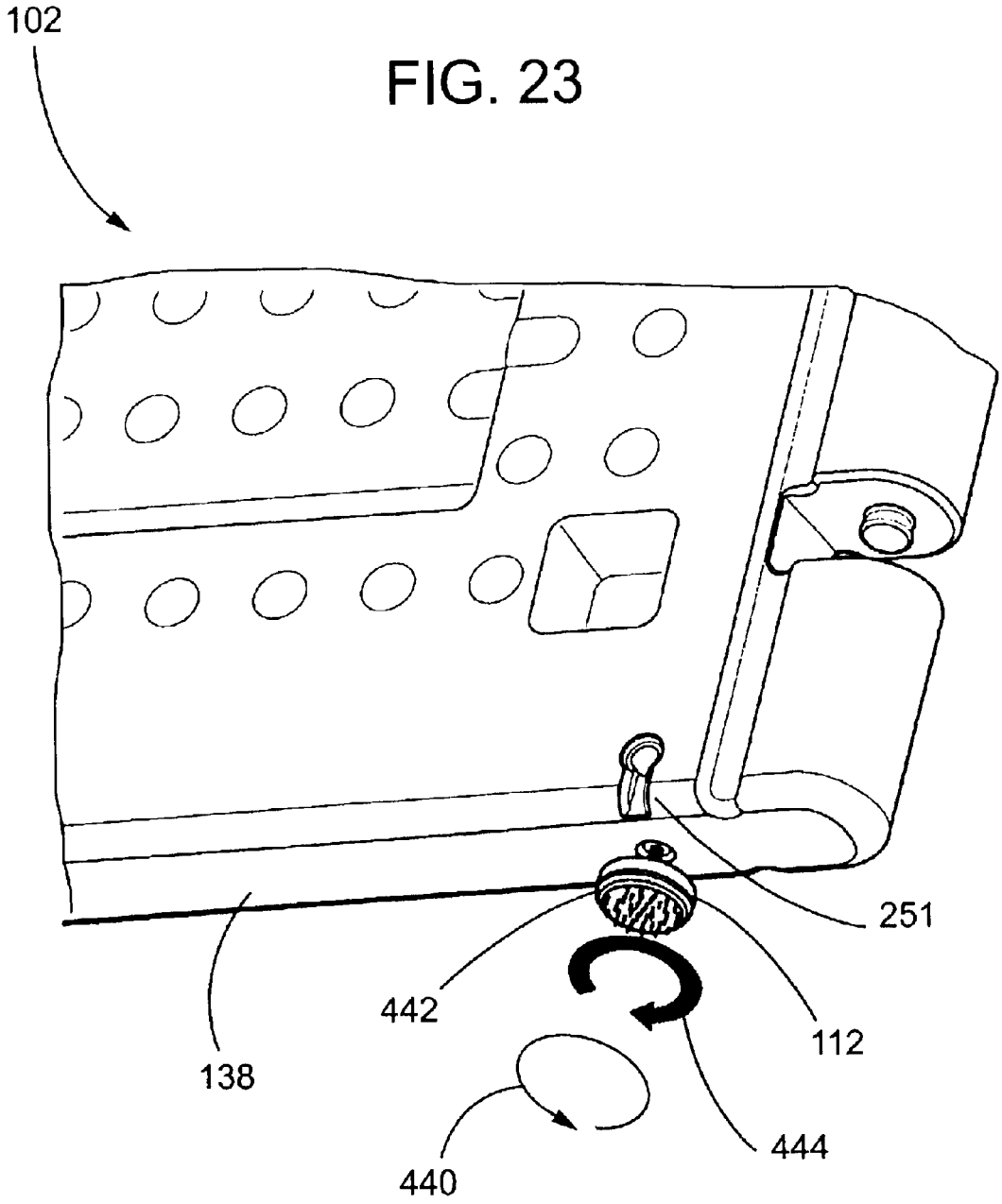
FIG. 23 is a view similar to FIG. 21 illustrating a leveling member mounted to the panel.

Referring to FIG. 20, the inlay insert 107 can be mounted to any one of the recesses of the panel 102. The inlay insert 107 is substantially the same size as the accessory insert and the tack insert. The inlay insert 107 can be mounted to any one of the recesses in a fashion similar to the mounting of the tack insert. FIG. 23 shows a plurality of hook and loop fasteners 400 mounted to the recess, which can be used to engage a counterpart fastener mounted to the inlay insert 107. The insert 107 can include an inlay surface 402. The inlay surface 402 can comprise wood, plastic or any other suitable material suitable for presenting a selected, decorative appearance.

Figure 21:
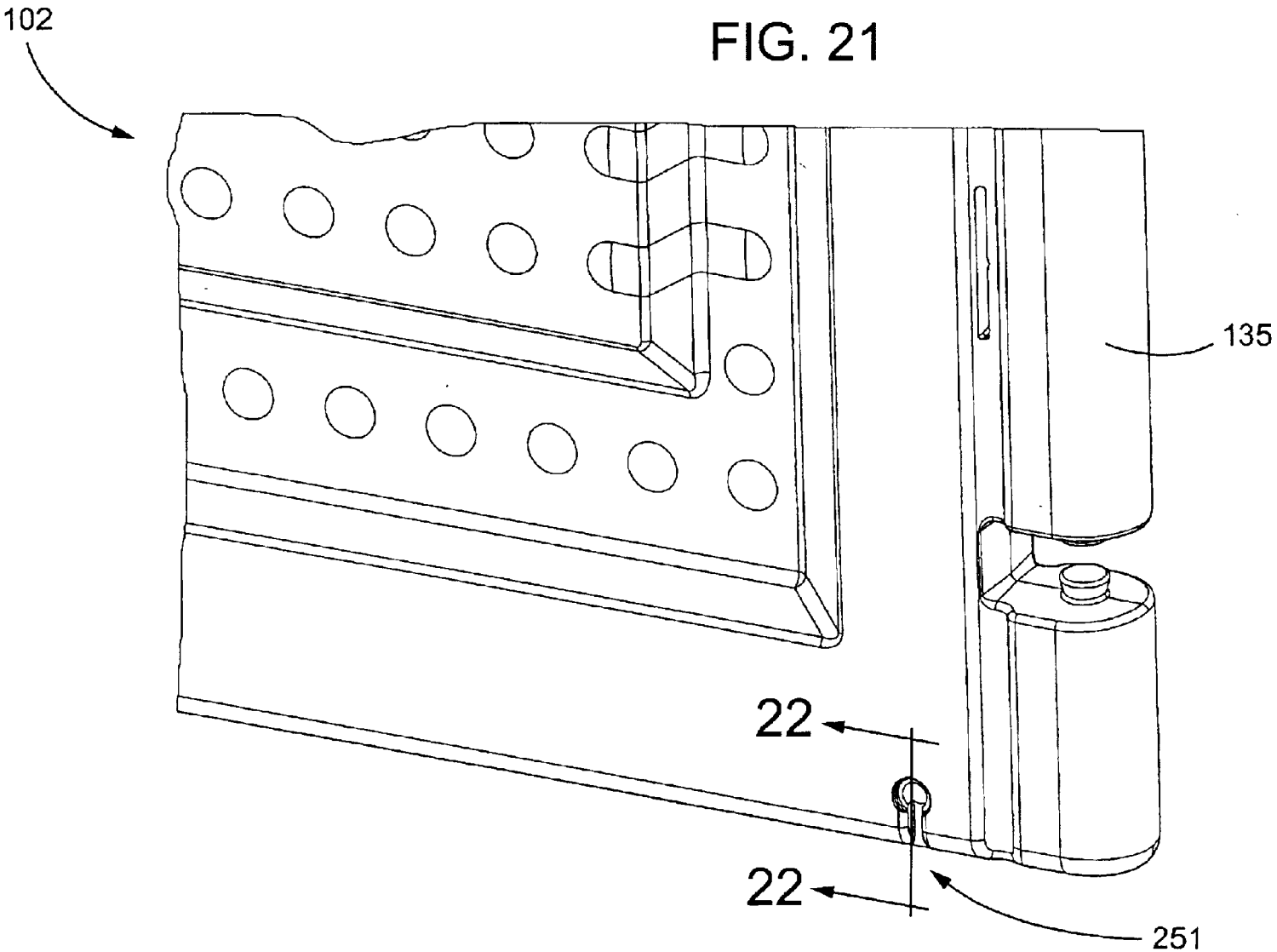
FIG. 21 is an enlarged, fragmentary perspective view of the panel of FIG. 2 illustrating a leveler-receiving structure.

Referring to FIGS. 21–24, the second leveler-receiving structure is shown. The second leveler-receiving structure 251 disposed adjacent the second end 135 of the panel 102 is shown in FIG. 21. The first leveler-receiving structure is similar to the second leveler-receiving structure 251. As such, the description of the second leveler-receiving structure 251 is applicable to the first leveler-receiving structure, as well.

Figure 22:
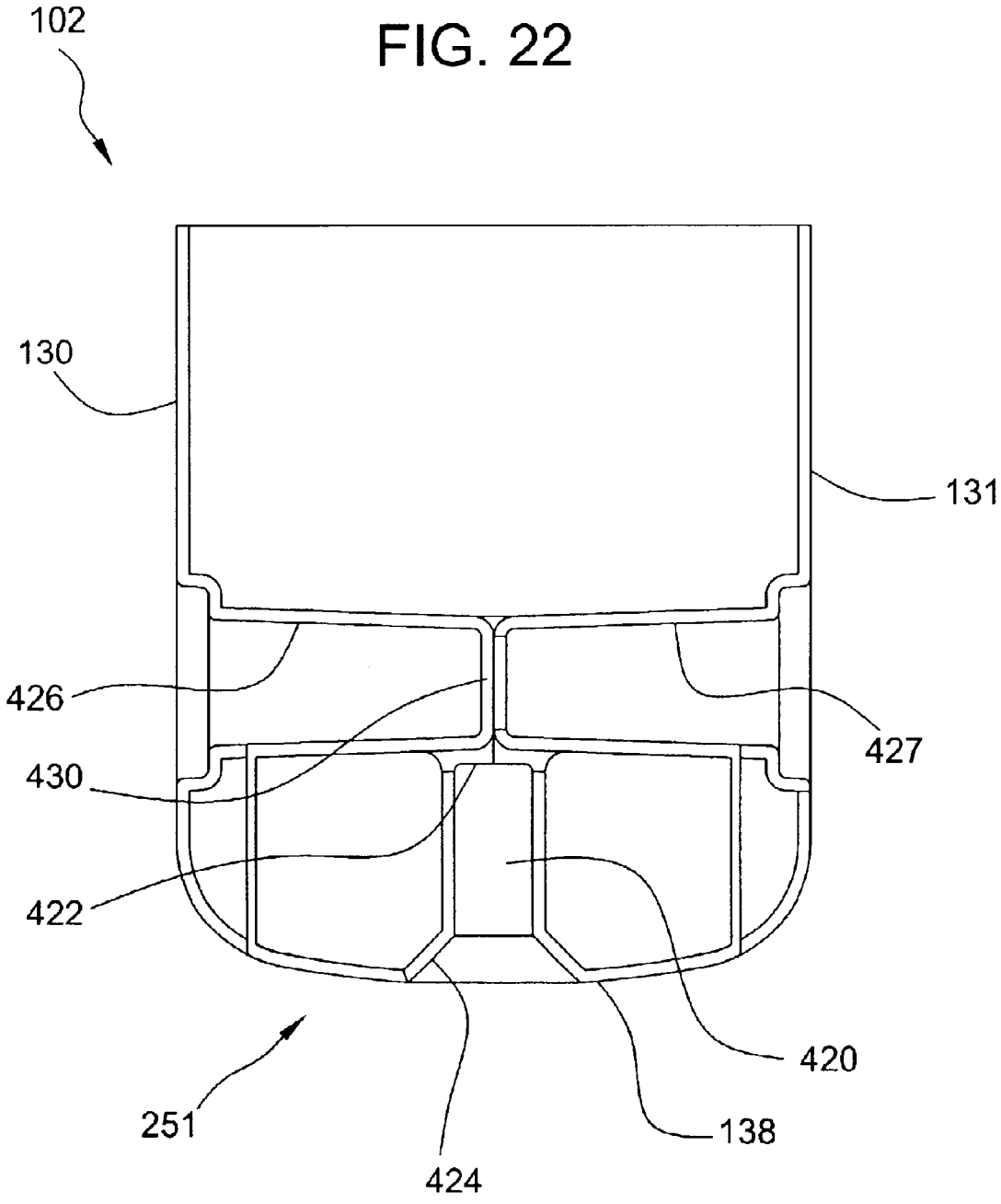
FIG. 22 is a cross-sectional view taken along line 22—22 in FIG. 21.

Referring to FIG. 22, the leveler-receiving structure 251 includes a leveler bore 420 which opens to the bottom 138 of the panel 102 and terminates in a base 422. The leveler bore 420 includes a countersink area 424 adjacent the bottom 138. The leveler-receiving structure 251 includes a pair of support bores 426, 427 extending respectively from the first and second face 130, 131 of the panel 102. The support bores 426, 427 are axially aligned with each other and include a common wall 430 therebetween. The leveler bore 420 depends from the support bores 426, 427 and is integral therewith. The support bores 426, 427 can act to provide structural rigidity to the leveler bore 420 and to facilitate the mounting of the leveling member of the panel 102.

Referring to FIG. 23, the leveling member 112 is adjustably mounted to the panel 102 for orienting the panel 102 with respect to a floor surface in a desired position. The leveling member 112 can be adjusted relative to the bottom 138 of the panel 102 by rotating the leveling member 112 in either an extension direction 440 to increase the vertical distance between the bottom 138 of the panel 102 and a base 442 of the leveling member 112 or in a retraction direction 444 to decrease the distance between the base 442 and the bottom 138.

Figure 24:
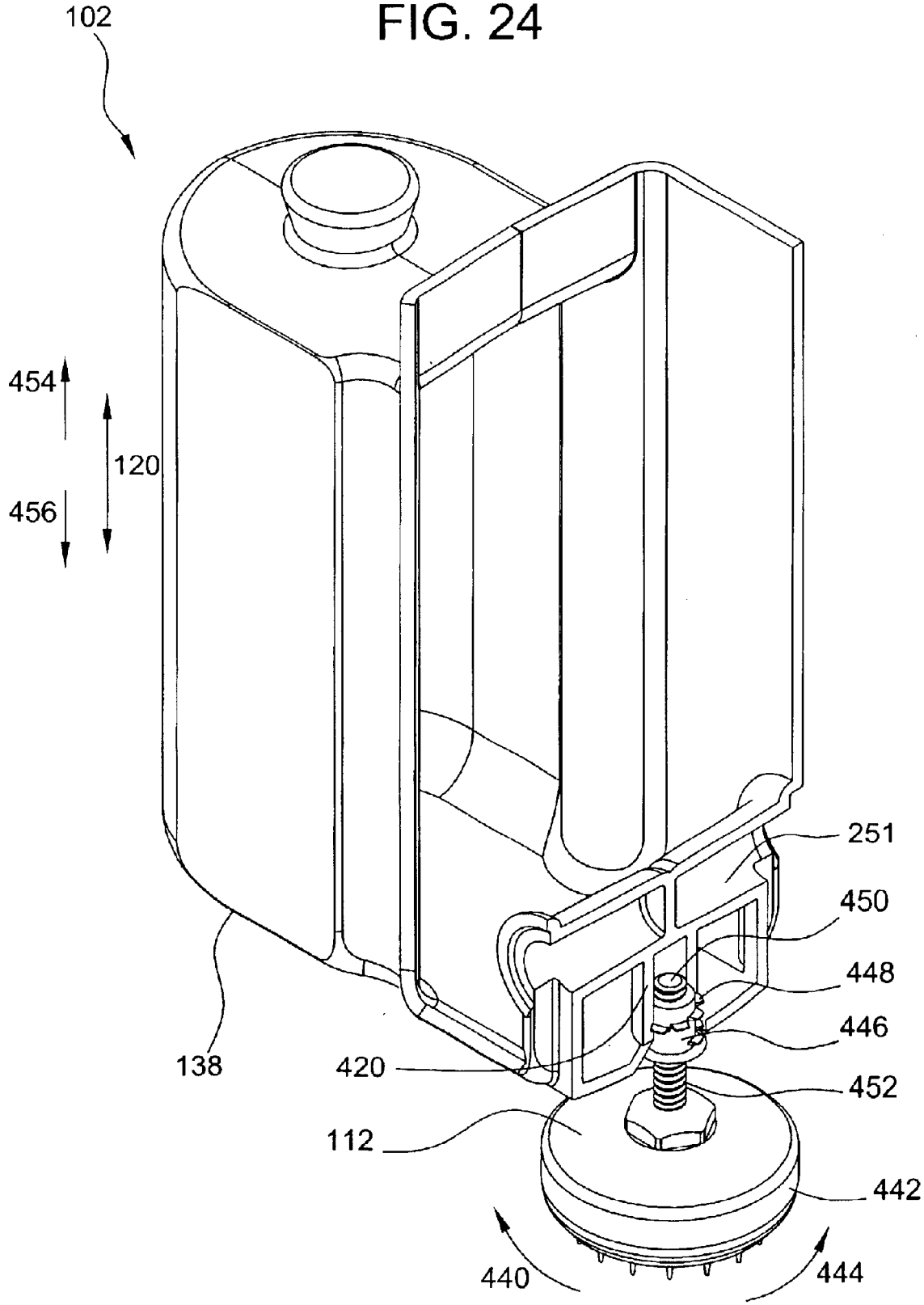
FIG. 24 is an enlarged, fragmentary, broken away, perspective view of the panel and the leveling member of FIG. 23.
Figure 25:
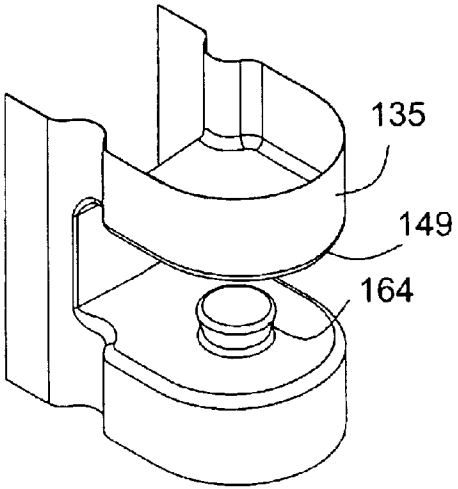
FIG. 25 is a fragmentary, broken away, perspective view of the panel of FIG. 2 illustrating a connector port.

Referring to FIG. 24, a fastener 446 can be inserted into the leveler bore 420 and retained therein by a plurality of tabs 448 disposed on the fastener 446. The fastener 446 includes a through hole having a threaded wall surface. The leveling member 112 includes a stud 450 having a threaded external surface 452 that can threadingly engage the threaded interior surface of the fastener 446 to retain the leveling member 112 relative to the fastener 446. The base 442 of the leveling member 112 can be adjusted relative to the bottom 138 of the panel 102 by rotating the leveling member in either the extension direction 440 or the retraction direction 444. The threaded stud 450 can move axially relative to the fastener 446 in either an upward direction 454 or a downward direction 456 along the vertical axis 120 responsive to rotation of the leveling member 112 in the retraction direction 454 and the extension direction 440, respectively.

Figure 26:
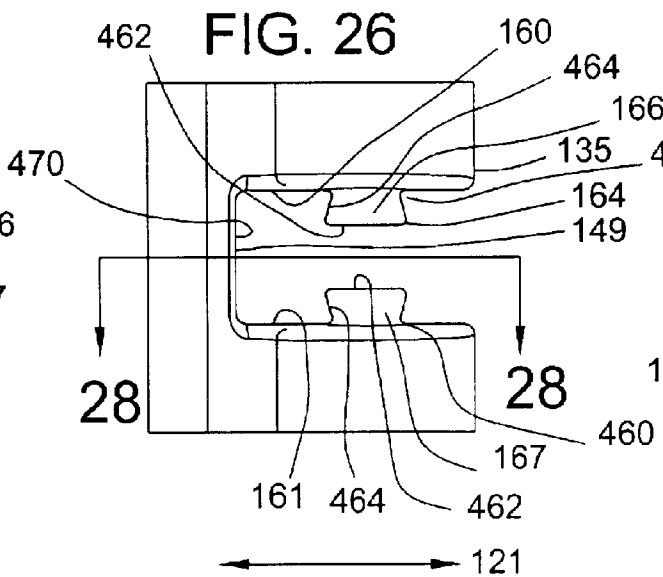
FIG. 26 is a front elevational view of the panel of FIG. 25.

FIGS. 25–29 depict an exemplary connector port 149 and exemplary connecting element 164. The description of the connector port 149 of the second end 135 is applicable to the connector port of the first end, as well. Referring to FIG. 26, the connecting element 164 includes an upper post 166 and a lower post 167 extending toward each other from the upper surface 160 and the lower surface 161 of the connector port 149, respectively. The posts 166, 167 are similar to each other, being generally of the same size.

Figure 27:
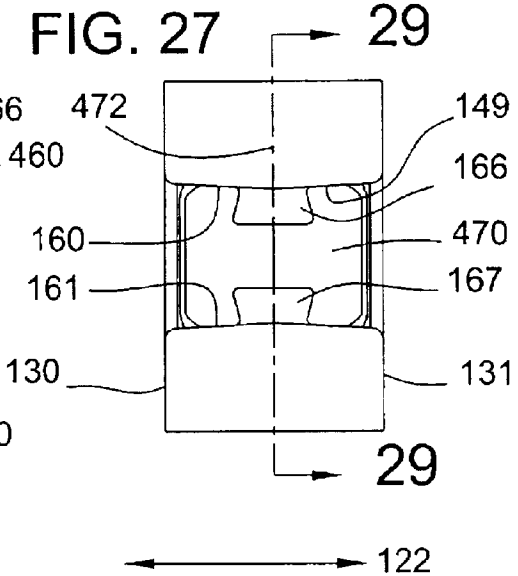
FIG. 27 is an end elevational view of the panel of FIG. 25.

Referring to FIG. 26, each post 166, 167 includes a base 460 adjacent the respective surface 160, 161 of the connector port 149 and extends to a free end 462 with a circumferential sidewall 464 extending therebetween. The posts 166, 167 are aligned with each other along the horizontal axis 121 and along the transverse axis 122, as shown in FIG. 27. The connector port 149 includes an end wall 470 extending between the upper surface 160 and the lower surface 161 thereof. Referring to FIG. 26, the posts 166, 167 are disposed along the horizontal axis 121 between the end wall 470 and the extremity of the second end 135 of the panel 102. Referring to FIG. 27, the posts 166, 167 are disposed along the transverse axis 122 such that they are aligned with each other generally at a midpoint 472 along the transverse axis 122 between the first face 130 and the second face 131.

Figure 28:
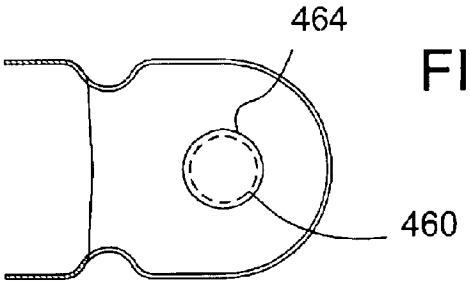
FIG. 28 is a cross-sectional view taken along line 28—28 in FIG. 26.

Referring to FIG. 28, the base 460 and the free end 464 are both generally circular with the base 460 being relatively smaller than the free end 464 such that the circumferential sidewall tapers outwardly as it extends from the base to the free end. Referring to FIG. 28, each post 166, 167 is hollow.

Figure 30:
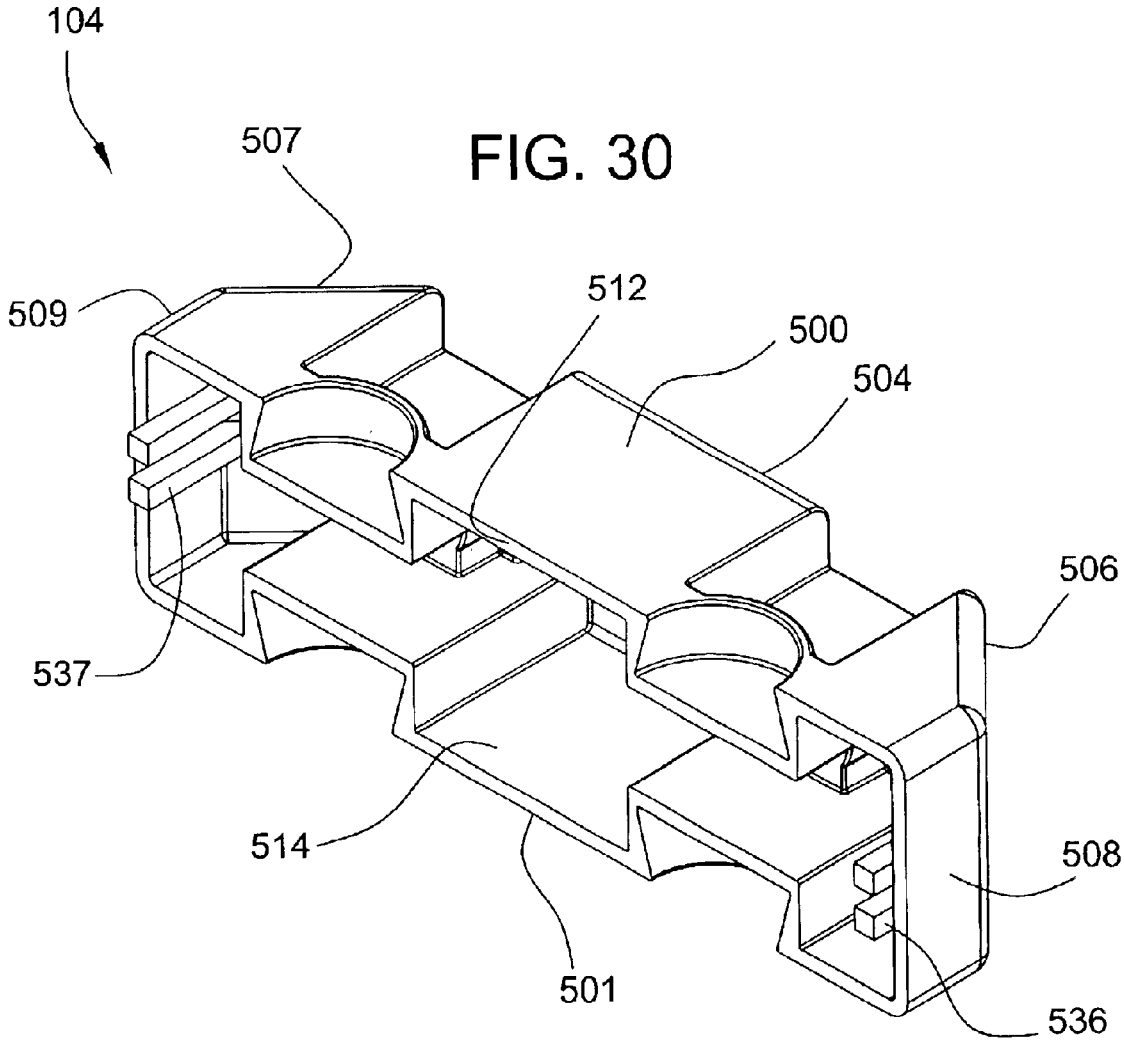
FIG. 30 is a first perspective view of a connector link member of the partition system of FIG. 1.
Figure 31:
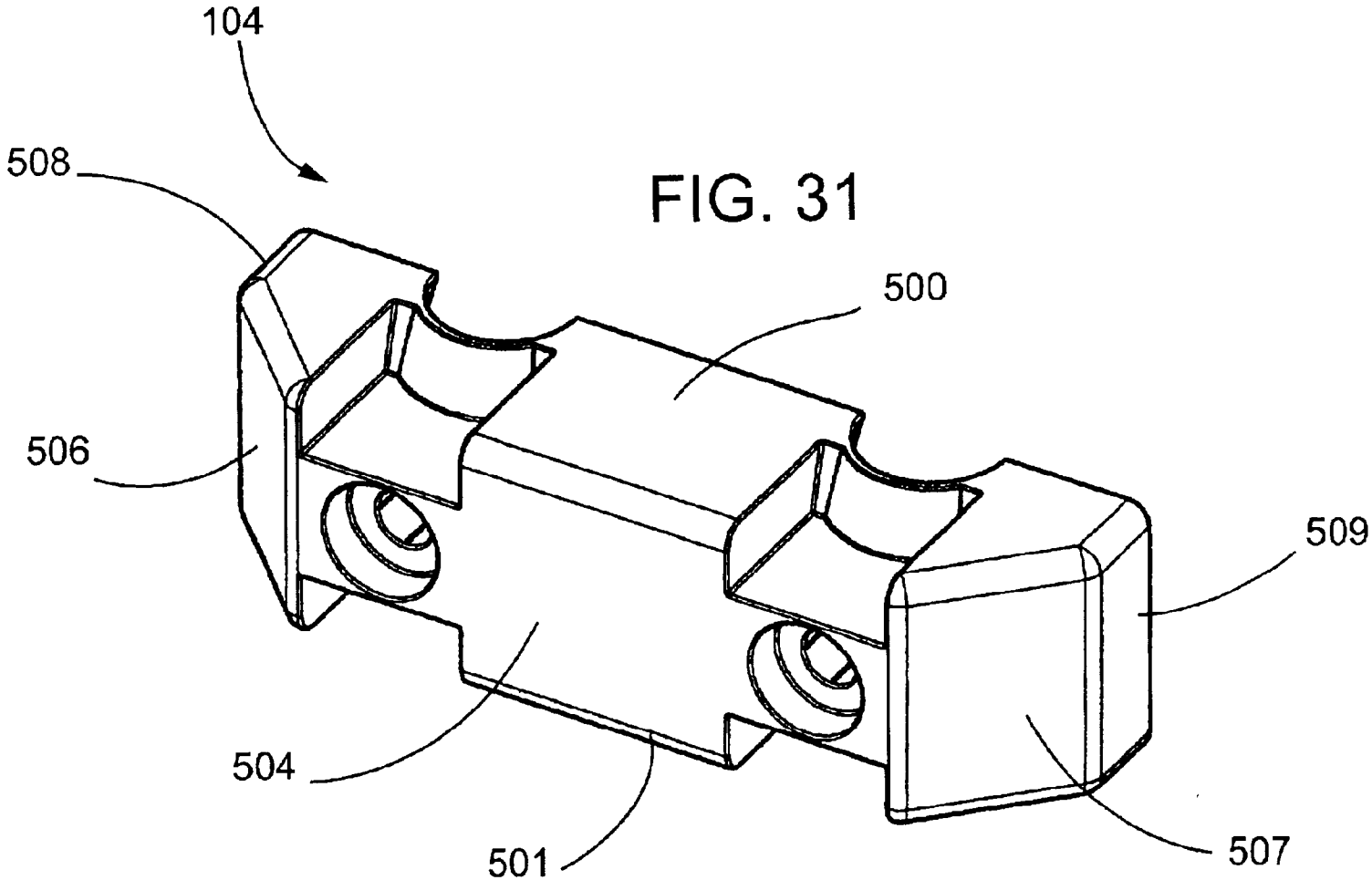
FIG. 31 is a second perspective view of the connector link member of FIG. 30.

FIGS. 30–36 depict the connector link member 104. Referring to FIGS. 30 and 31, the connector link member 104 includes first and second connecting surfaces 500, 501 in spaced relationship to each other, a face 504 extending therebetween, a pair of bevel surfaces 506, 507 flanking the face 504 and extending between the connecting surfaces 500, 501, a pair of ends 508, 509 respectively extending from the bevel surfaces 506, 507 and extending between the connecting surfaces 500, 501, a mating surface 512 opposing the face 504, and an interior surface 514.

Figures 32, 33, 34:
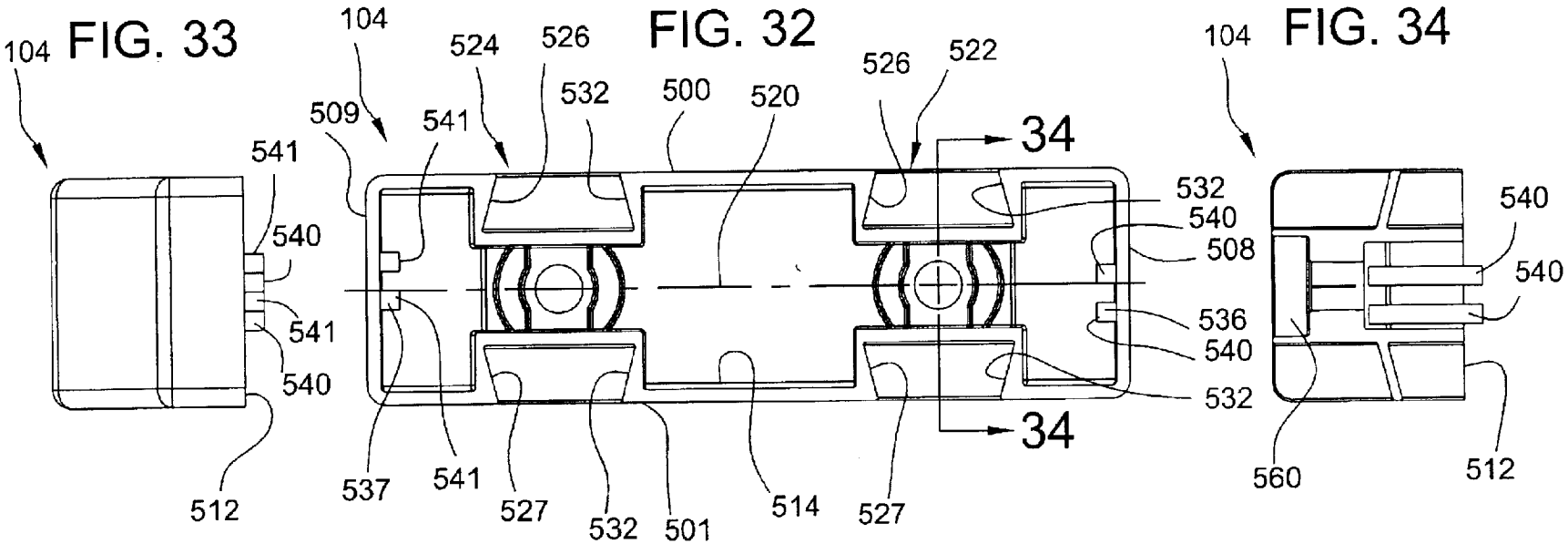
FIG. 32 is a first elevational view of the connector link member of FIG. 30.
FIG. 33 is an end elevational view of the connector link member of FIG. 30.
FIG. 34 is a cross-sectional view taken along line 34—34 in FIG. 32.

Referring to FIG. 32, the first and second connecting surfaces 500, 501 are substantially the same as each other, being symmetrical about a central, longitudinal axis 520. The connector link member 104 includes a first retaining element 522 and a second retaining element 524. Both retaining elements 522, 524 can be configured to be removably mountable to the panel via the connecting element.

Each retaining element 522, 524 of the connector link member 104 includes a pair of tapered keyways 526, 527, which are respectively configured to retentively engage the posts of one of the connecting elements. The first and second keyways 526, 527 of the first retaining element 522 are respectively disposed on the first and second connecting surfaces 500, 501. The first and second keyways 526, 527 of the second retaining element 524 are respectively disposed on the first and second connecting surfaces 500, 501. Each keyway includes a wall surface 532 disposed at an angle oriented to generally correspond to the tapered circumferential sidewall of the post.

Referring to FIGS. 30 and 32, the connector link member 104 includes a pair of latch mechanisms 536, 537 for releasably engaging another connector link member. The first and second latch mechanisms 536, 537 of the connector link member 104 are disposed to matingly engage the second and first latch mechanisms of a second connector link member, respectively. The first and second latch mechanisms 536, 537 are disposed on the interior surface 514 of the connector link member 104, respectively adjacent the first and second ends 508, 509. Referring to FIG. 32, the first latch mechanism 536 is disposed a predetermined distance from the central axis 520 toward the second connecting surface 501. The second latch mechanism 537 is disposed an equal distance from the central axis 520 toward the first connecting surface 500. Each latch mechanism 536, 537 includes a pair of fingers 540, 541, respectively, disposed at an offset position with respect to the central axis 520 such that when the mating faces of two connector link members are aligned, the latch mechanisms engage each other to retain the connector link members such that the fingers of each latch mechanism interdigitate with the fingers of the latch mechanism matingly engaged thereto.

Referring to FIGS. 33 and 34, each finger 540, 541 includes an end that projects from the mating surface 512 of the connector link member 104.

Figure 36:
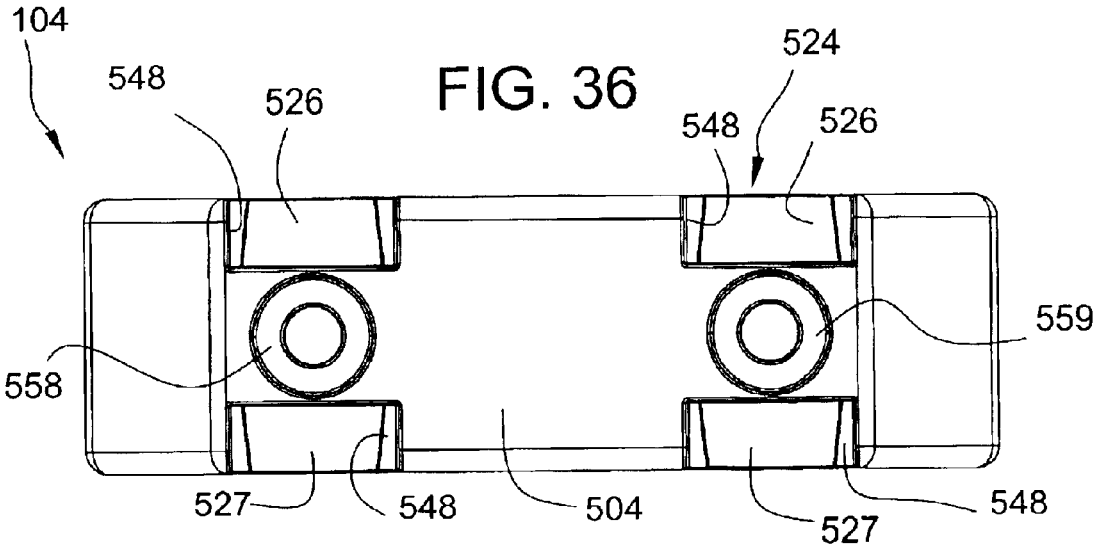
FIG. 36 is a second elevational view of the connector link member of FIG. 30.
Figure 35:
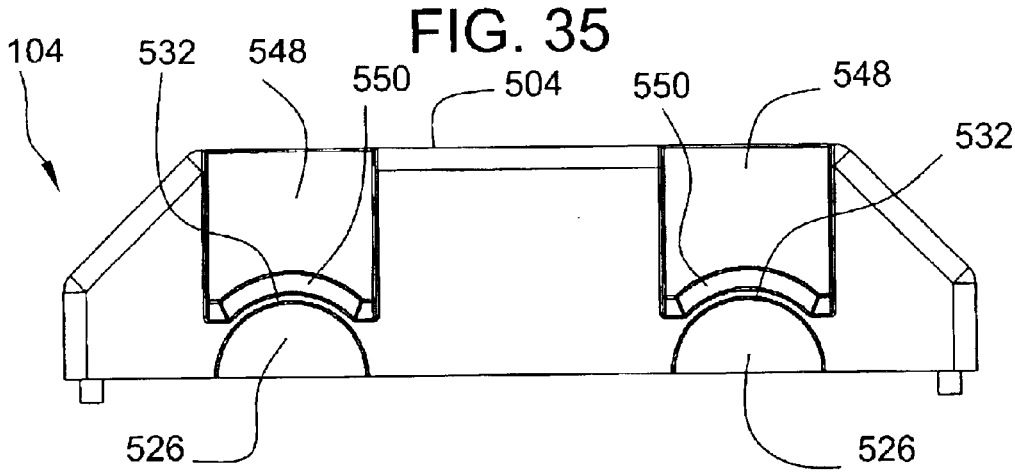
FIG. 35 is a plan view of the connector link member of FIG. 30.

Referring to FIGS. 35 and 36, for each keyway 526, 527, a channel 548 extends from the face 504 of the connector link member 104 toward the respective keyway 526, 527. Each channel 548 has a generally rectangular shape defined by a pair of sidewalls and a bottom. Referring to FIG. 35, each channel 548 terminates in an end wall 550 that generally conforms to the curvature of the keyway. The end wall 550 cooperates with the keyway to define a portion of the circumferential wall surface 532 of the keyway. The channels 548 can be provided to facilitate the manufacture of the connector link member and to reduce material usage.

Referring to FIG. 36, to mount the connector link member 104 to a second connector link member, first and second mounting holes 558, 559 can be provided for receiving screws therethrough. The first and second mounting holes 558, 559 are disposed in the face 504. The first mounting hole 558 is disposed between the keyways 526, 527 of the first retaining element 522, and the second mounting hole 559 is disposed between the keyways 526, 527 of the second retaining element 524. Referring to FIG. 34, each mounting hole can include a counter bore 560.

The connector link member can comprise plastic, such as ABS, for example, or any other suitable material. The connector link member can be made by injection-molding, for example, or any other suitable technique.

Figure 37:
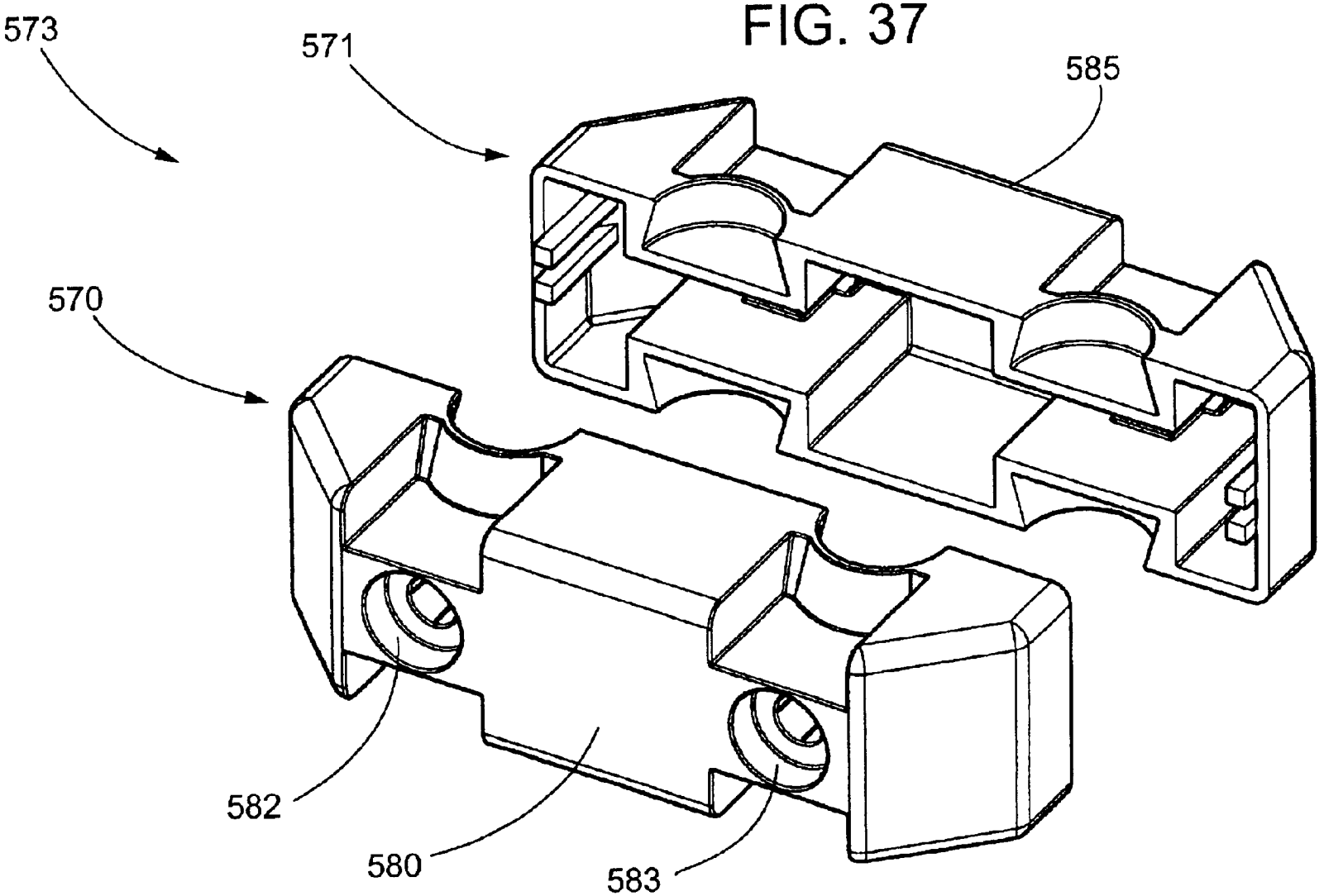
FIG. 37 is an exploded, perspective view of a pair of connector link members of a connector link assembly of the partition system of FIG. 1.
Figure 38:
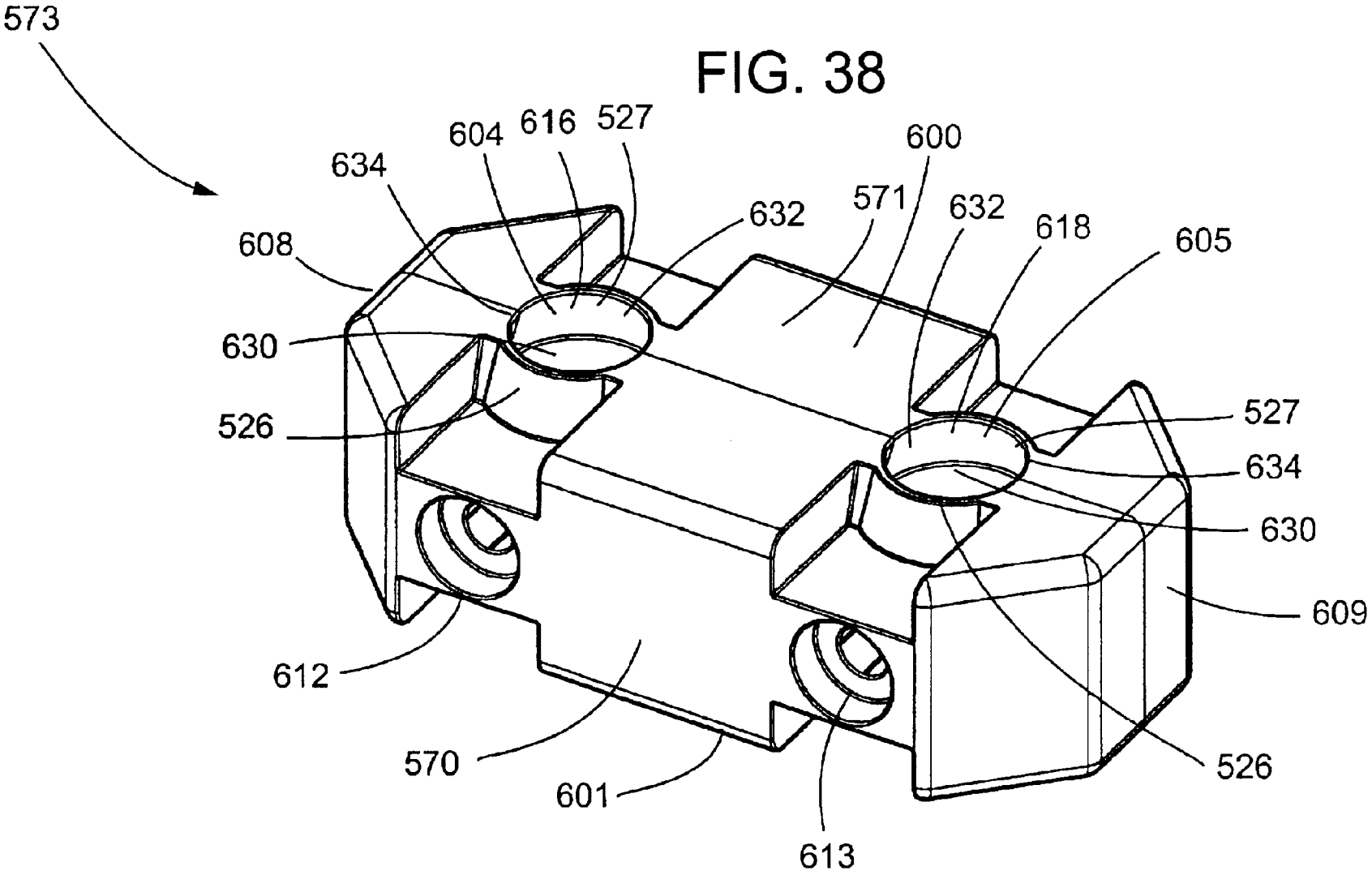
FIG. 38 is a view as in FIG. 37 except with the connector link members mounted together.
Figure 39:
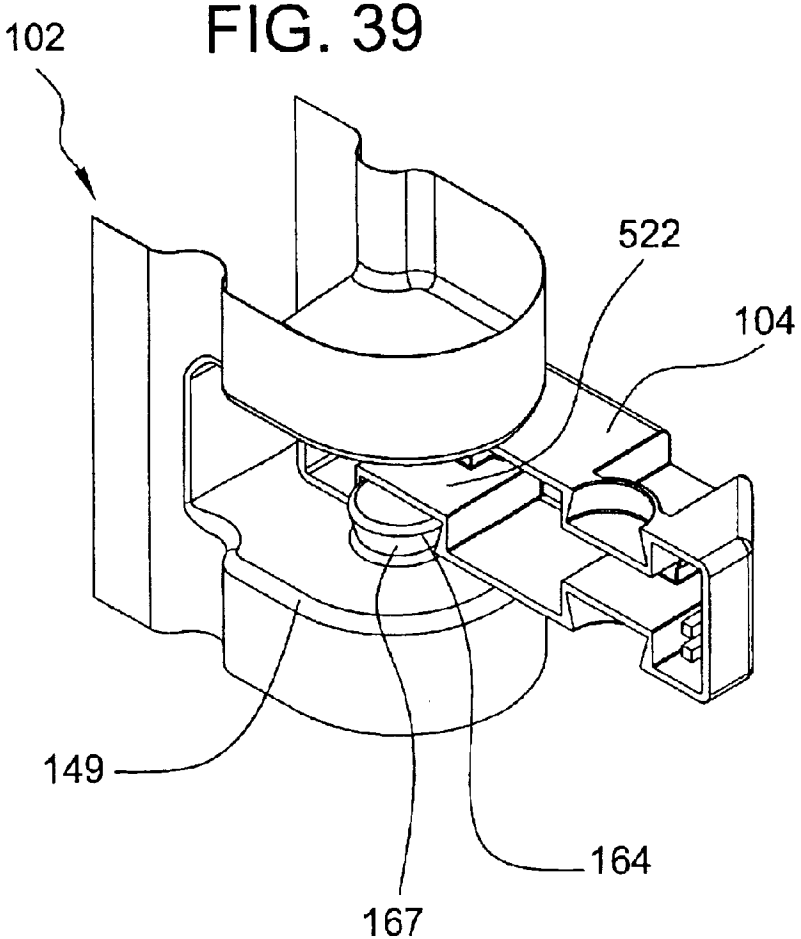
FIG. 39 is a view of the panel as in FIG. 25 with the connector link member of FIG. 30 mounted thereto.

FIGS. 37 and 38 show a pair of connector link members 570, 571 that can be mounted together to define a connector link assembly 573. Referring to FIG. 37, the first connector link member 570 includes a first face surface 580 with a pair of first mounting holes 582, 583 therethrough. The second connector link member 571 includes a second face surface 585 with a pair of second mounting holes therethrough. The first mounting holes can be axially aligned with the second mounting holes, respectively, for receiving a pair of screws therethrough to retain the pair of connector link members together.

Referring to FIG. 38, the connector link assembly 573 includes a first connector side 600, a second connector side 601, a first retaining assembly 604, and a second retaining assembly 605. The connector link assembly 573 includes a pair of chamfered ends 608, 609. The connector link assembly 573 can include a pair of securing screws respectively mounted in first and second pairs of mounting holes 612, 613.

The first retaining assembly 604 includes a pair of retaining enclosures 616 respectively disposed on the first and second connector sides 600, 601. The second retaining assembly 605 includes a pair of retaining enclosures 618 respectively disposed on the first and second connector sides 600, 601. Each retaining enclosure 616, 618 is in the form of a socket configured to retentively engage one of the posts of the connecting element. The post can be inserted into the socket such that the socket surrounds the post.

The pair of first tapered keyways 526 of the first connector link member 570 and the pair of second tapered keyways 527 of the second connector link member 571 respectively define each socket 616, 618 of the first connector side 600. Each socket 616, 618 includes a base 630, a circumferential wall surface 632 extending from the base 630, and an opening 634. The wall surface 632 is tapered such that the size of the opening 634 is smaller than the size of the base 630. The wall surface 632 is configured to generally conform to the circumferential sidewall of the post. The opening 634 is configured to generally correspond to the size of the base of the post, and the base 630 of each socket 616, 618 is configured to generally correspond to the size of the end of the post such that the socket can be constrained from moving with respect to the posts.

Figure 40:
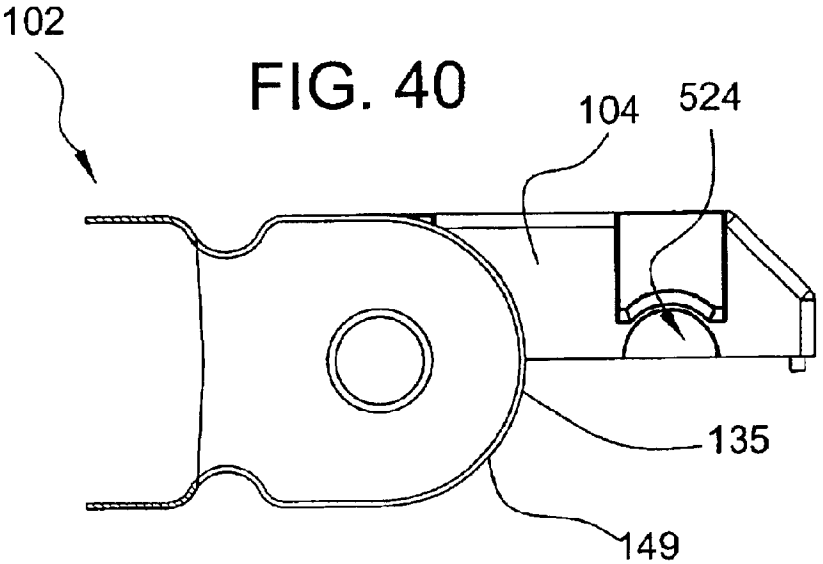
FIG. 40 is a plan view of the panel and the connector link member of FIG. 39.
Figure 42:
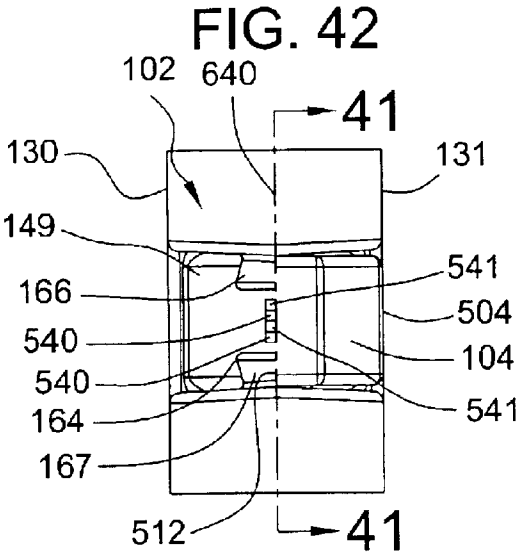
FIG. 42 is an end elevational view of the panel and the connector link member of FIG. 39.
Figure 41:
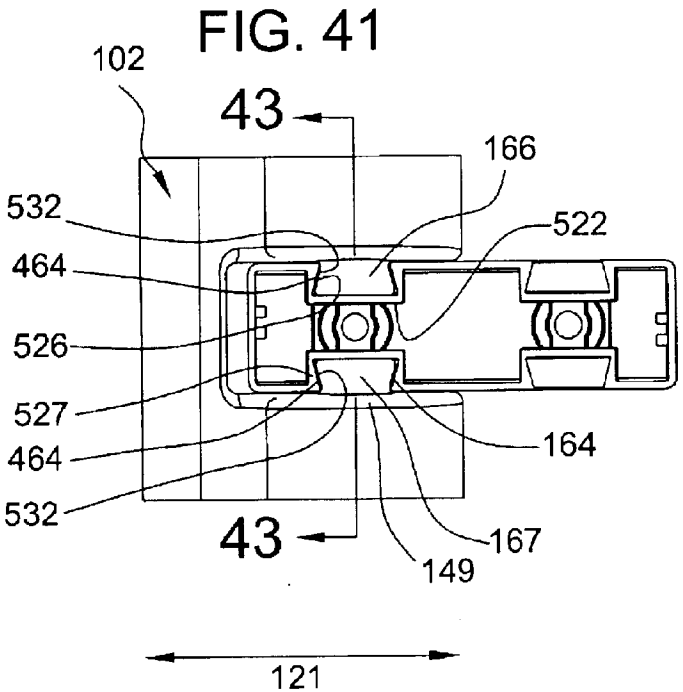
FIG. 41 is an elevational view of the panel and the connector link member of FIG. 39.
Figure 43:
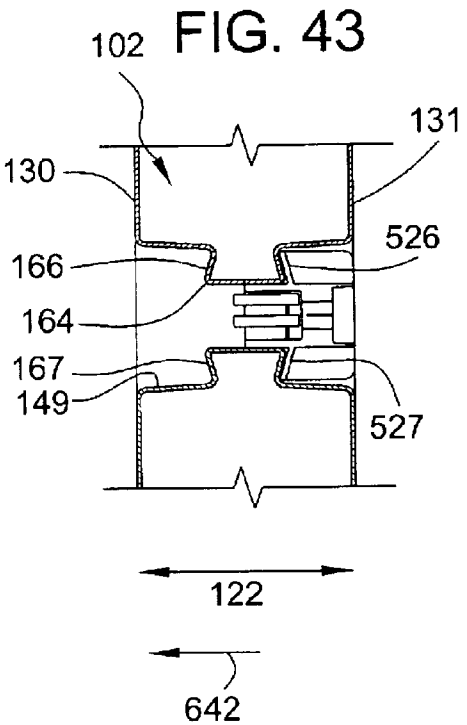
FIG. 43 is a cross-sectional view taken along line 43—43 in FIG. 41.

Referring to FIGS. 39–43, the connector link member 104 is shown disposed within a selected one of the connector ports 149 of the panel 102 such that the first retaining element 522 of the connector link member 104 is engaged with the posts 166, 167 of the connecting element 164 disposed within the connector port 149. Referring to FIG. 40, the second retaining element 524 of the connector link member 104 extends from the end 135 of the panel 102. Referring to FIG. 41, the respective engagement of the keyways 526, 527 and the posts 166, 167 prevent the connector link member 104 from moving with respect to the panel 102 along the horizontal axis 121. The wall surface 532 of each keyway generally corresponds to the circumferential sidewall 464 of the post to which it is engaged. Referring to FIG. 42, the connector link member 104 can be engaged with the connecting element 164 such that the mating surface 512 of the connector link member 104 can be positioned along a central axis 640 of the posts 166, 167. The ends of the fingers 540, 541 are configured to extend from the mating surface 512 beyond the central axis 640 of the posts 166, 167. The face 504 of the connector link member 104 is substantially flush with the second face 131 of the panel 102. Referring to FIG. 43, the respective engagement of the keyways 526, 527 and the posts 166, 167 prevents the connector link member 104 from moving along the transverse axis 122 from the second face 131 toward the first face 130, as indicated by an arrow 642 in FIG, 43.

Figure 44:
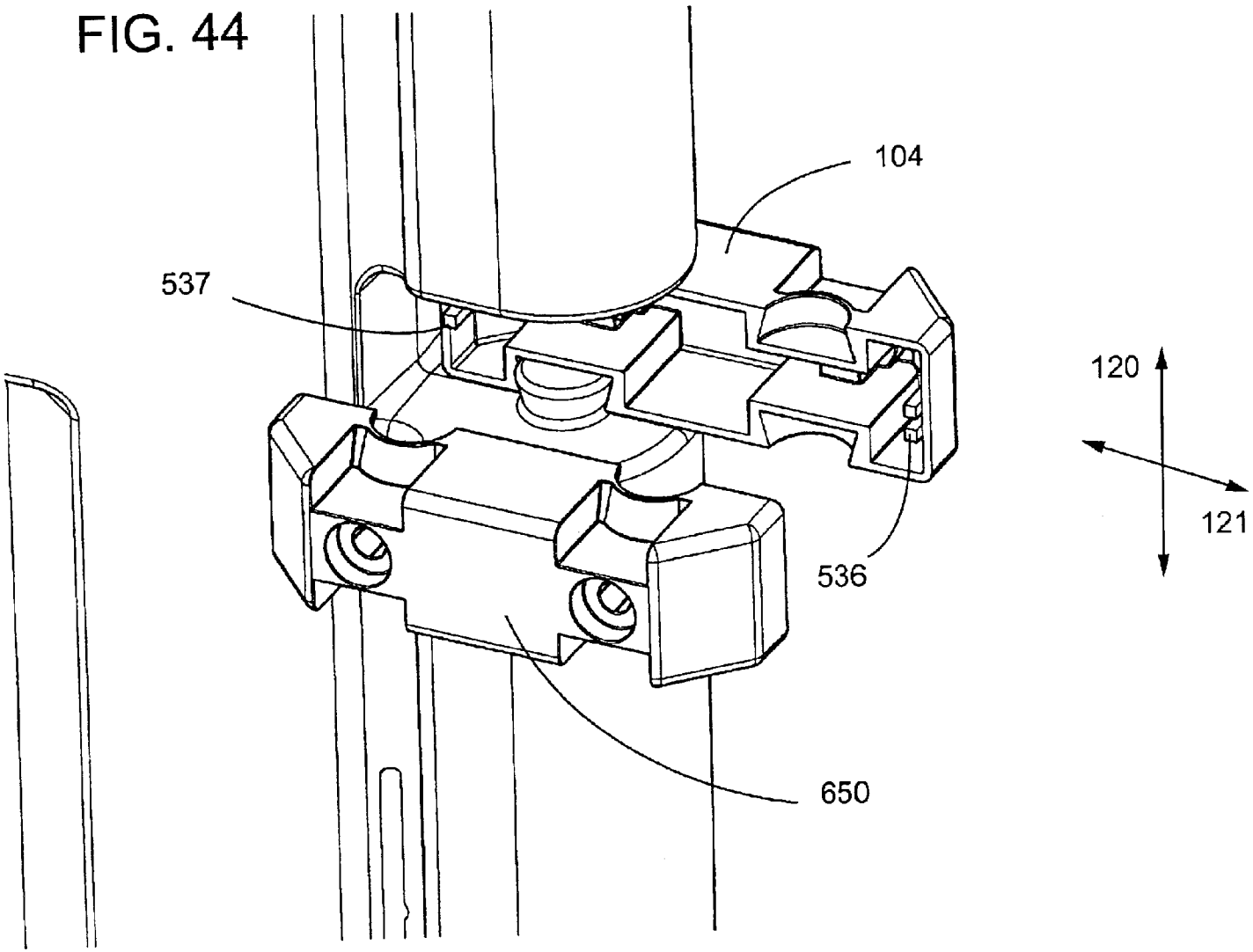
FIG. 44 is a view of the panel similar to FIG. 25 with the connector link member of FIG. 30 mounted thereto and a second connector link member exploded therefrom.

Referring to FIG. 44, a second connector link member 650 can be mounted to the first connector link member 104 by joining the mating surfaces thereof. The first latch mechanism 536 and the second latch mechanism 537 of the first connector link member 104 can respectively engage the second latch mechanism and the first latch mechanism of the second connector link member 650 to facilitate the alignment of the connector link members 104, 650 and to retain the members 104, 650 along the vertical axis 120 and the horizontal axis 121.

Figures 45, 46:
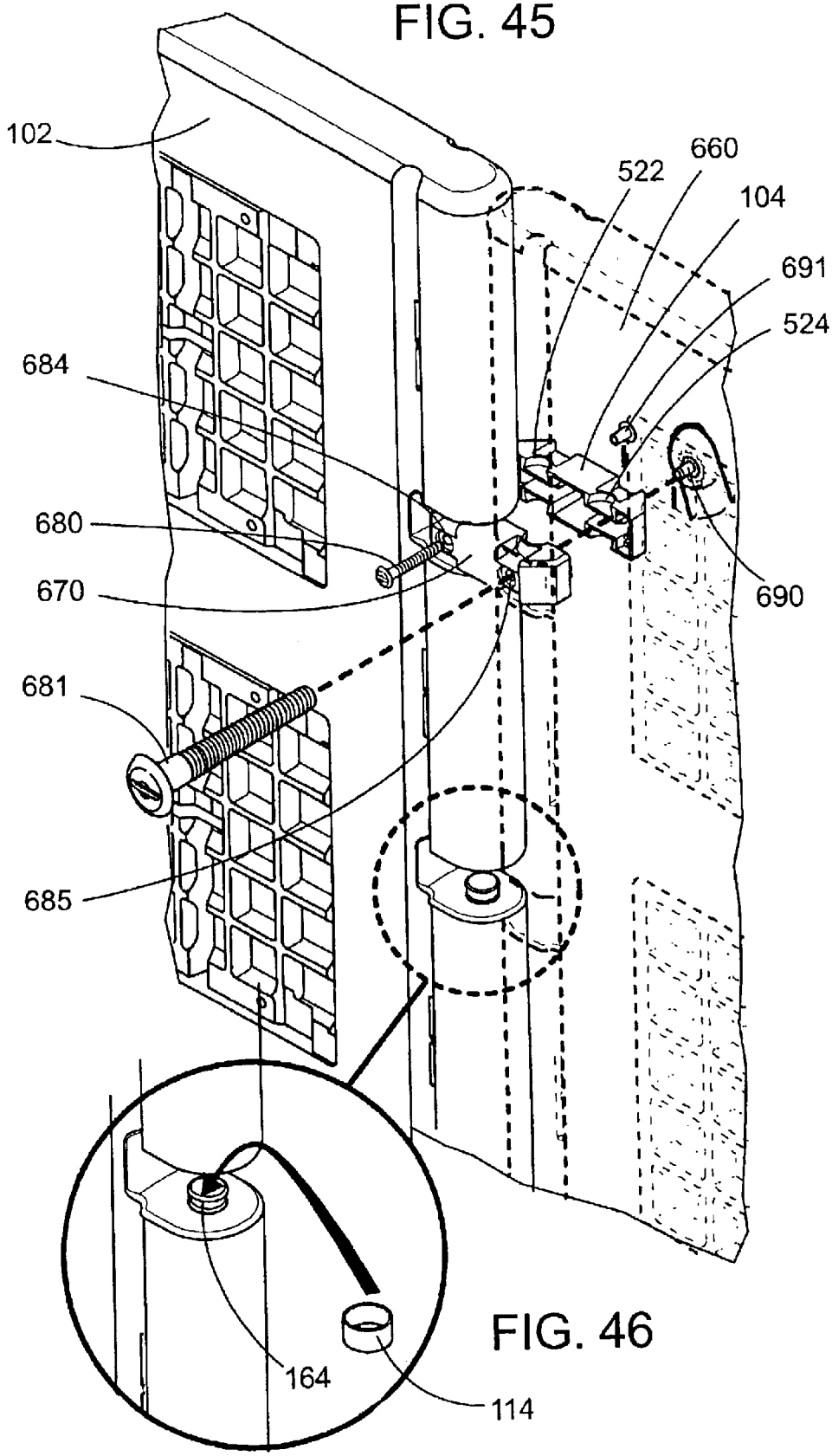
FIG. 45 is a partially exploded, perspective view of a pair of panels and a connector link assembly of the partition system of FIG. 1.
FIG. 46 is an enlarged detail, exploded view taken from FIG. 45 illustrating a friction ring of the partition system of FIG. 1.

Referring to FIG. 45, the connector link member 104 is adapted to join a pair of panels 102, 660 together by mounting the first retaining element 522 to the connecting element of the first panel 102 and the second retaining element 524 to the connecting element of the other of the panels 660. The connector link member 104 can join the panels 102, 660 together such that the panels are disposed at a desired angle with respect to each other, such as an acute angle, an obtuse angle, a 90° angle, or an 180° angle, for example. The ends of each panel include a curved, convex surface to facilitate the mounting of the panels at a desired angle. The curved surfaces of the ends allow the panels to be positioned such that the connector link member can be mounted to both panels without the panels interfering with each other.

The connector link member 104 can be configured to mate to another connector link member 670 to define a connector link assembly. The connector link assembly can be used to join the panels 102, 660 together. The second connector link member 670 can be identical to the first link member 104. The second connector link member 670 can be mounted to the first connector link member 104 such that the mating faces of the first and second connector link members are aligned with each other and brought together and such that the latch mechanisms are operably arranged with each other to prevent the members from moving relative to each other along at least one axis.

Screws 680, 681 can be provided to mount the connector link members 104, 670 together. The first screw 680 can be disposed in the first mounting hole 684 of the second connector link member 670 and the second mounting hole of the first connector link member 104. The second screw 681 can be disposed in the second mounting hole 685 of the second connector link member 670 and the first mounting hole of the first connector link member 104. The screws 680, 681 can retain the members 670, 104 together such that the members are prevented from moving relative to each other. A pair of screw caps 690, 691 can be mounted to the connector link member which does not receive the heads of the screws to provide a finished appearance to the connector link assembly. The screws 680, 681 can be mounted to the connector link assembly such that the head of one screw is received in one of the connector link members and the head of the other screw is received in the other of the connector link members, with the screw caps being mounted in alternate relationship to the heads of the screws.

Referring to FIG. 46, the friction ring 114 can be configured to mount to the connecting element 164 of the panel 102. The connector link assembly is mountable to the connecting element 164 with the friction ring 114 disposed thereon. Each post of the connecting element 164 can receive the friction ring 114 such that the friction ring 114 extends around the post. The friction ring 114 is disposed between the connector link assembly and the posts to provide a resilient surface for pivotally retaining the connector link assembly with respect to the connecting element to which it is attached. The friction ring 114 can be operable to rotatively fix the connector link member with respect to the connecting element when the connector link member is mounted to the connecting element. The friction ring 114 can be provided to allow the connector link member and the posts to be manufactured with greater tolerances. The friction ring 114 can be made from an elastomeric material that can be compressed between the connector link assembly and the post to which it is attached to occupy any gap between the connector link assembly and the post, thereby providing a close fit therebetween such that the connector link assembly is restrained from rotating about the connecting element when the screws of the connector link assembly are tightened.

In use, the screws retaining the connector link assembly can be adjusted to allow the connector link assembly to be rotated to a desired position. The screws can be further adjusted to clamp the connector link assembly to the friction rings 114 and the connecting element 164 such that the connector link assembly is rotationally fixed.

Figure 47:
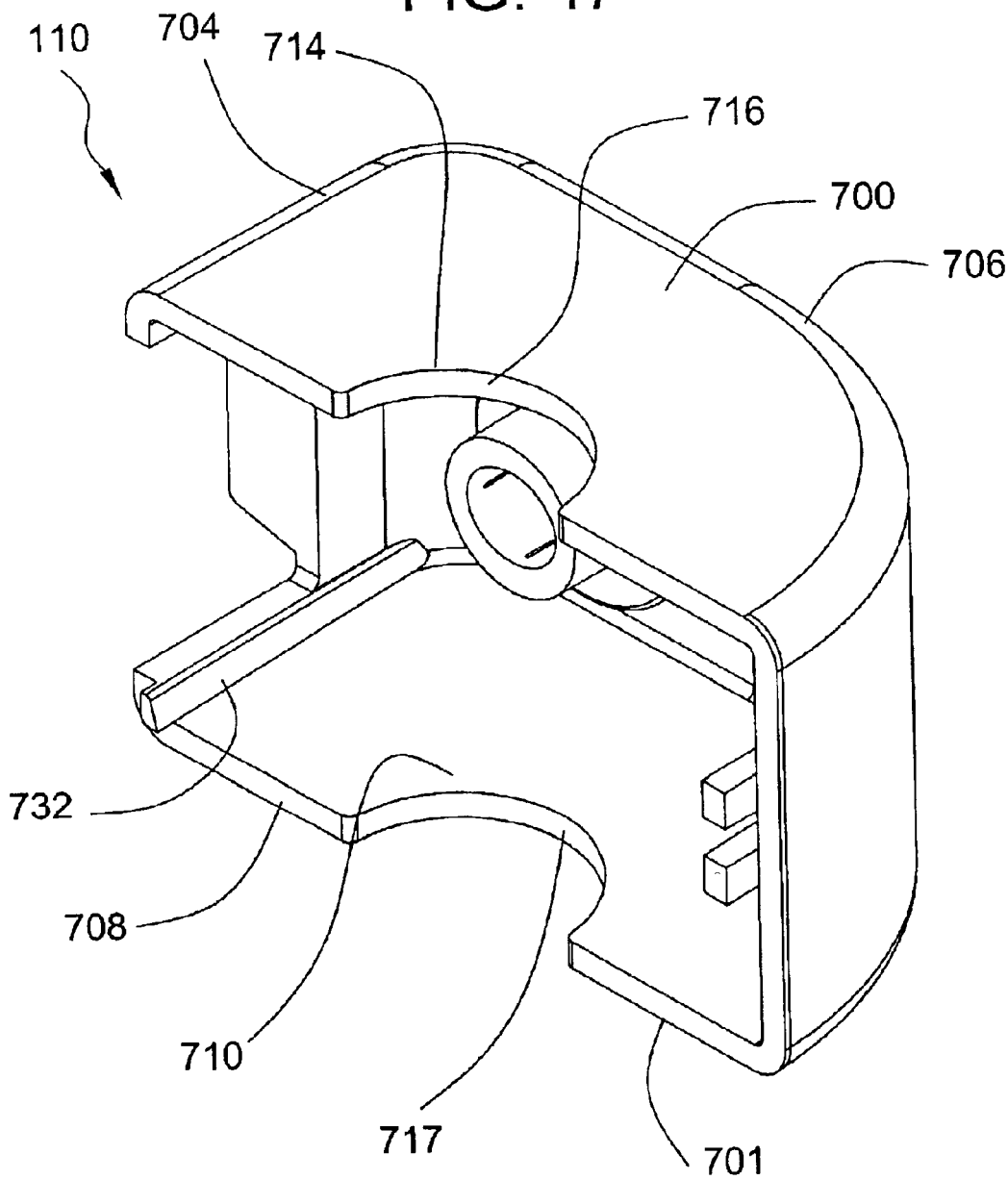
FIG. 47 is a perspective view of a trim element of the partition system of FIG. 1.

Referring to FIGS. 47–53, the trim element 110 is shown. Referring to FIG. 47, the trim element 110 includes first and second connecting surfaces 700, 701, an end 704 extending between the connecting surfaces 700, 701, a curved face 706 extending between the connecting surfaces 700, 701 and being contiguous with the end 704, a mating surface 708, and an interior surface 710. The trim element 110 includes a retaining element 714 configured to be removably mountable to one of the connecting elements of the panel. The retaining element 714 includes a first retaining notch 716 and a second retaining notch 717. The first and second retaining notches 716, 717 are disposed in the first and second connecting surfaces 700, 701, respectively. Each retaining notch 716, 717 is generally semi-circular in shape. Each retaining notch 716, 717 is sized to fit around the base of one of the posts of the connecting element. Each notch 716, 717 is sized to be smaller than the end of the post.

Figure 48:
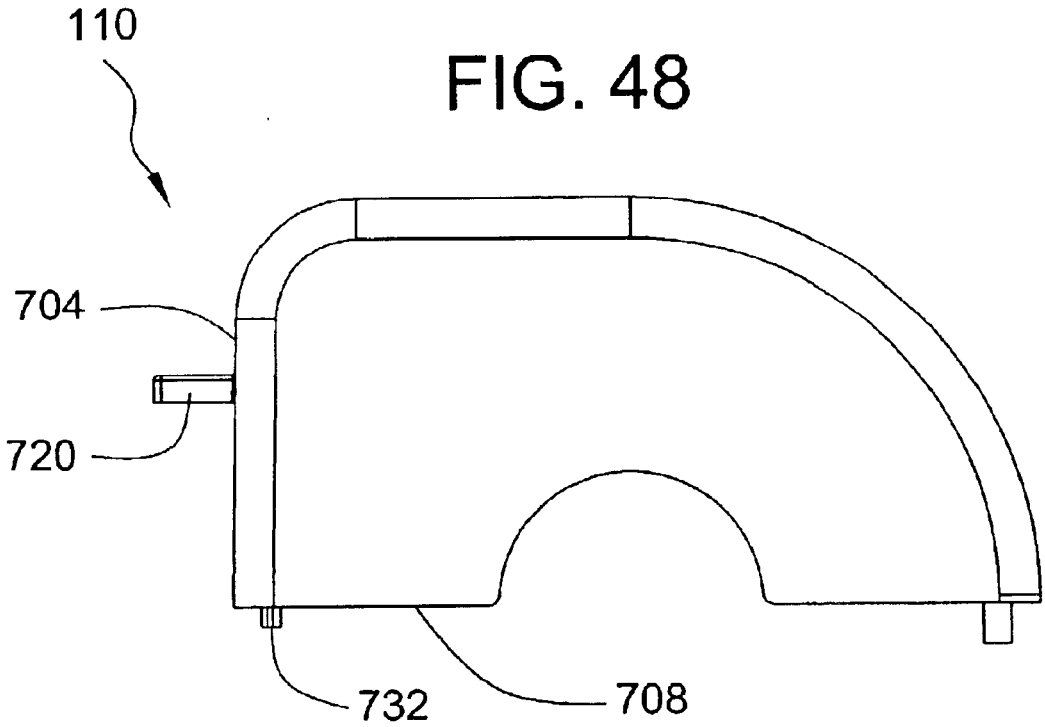
FIG. 48 is a top plan view of the trim piece of FIG. 47.

Referring to FIG. 48, the trim element 110 includes a tab 720 which extends from the end 704 thereof. The tab 720 is configured to engage the connector port such that when the trim element 110 is mated with a second trim element about the connecting element, the two tabs engage the connector port to prevent the trim assembly from rotating with respect to the posts.

Figure 49:
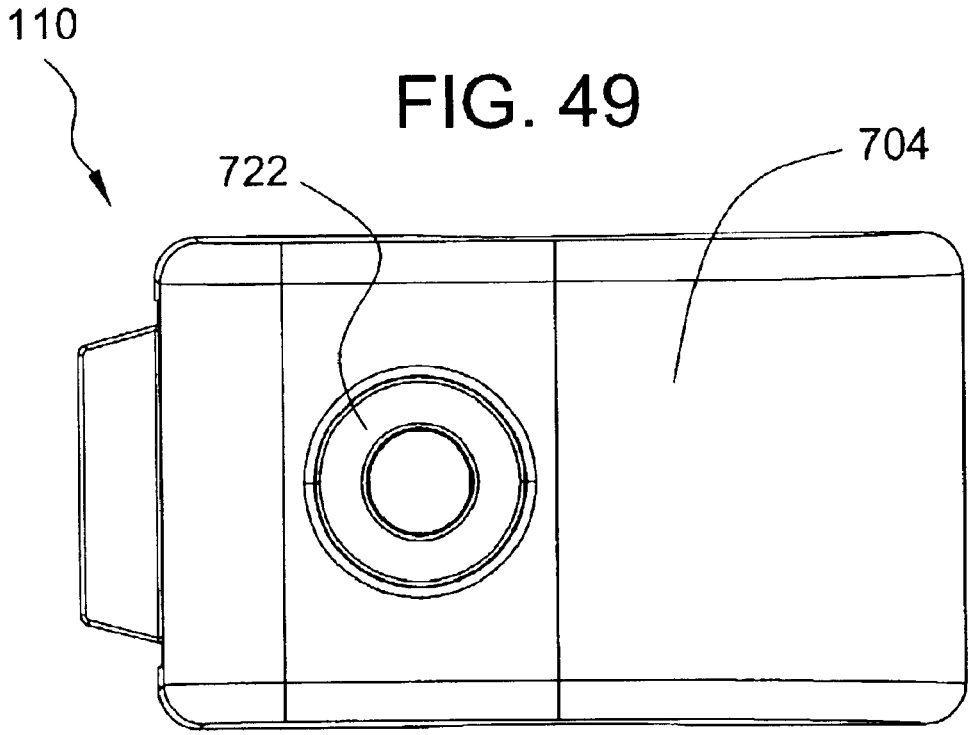
FIG. 49 is a first elevation of the trim piece of FIG. 47.
Figures 50, 51, 52:
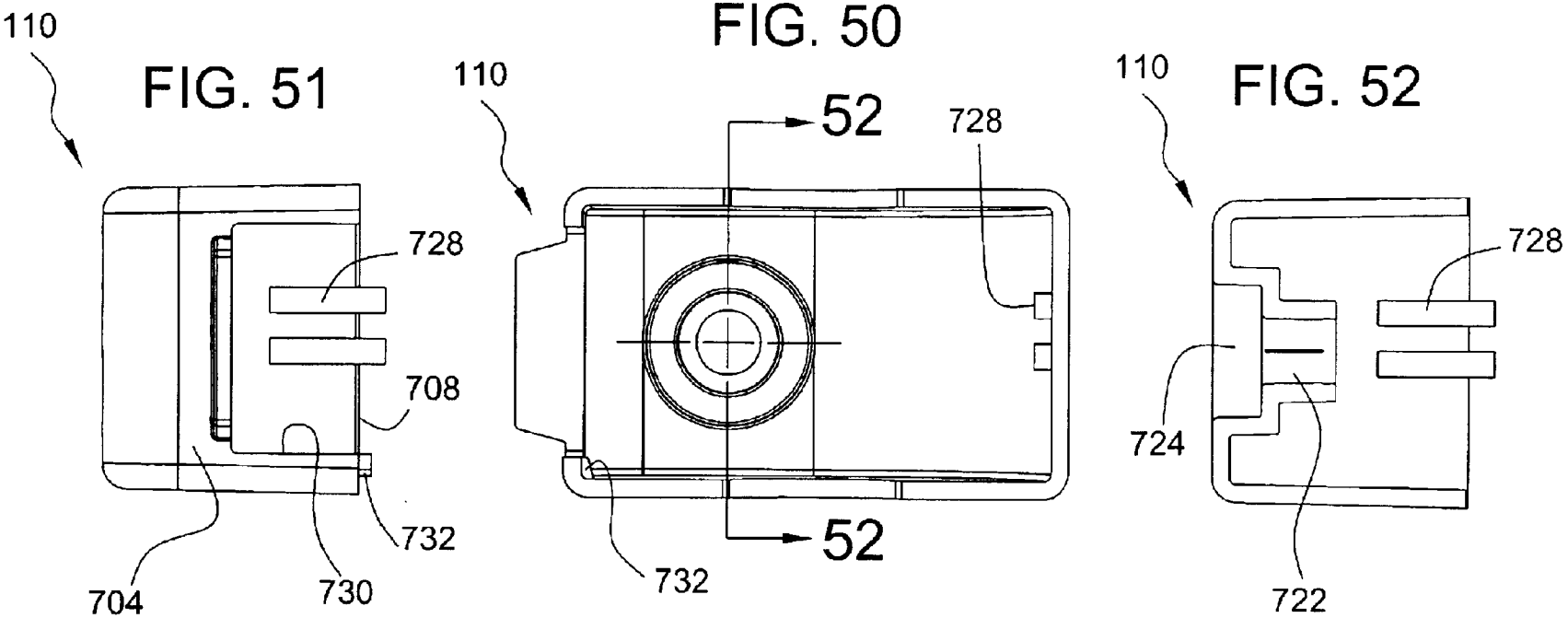
FIG. 50 is a second elevational view of the trim piece of FIG. 47.
FIG. 51 is an end elevational view of the trim piece of FIG. 47.
FIG. 52 is a cross-sectional view taken along line 52—52 of FIG. 50.

Referring to FIG. 49, a mounting hole 722 is provided in the face 704 of the trim element 110 for mounting the trim element 110 to a second trim element. Referring to FIG. 52, the mounting hole 722 includes a counter bore 724.

Referring to FIGS. 50–52, the trim element 110 includes a latch mechanism 728 similar to the latch mechanism described with respect to the connector link member. Referring to FIG. 51, the end 704 of the trim element 110 includes a generally rectangular opening 730. Referring to FIG. 47, 48, and 51, the trim element 110 also includes a stop 732 projecting from the interior surface 710 of the trim element 110 adjacent the end 704. The stop 732 includes an end that extends beyond the mating surface 708. Referring to FIG. 50, the stop 732 can be provided to engage a second, mating trim element such that the trim element 110 cannot move relative to the mating trim element in a direction indicated by an arrow 736 in FIG. 51.

Figure 53:
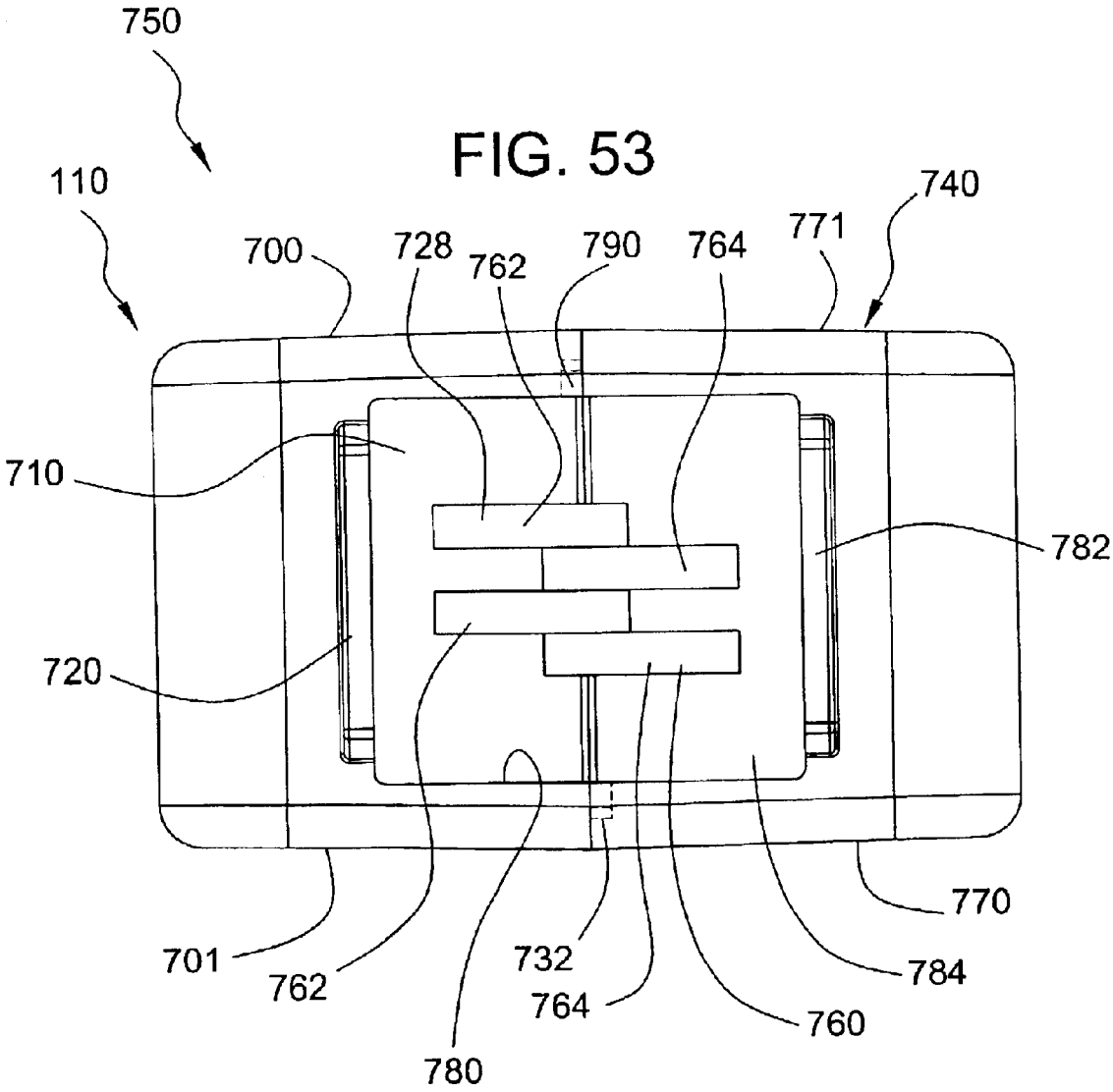
FIG. 53 is an end elevational view of a trim assembly of the partition system of FIG. 1.

Referring to FIG. 53, the first trim element 110 can be matingly engaged with a second trim element 740 to form a trim assembly 750. The second trim element 740 is identical to the first trim element 110. The latch mechanisms 728, 760 of the trim elements are shown matingly engaged such that the fingers 762, 764 of the latch mechanisms 728, 760, respectively, are interdigitated with each other. The first and second trim elements 110, 740 are mated such that the first connecting surface 700 of the first trim element 110 is aligned with the second connecting surface 771 of the second trim element 740 and such that the second connecting surface 701 of the first trim element 110 is aligned with the first connecting surface 770 of the second trim element 740. The ends of the first and second trim elements define a large rectangular opening 780 flanked by the tabs 720, 782. The stop 732 of the first trim element 110 is engaged with the interior surface 784 of the second trim element adjacent the first connector surface 770 thereof. The stop 790 of the second trim element is engaged with the interior surface 710 of the first trim element adjacent the first connector surface 700 thereof.

Figure 54:
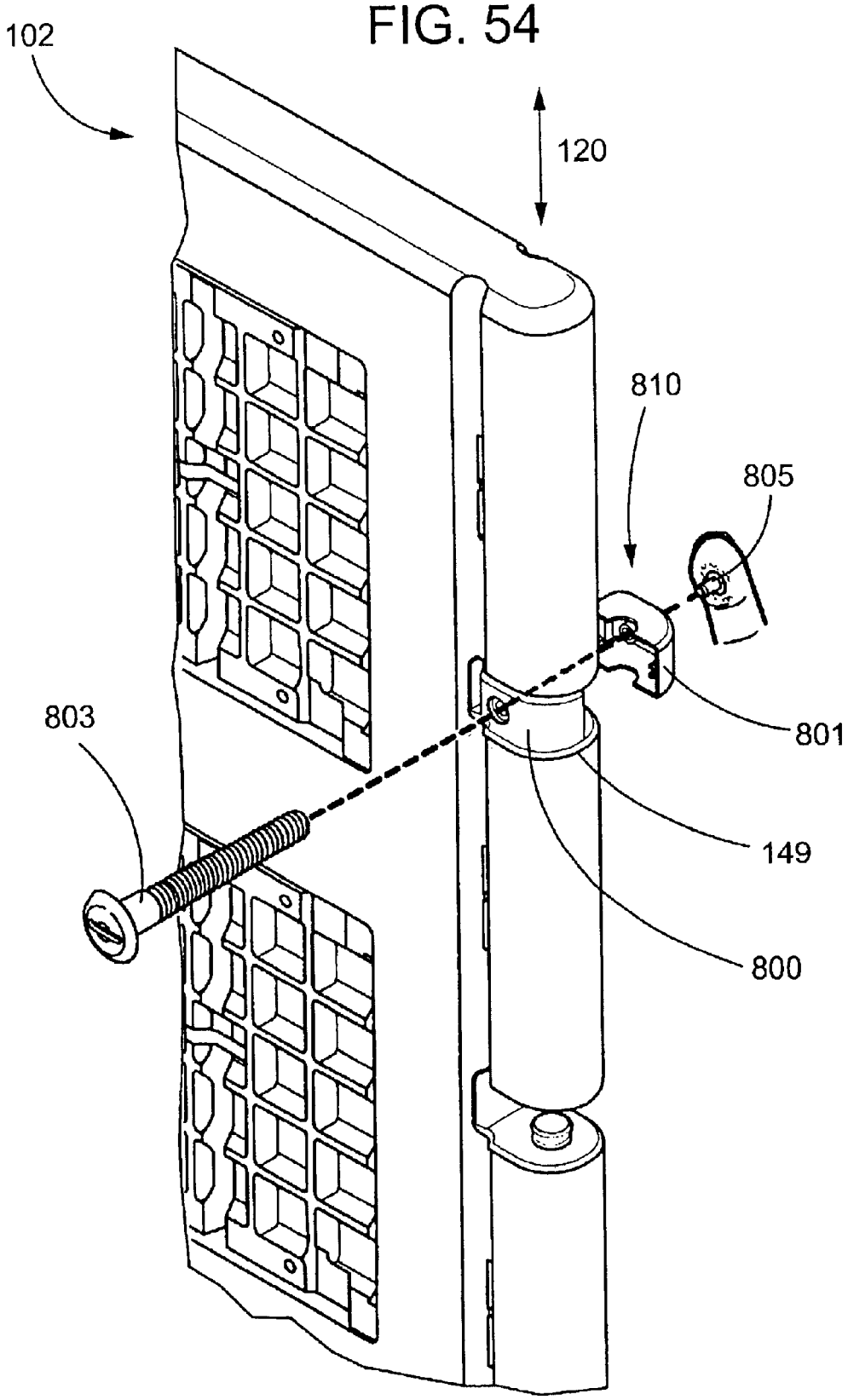
FIG. 54 is a fragmentary, perspective view of the panel of FIG. 2 illustrating a trim assembly being mounted thereto.

Referring to FIG. 54, first and second trim elements 800, 801 can be mounted together by a screw 803 within the connector port 149 to provide a finished appearance to the panel 102. A screw cap 805 can be cooperatively engaged with the second trim element 801 to provide a finished appearance. The screw cap 805 can be disposed within the mounting hole of the second trim element 801. The first and second trim elements 800, 801, the screw 803, and the screw cap 805 comprise a trim assembly 810. Each trim element can be configured to be mountable to another trim element to present a curved, convex surface. Each trim element is sized such that it can be disposed within the connector port and such that its convex surface substantially conforms to the convex surface of the panel 102 at each end. The tabs of the first and second trim elements 800, 801 are configured to be engaged with the end of the connector port 149 to prevent the trim assembly from rotating about the vertical axis 120. A pair of friction rings can be disposed upon the posts of the connecting element to which the trim assembly 810 is mounted with the friction rings disposed between the trim assembly 810 and the connecting element Preferably, the trim assemblies are respectively disposed in the connector ports that are not occupied by a connector link assembly such that in use, either a connector link assembly or a trim assembly occupies each connector port.

Figures 55, 56:
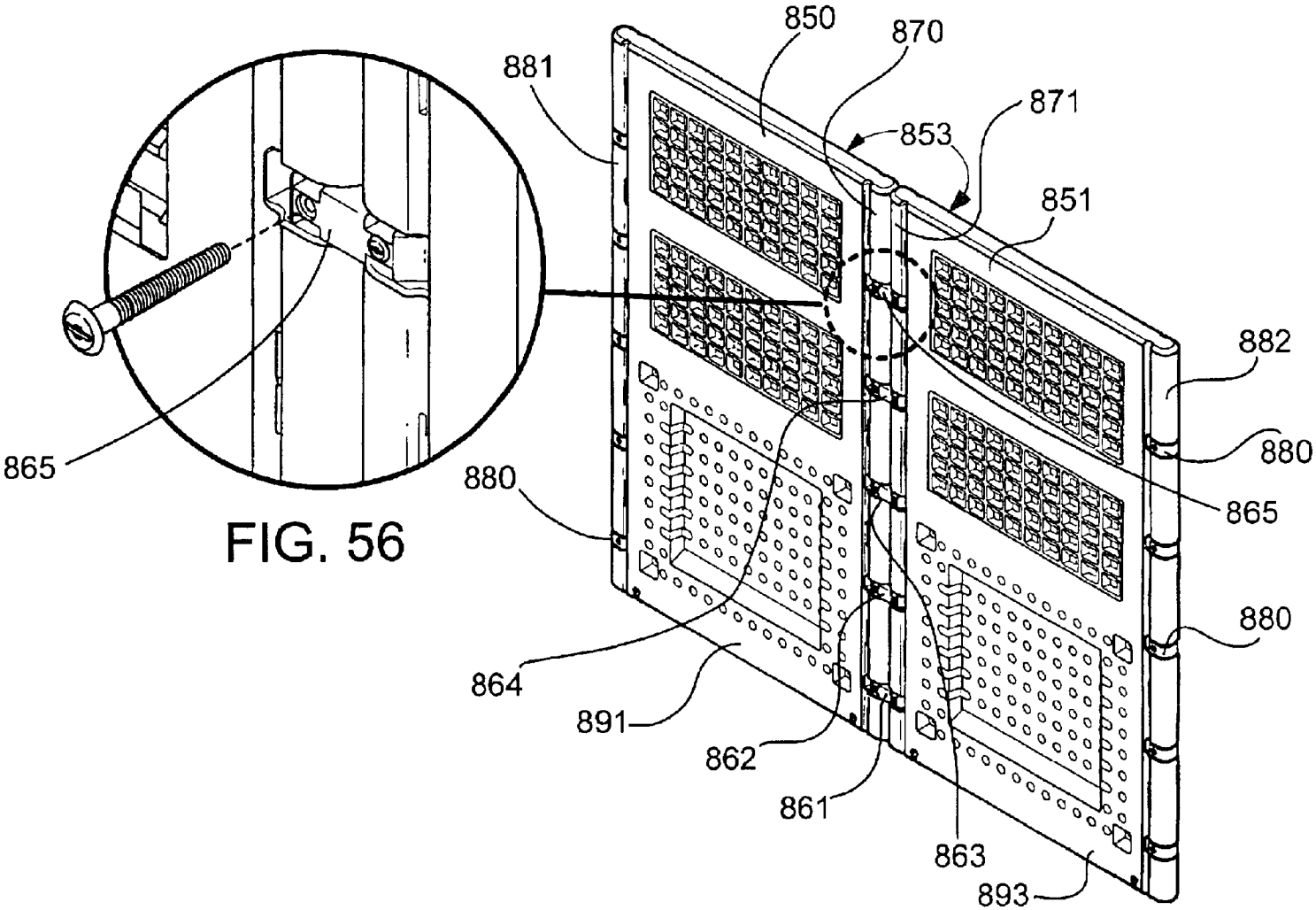
FIG. 55 is a perspective view of a linear wall constructed from the partition system of FIG. 1.
FIG. 56 is an enlarged detail view taken from FIG. 55.

Referring to FIGS. 55 and 56, first and second panels 850, 851 are mounted together by a plurality of connector link assemblies such that the panels are disposed with respect to each other at an angle 853 of about 180°. The panels 850, 851 define a planar wall portion. Connector link assemblies 861, 862, 863, 864, 865 are respectively mounted to the connecting elements at the second end 870 of the first panel 850 and at the first end 871 of the second panel 851. Trim assemblies 880 respectively occupy the connector ports at the first end 881 of the first panel 850 and at the second end 882 of the second panel 851. The first and second panels are disposed such that the second face 891 of the first panel 850 and the second face 893 of the second panel 851 are side-by-side and are oriented the same way. In other arrangements, the first and second panels 850, 851 can be configured such that the first face of the first panel is next to the second face of the second panel and vice versa.

Figure 29:
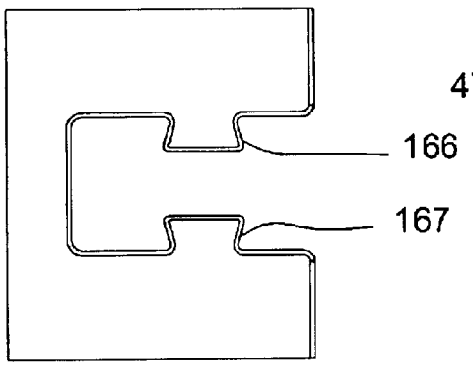
FIG. 29 is a cross-sectional view taken along line 29—29 in FIG. 27.
Figures 57, 58:
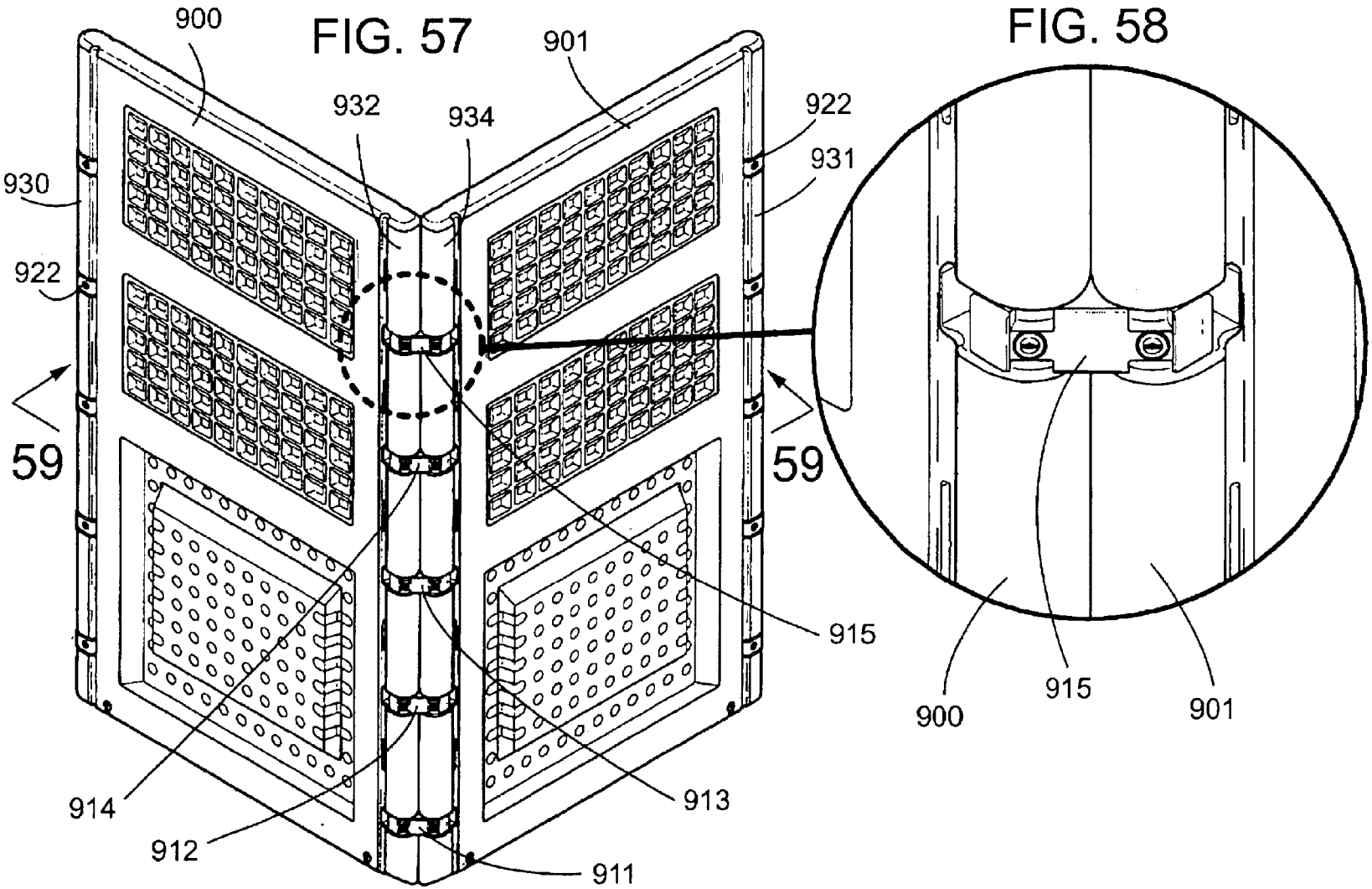
FIG. 57 is a perspective view of an L-shaped wall constructed from the partition system of FIG. 1.
FIG. 58 is an enlarged detail view taken from FIG. 57.

Referring to FIGS. 57–62, a pair of panels 900, 901 is mounted together by a plurality of connector link assemblies 911, 912, 913, 914, 915 such that the first panel is disposed with respect to the second panel at about a 90° angle 920 to define an L-shaped wall portion, as shown in FIG. 29. Referring to FIG. 57, trim assemblies 922 respectively occupy the connector ports disposed at the first end 930 of the first panel 900 and at the second end 931 of the second panel 901. The connector link assemblies 911, 912, 913, 914, 915 are respectively mounted to the connecting elements disposed at the second end 932 of the first panel 900 and to the corresponding connecting elements disposed at the first end 934 of the second panel 901.

Figures 59, 60, 61, 62:
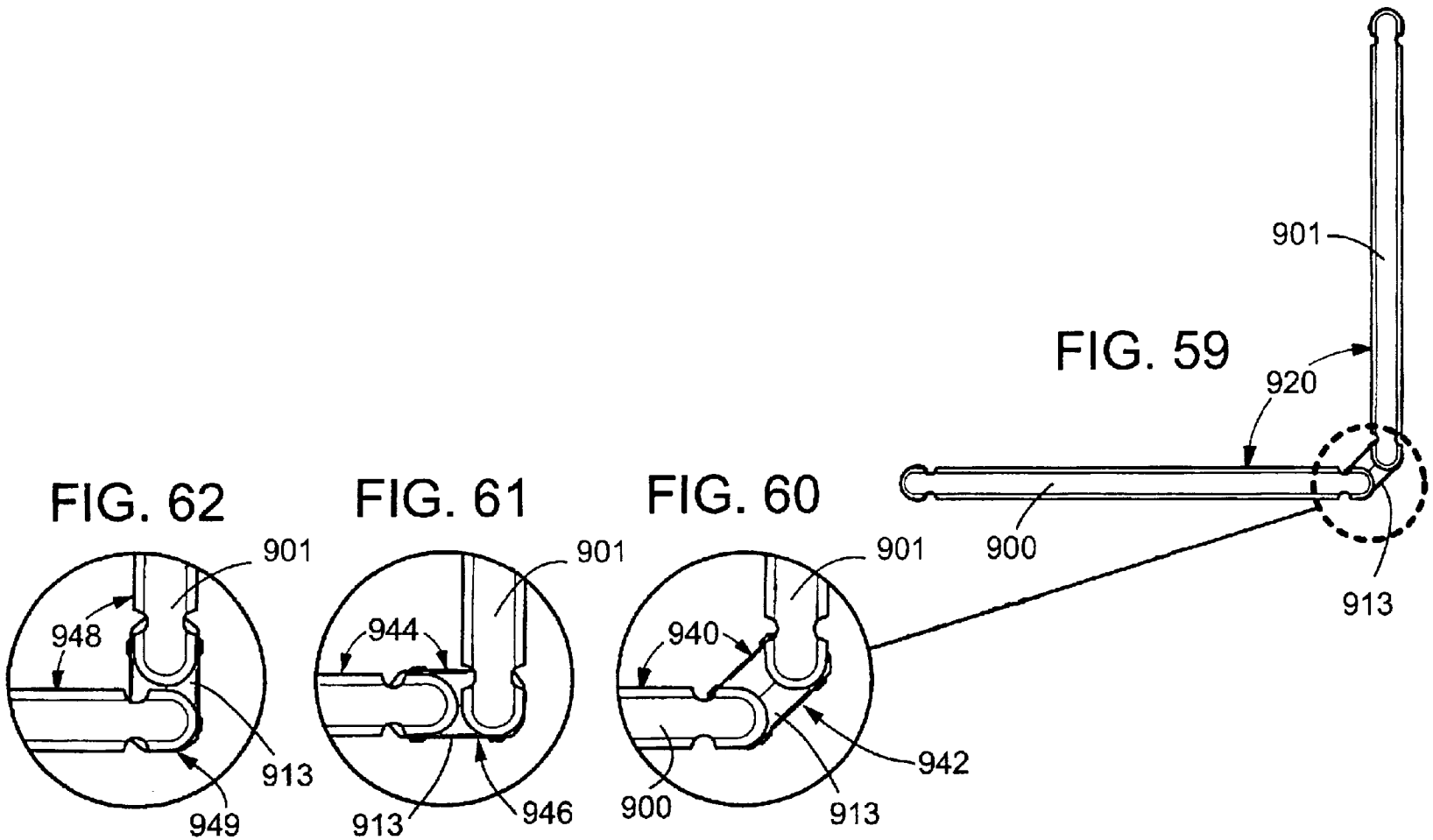
FIG. 59 is a cross-sectional view taken along line 59—59 in FIG. 57.
FIG. 60 is an enlarged detail view taken from FIG. 59.
FIG. 61 is a view similar to FIG. 60 illustrating an alternate configuration for the L-shaped wall.
FIG. 62 is a view similar to FIG. 60 illustrating another alternate configuration for the L-shaped wall.

Referring to FIG. 60, the connector link assemblies are disposed with respect to the first panel 900 at an angle 940 of about 135° such that the first and second panels 900, 901 and the connector link assemblies defined a chamfered corner 942.

Referring to FIG. 61, the connector link assemblies can be disposed with respect to the first panel 900 at about an 180° angle 944 such that the first panel 900, the connector link assemblies, and the second panel 901 define an extended corner 946. The extended corner 946 is an alternative assembly configuration to the chamfered corner 942 configuration shown in FIG. 60.

Referring to FIG. 62, the connector link assemblies can be disposed with respect to the first panel 900 at about a 90° angle 948 such that the first panel 900, the connector link assemblies, and the second panel 901 define a shortened corner 949. The shortened corner 949 is an alternative assembly configuration to the chamfered corner 942 and the extended corner 946, as shown in FIGS. 60 and 61, respectively.

The alternative assembly configurations shown in FIGS. 60–62 allow for defining wall portions of variable sizes to position the wall portions within different space limitations. For example, the shortened corner 949 can be used where the available space will not allow for an extended corner 946. On the other hand, the extended corner 946 can be used in situations where it is desired to maximize the space of a workstation defined by the wall portion.

Figure 63:
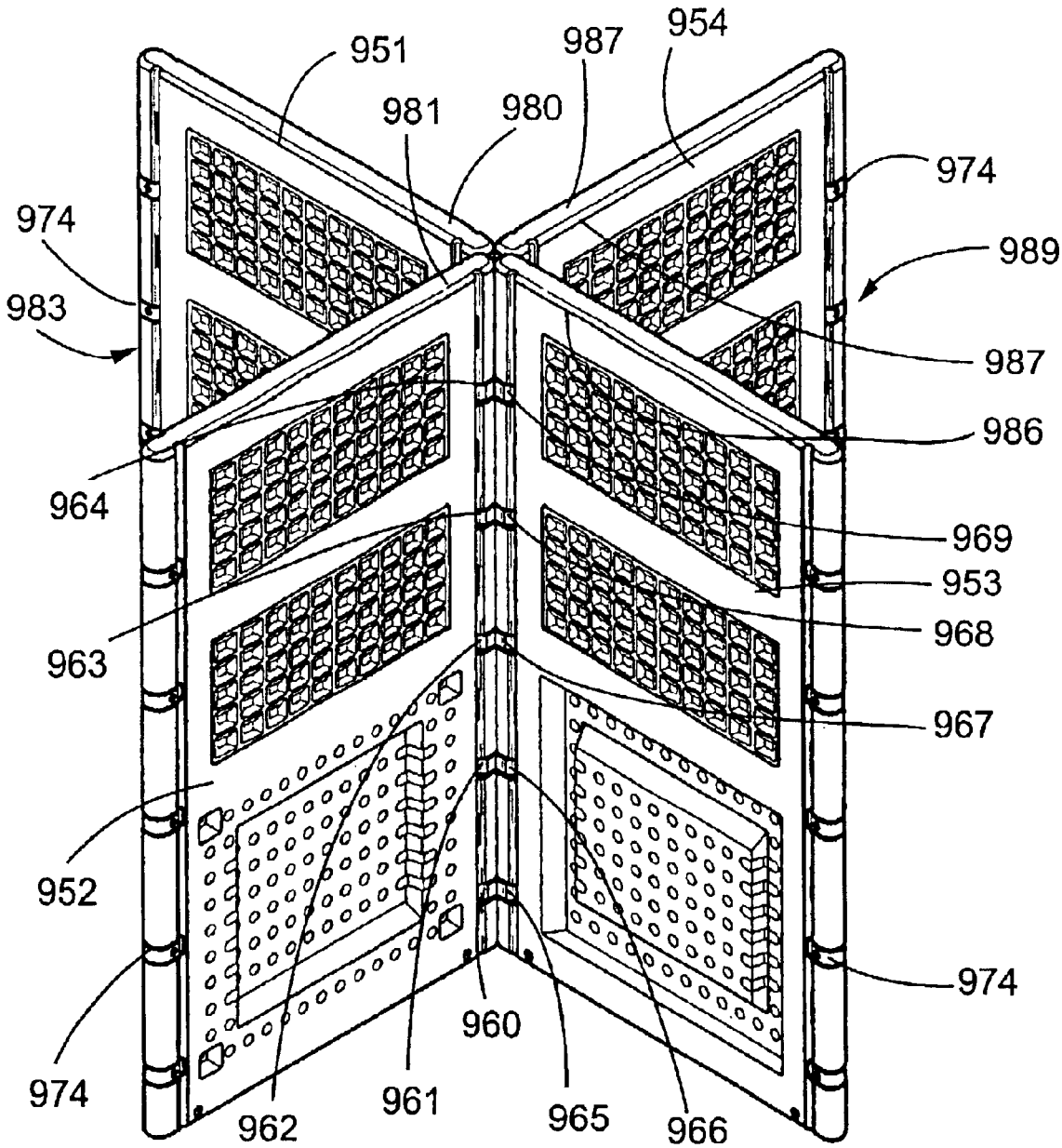
FIG. 63 is a perspective view of an X-shaped wall constructed from the partition system of FIG. 1.

Referring to FIG. 63, first, second, third, and fourth panels 951, 952, 953, 954 are mounted together by a plurality of connector link assemblies 960, 961, 962, 963, 964, 965, 966, 967, 968, 969. For each of the four panels, the connector ports not occupied by connector link assemblies are respectively occupied by trim assemblies 974. The four panels 951, 952, 953, 954 are configured to define a wall portion having an X-shape. In one assembly configuration, the first panel 951 and the second panel 952 are mounted together by connector assemblies 961, 962, 963 disposed in the middle three connector ports of both first ends 980, 981 to form a first wing 983. The third panel 953 and the fourth panel 954 are mounted together by connector link assemblies 966, 967, 968 disposed in the middle three connector ports of both first ends 986, 987 of the third and fourth panels 953, 954 to define a second wing 989. To mount the first wing 983 and the second wing 989 together, the connector link assembly 964 disposed in the uppermost connector ports of the first panel 951 and the second panel 952 and the connector link assembly 969 disposed in the uppermost connector ports of the third panel 953 and the fourth panel 954 are mounted together by a pair of screws. The bottommost connector link assemblies 960, 965 are similarly arranged and secured. It will be understood that other mounting configurations can be used.

Figure 64:
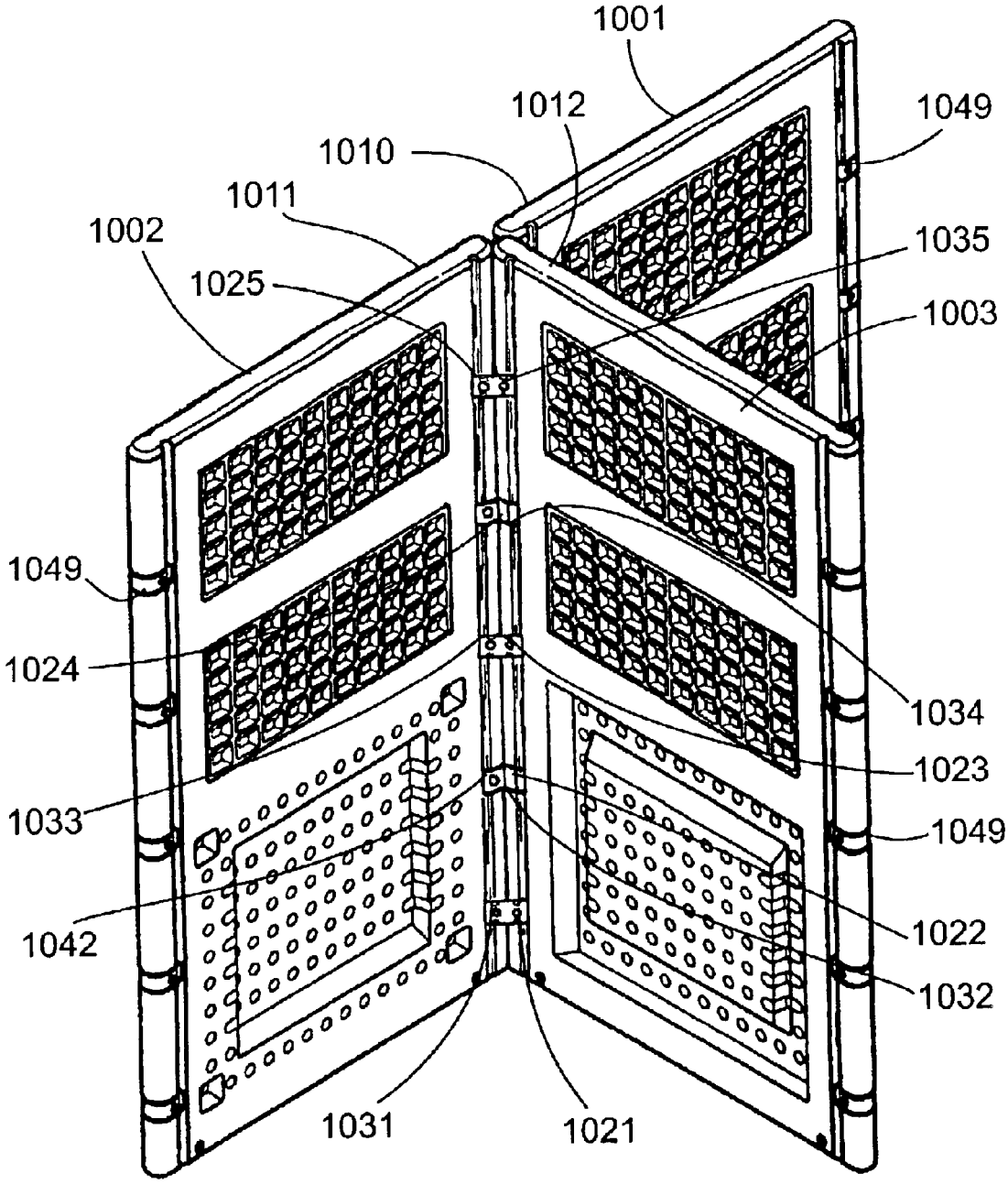
FIG. 64 is a perspective view of a T-shaped wall constructed from the partition system of FIG. 1.

Referring to FIG. 64, first, second, and third panels 1001, 1002, 1003 are arranged in a wall portion having a T-shaped configuration. In one mounting configuration, the second end 1010 of the first panel 1001, the first end 1011 of the second panel 1002 and the first end 1012 of the third panel 1003 are mounted together by five alternately-mounted connector link assemblies 1021, 1022, 1023, 1024, 1025. The connector link assembly disposed in a first connector port position 1031, the lowermost connector port, is mounted to the second panel 1002 and the third panel 1003. A trim assembly is disposed in the first connector port of the second end 1010 of the first panel 1001 to provide a finished appearance. In a second connector port position 1032, the connector link assembly 1022 is mounted to the first panel 1001 and the third panel 1003 with a trim assembly 1042 being disposed in the second connector port of the second panel 1002. Third and fifth connector port positions 1033, 1035 are configured in the same way as the first connector port position 1031. The fourth connector port position 1034 is configured in the same way as the second connector port position 1032. Trim assemblies 1049 can respectively occupy the connector ports of the first, second, and third panels that are not used to connect the panels together. Other mouthing configurations can be employed.

Figure 65:
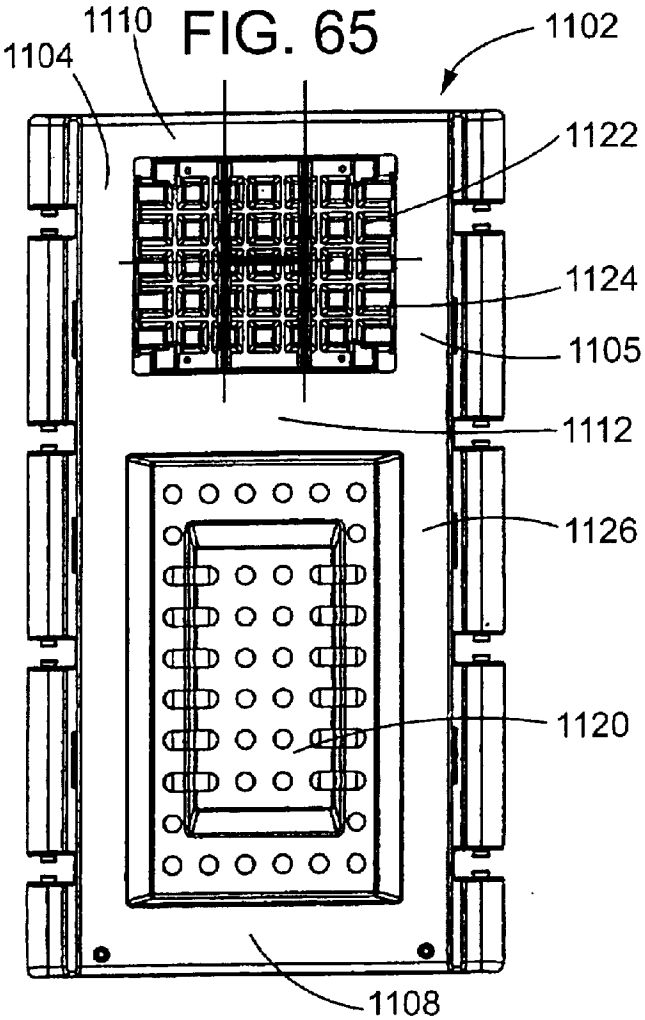
FIG. 65 is a first elevational view of another embodiment of a panel useful in connection with the partition system of FIG. 1.
Figure 66:
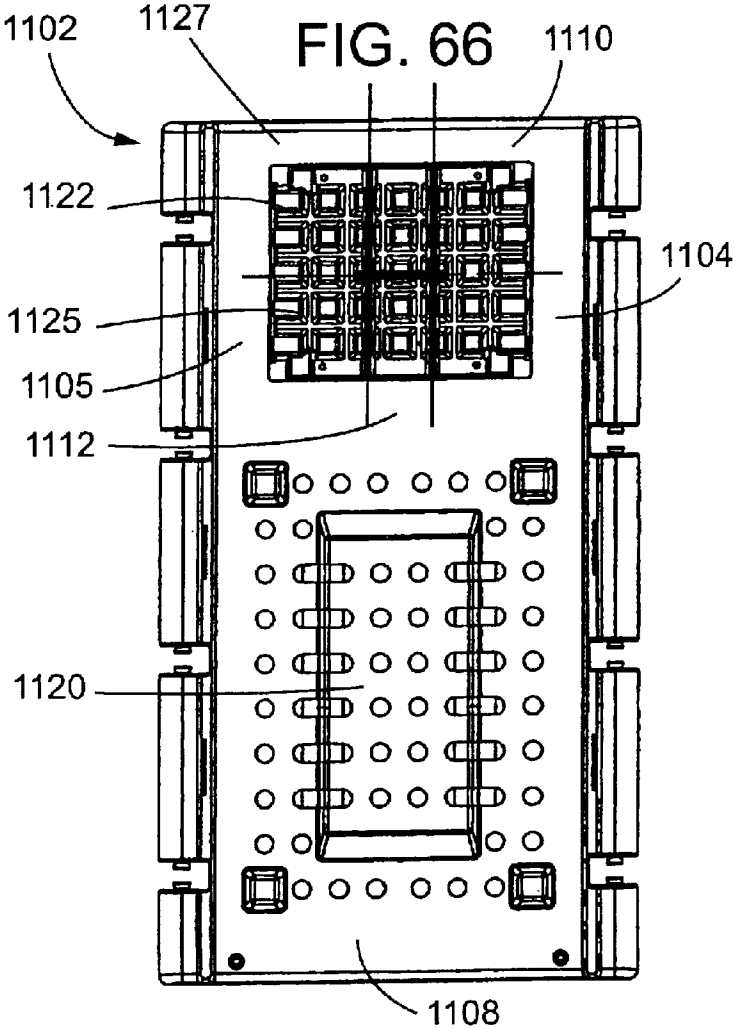
FIG. 66 is a second elevational view of the panel of FIG. 65.

Referring to FIGS. 65 and 66, another embodiment of a panel 1102 useful in connection with the present invention is shown. The panel 1102 includes first and second stiles 1104, 1105, abottom rail 1108, a top rail 1110, and abody rail 1112. The bottom, body, and top rails 1108, 1112, 1110 extend between the stilesl 104, 1105 with the body rail 1112 being disposed intermediate to the top rail 1110 and the bottom rail 1108. The body rail 1112, the first and second stiles 1104, 1105, and the bottom rail 1108 define a field portion 1120. The top rail 1110, the first and second stiles 1104, 1105, and the body rail 1112 define an insert portion 1122 having a single recess 1124, 1125 on each face 1126, 1127. The panel 1102 shown in FIGS. 65 and 66 is similar in other respects to the panel 102 shown in FIG. 1.

Figures 67, 68, 69, 70:
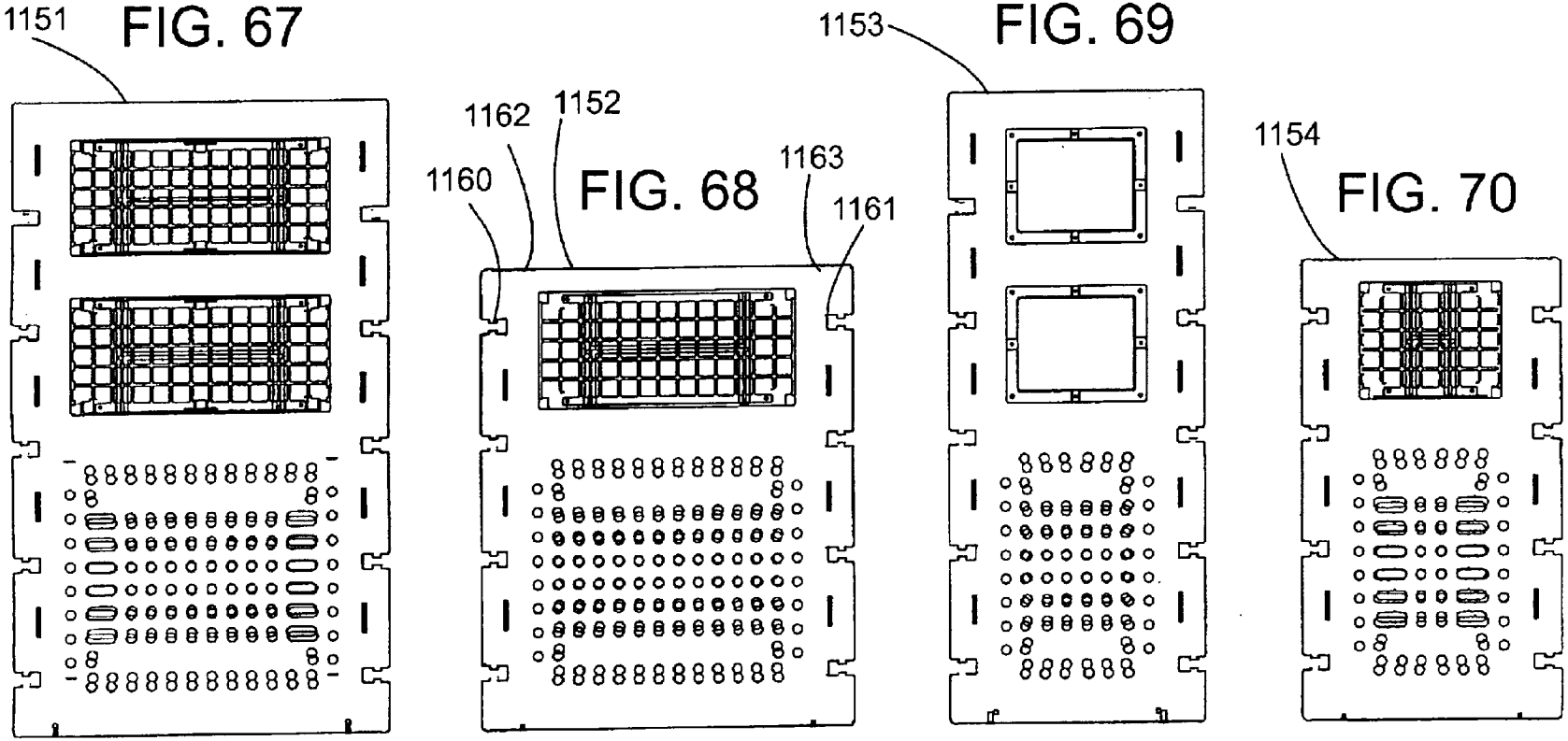
FIG. 67 is a first elevational view of another embodiment of a panel useful in connection with the partition system of FIG. 1.
FIG. 68 is a first elevational view of another embodiment of a panel useful in connection with the partition system of FIG. 1.
FIG. 69 is a first elevational view of another embodiment of a panel useful in connection with the partition system of FIG. 1.
FIG. 70 is a first elevational view of another embodiment of a panel useful in connection with the partition system of FIG. 1.

Referring to FIGS. 67–70, other embodiments of panels 1151, 1152, 1153, 1154 useful in connection with the present invention are shown. The panels shown in FIGS. 66–69 have different sizes. The panel 1151 shown in FIG. 67 is about 66 inches tall and 38 inches wide.

The panel 1152 shown in FIG. 68 is about 48 inches tall and 38 inches wide. In this embodiment, the panel 1152 has four connector ports 1160, 1161 disposed in spaced relation to each other at each end 1162, 1163 thereof. The connector ports 1160, 1161 at each end 1162, 1163 can be configured such that they can be aligned with four of the five connector ports at each end of the panel 102 shown in FIG. 1. Preferably, the connector ports of the panel 1152 in FIG. 68 are mountable to the connector ports in the first four connector port positions of the panel in FIG. 1 by four connector link assemblies, respectively.

The panel 1153 shown in FIG. 69 is about 66 inches tall and 26 inches wide. The panel 1154 shown in FIG. 70 is about 48 inches tall and 26 inches wide. It will be understood that other configurations of the panel are possible.

Figure 71:
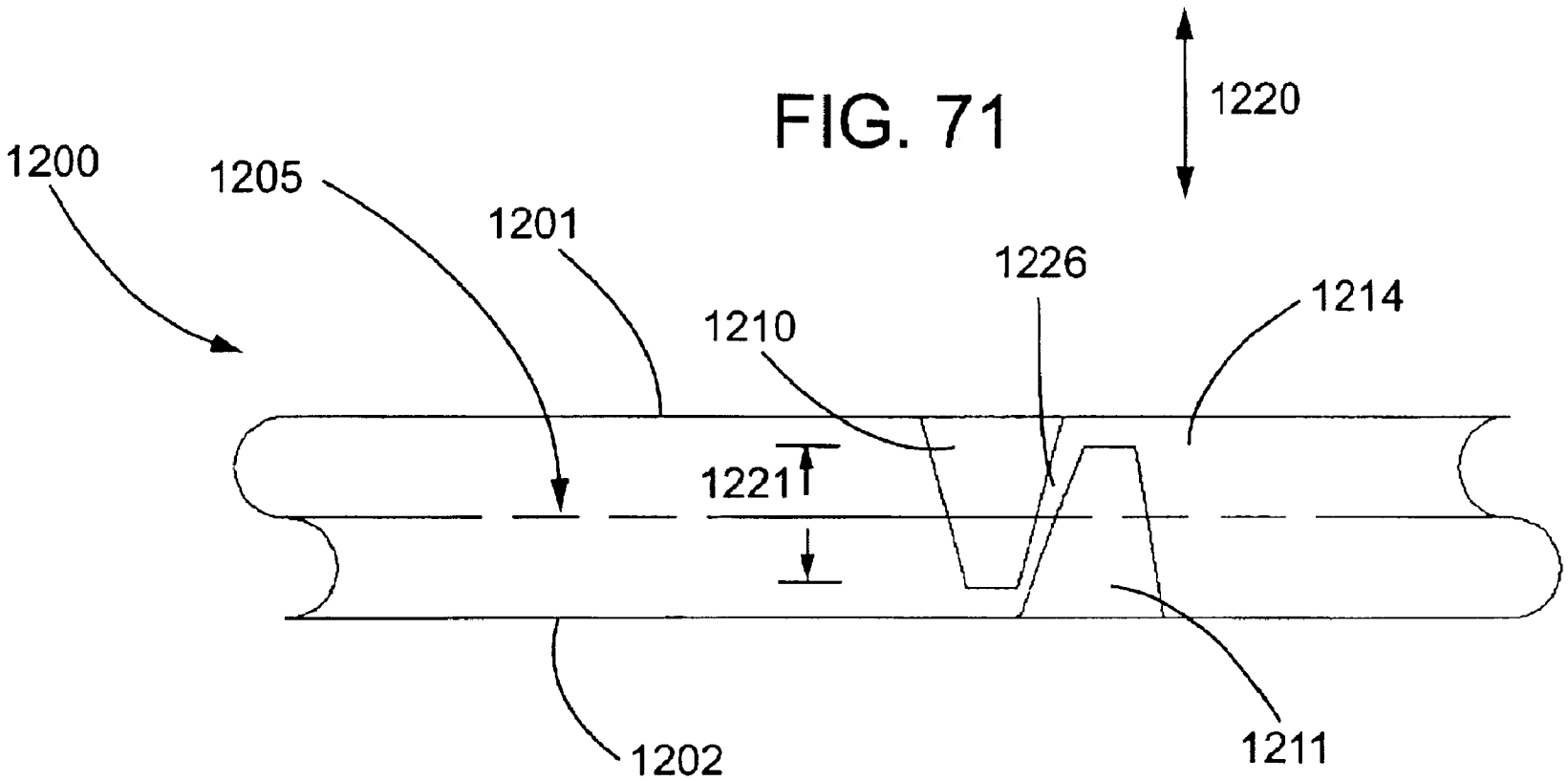
FIG. 71 is a generally schematic view of a molding assembly useful in connection with the manufacture of the panel of FIG. 1.

Referring to FIG. 71, to make the panel, a blow-molding process can be used. A mold assembly 1200 can include first and second mold portions 1201, 1202, which define a parting plane 1205 when brought together. The offset tack-off design arrangement can be provided by pairs of cooperating welding elements 1210, 1211 disposed on each half mold portion 1201, 1202.

A method for making a panel for a partition system can include extruding a predetermined amount of plastic parison, which is plastic heated such that it is suitable for blow-molding. The first mold portion 1201 and the second mold portion 1202 can be brought together to define a mold cavity 1214 with the parison disposable therein. The first mold portion 1201 and the second mold portion 1202 can define the parting plane 1205 when brought together. The first weld element 1210 can be configured such that when the first and second mold portions 1201, 1202 are brought together, the first weld element 1210 extends along a mold axis 1220 from the first mold portion 1201 beyond the parting plane 1205. The second weld element 1211 can be configured such that when the first and second mold portions 1201, 1202 are brought together, the second weld element 1211 extends along the mold axis 1220 from the second mold 1202 portion beyond the parting plane 1205.

The first and second weld elements 1210, 1211 can be offset from each other to allow the first and second mold portions 1201, 1202 to be brought together and to allow a portion of the first and second welding elements to overlap each other to define an overlap zone 1221 along the mold axis 1220 wherein both elements 1210, 1211 are found when the first and second mold portions 1201, 1202 are brought together. The first and second weld elements 1210, 1211 can act to define a shear wall path 1226. The distance the two cooperating weld elements 1210, 1211 are offset from each other can be determined by selecting a nominal wall thickness and offsetting the two weld elements with proper draft on the side walls so the walk of parison will "shear" and weld to each other while the first and second mold portions close. The welded sections can be alternated with hollow sections to avoid a "hinge effect."

A blow pin can be inserted into the parison. The parison can be inflated via the blow pin such that the parison is urged against the first and second mold portions 1201, 1202. The first and second mold portions 1201, 1202 can be separated, and the plastic material ejected therefrom. Any necessary trimming of the plastic material can be conducted to finish the panel.

Figure 72:
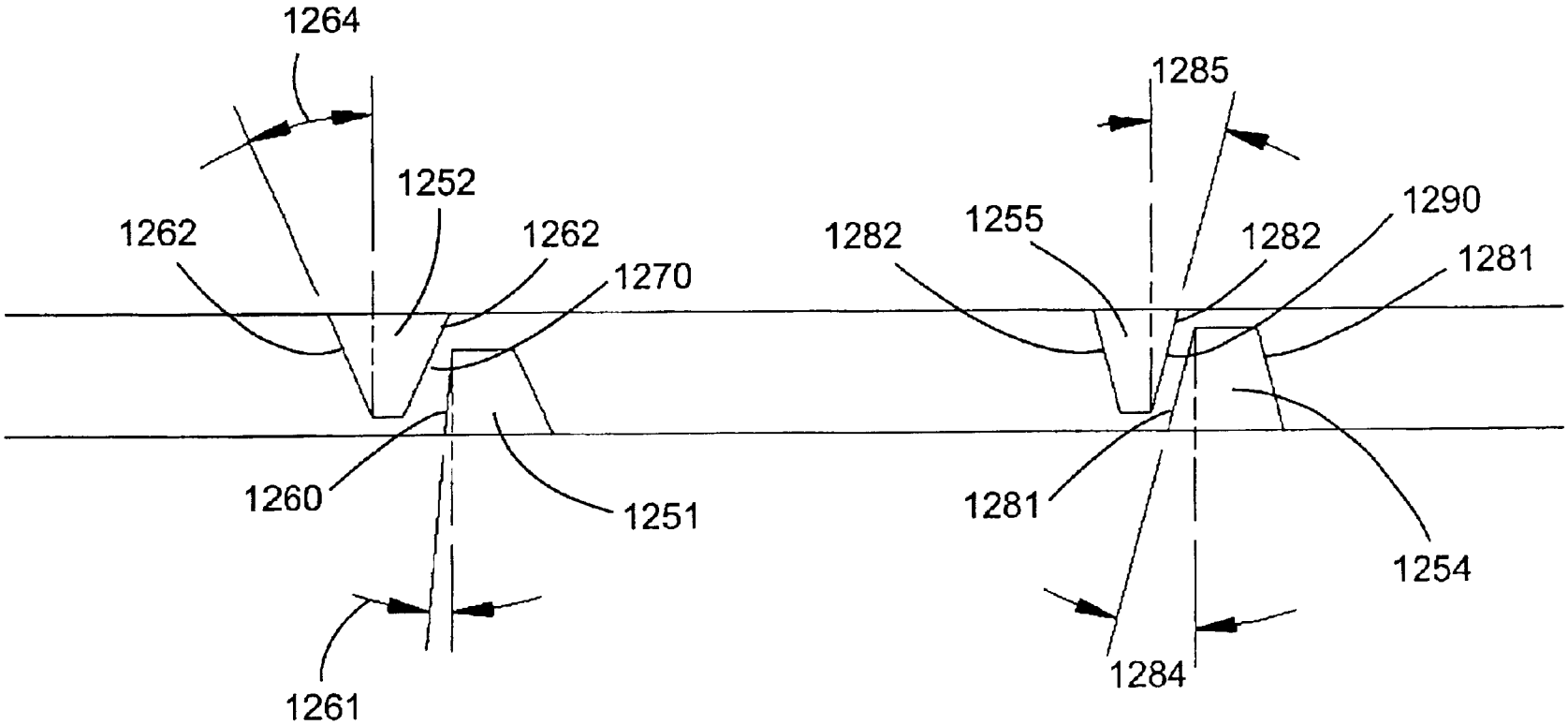
FIG. 72 is a generally schematic view of a plurality of mold elements useful in connection with the molding assembly of FIG. 71.

Referring to FIG. 72, a first pair of cooperating weld elements 1251, 1252 and a second pair of cooperating weld elements 1254, 1255 are shown. The first weld element 1251 has a sidewall 1260 with a draft angle 1261 of about 5°. The second weld element 1252 has a pair of sidewalls 1262 each with a draft angle 1264 of about 24°. The first and second weld elements 1251, 1252 can cooperate together during a blow-molding process to define a linear-to-linear shear connection pathway 1270 therebetween.

Both the third and the fourth weld elements 1254, 1255 include a pair of sidewalls 1281, 1282, each sidewall having a draft angle 1284, 1285 of about 15°. When the third and fourth weld elements l254, 1255 are brought together during a blow-molding process, one of the sidewalls 1281 of the third weld element 1254 is brought adjacent to one of the sidewalls 1282 of the fourth weld element 1255. The adjacent, cooperating sidewalls 1281, 1282 of the third and fourth weld elements 1254, 1255, respectively, are substantially parallel to each other. The adjacent sidewalls 1281, 1282 can define a surface-to-surface shear connection pathway 1290 therebetween during the blow-molding process. In other embodiments, the weld elements can have sidewalls with different draft angles. Each of the weld elements shown in FIG. 72 has a free end that is substantially planar.

The welding elements can be provided with free ends having a relatively large radius or a chamfer of approximately 45° to facilitate stretch the material over the ends and to prevent thinner welding elements from penetrating the parison walls.

Using offset and associability features of the welding elements can facilitate the manufacture of an aesthetically-pleasing panel. The welding elements can be configured to be a unit of an ornamental design that is repeated in an array or other design feature. The second welding element can be associatively offset from the first welding element such that the second welding element follows the path of the first element.

The panel can be made such that it includes both surface-to-surface shear connections and linear-to-linear shear connections. The panel can be constructed such that it includes other offset configurations and other tack-off arrangements.

The offset welding arrangement provides a flat, blow-molded panel with excellent structural integrity and is readily used without the need for major investments in machining and head tooling to provide an increased production yield rate compared to the conventional spot-weld system. The offset-welded panels tend to shrink more evenly and maintain their flatness during use.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise, claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A partition system comprising:

a hollow body, plastic panel, the panel including a first face, a second face, a pair of opposing ends, a top, a bottom, a weld section, and a connecting element, the first and second faces being connected together via the weld section, and the connecting element being disposed at one of the ends, the connecting element including a post having a tapered circumferential sidewall; and a connector link member, the connector link including a first retaining element and a second retaining element, both retaining elements configured to be removably mountable to the connecting element, one of the first and second retaining elements of the connector link member including a keyway, the keyway configured to retentively engage the post, the keyway including a wall surface configured to correspond substantially to the tapered circumferential sidewall of the post.

2. The partition system according to claim 1 further comprising:

a plurality of panels.

3. The partition system according to claim 2 wherein the connector link member is adapted to join a pair of panels together by mounting the first retaining element to the connecting element of one of the panels and the second retaining element to the connecting element of the other of the panels.

4. The partition system according to claim 3 wherein the connector link member is adapted to join the panels together such that the panels are disposed at a desired angle with respect to each other.

5. The partition system according to claim 4 wherein the angle is acute.

6. The partition system according to claim 4 wherein the angle is obtuse.

7. The partition system according to claim 4 wherein the angle is 90°.

8. The partition system according to claim 4 wherein the angle is 180°.

9. The partition system according to claim 1 wherein the panel includes a pair of stiles in predetermined, spaced relationship to each other, a top rail, and a bottom rail, the top and bottom rails extending between the stiles.

10. The partition system according to claim 9 wherein each stile includes a necked portion, each necked portion having a pair of opposing, concave grooves extending substantially along the entire respective stilc.

11. The partition system according to claim 9 wherein the stiles are contiguous with the ends, respectively, each end terminating in a curved, convex surface, one of the surfaces being interrupted by a connector port.

12. The partition system according to claim 9 wherein the panel includes a body rail, the body rail being disposed between the upper rail and the bottom rail and substantially parallel thereto, the body rail extending between the stiles.

13. The partition system according to claim 12 wherein the panel includes a field portion defined by the stiles, the bottom rail, and the body rail.

14. The partition system according to claim 12 wherein the stiles, the body rail, and the top rail define an insert portion.

15. The partition system according to claim 14 wherein the panel includes an insert rail, the insert rail being disposed between the body rail and the top rail and substantially parallel thereto, the insert rail defining a pair of recesses on each face.

16. The partition system according to claim 1 wherein the panel includes a connector port in one of the ends, the connecting element being disposed in the connector port, the post projecting from the connector port.

17. The partition system according to claim 16 wherein the connector port includes an upper surface and a lower surface, the connecting element includes a second post, the posts extending toward each other from the upper and lower surfaces of the connector port, respectively.

18. The partition system according to claim 17 wherein one of the first retaining element and the second retaining element of the connector link member includes a pair of keyways, the keyways being configured to retentively engage the posts.

19. The partition system according to claim 17 wherein the posts are identical to each other.

20. The partition system according to claim 1 wherein the post includes a base and a free end, the circumferential sidewall extending therebetween.

21. The partition system according to claim 20 wherein the base and the free end are both generally circular with the base being relatively smaller than the free end such that the circumferential sidewall tapers outwardly as it extends from the base to the free end.

22. The partition system according to claim 1 wherein the panel comprises a plurality of connecting elements and a corresponding plurality of connector ports in one of the ends, the connecting elements being respectively disposed in the corresponding plurality of connector ports.

23. The partition system according to claim 1 wherein each end of the panel comprises a plurality of connecting elements and a corresponding plurality of connector ports, the connecting elements being respectively disposed in the corresponding plurality of connector ports.

24. The partition system according to claim 23 wherein the connector ports of the first end are aligned, respectively, with the connector ports of the second end.

25. The partition system according to claim 1 wherein the panel includes a field portion, the field portion having a first wall surface disposed on the first face and a second wall surface disposed on the second face, the wall surfaces extending toward each other, and the wall surfaces having a shear wall extending therebetween.

26. The partition system according to claim 25 wherein the wall surfaces define a cavity and a plurality of passageways opening to the cavity.

27. The partition system according to claim 25 wherein the first wall surface has an exterior surface with a plurality of protrusions thereon.

28. The partition system according to claim 27 wherein the second wall surface has an exterior surface with a plurality of protrusions thereon.

29. The partition system according to claim 25 wherein the wall surfaces have a plurality of shear walls extending therebetween.

30. The partition system according to claim 25 wherein the second wall surface nests within the first wall surface.

31. The partition system according to claim 30 wherein the nested arrangement of the wall surfaces defines a plurality of shear walls therebetween.

32. The partition system according to claim 31 wherein each shear wall comprises a surface-to-surface shear connection.

33. The partition system according to claim 1 wherein the panel includes a shear wall integral with the first face surface and the second face surface.

34. The partition system according to claim 33 wherein the shear wall is formed by an offset weld arrangement.

35. The partition system according to claim 1 wherein the panel includes a plurality of offset tack-off welds.

36. The partition system according to claim 35 wherein at least one of the offset welds includes a shear wall having a surface-to-surface shear connection.

37. The partition system according to claim 35 wherein at least one of the offset welds includes a shear wall having a linear-to-linear shear connection.

38. The partition system according to claim 1 wherein the panel comprises blow-molded plastic.

39. The partition system according to claim 38 wherein the plastic is HDPE.

40. The partition system according to claim 1 wherein the panel includes an insert portion.

41. The partition system according to claim 1 wherein the first face of the panel includes a first recess, and wherein the partition system further comprises:

an insert, the insert being configured to be mountable to the panel within the first recess.

42. The partition system according to claim 41 wherein the second face of the panel includes a second recess, the second recess being substantially the same size as the first recess.

43. The partition system according to claim 42 wherein the first recess includes a first H-shaped groove having a pair of legs in spaced relation to each other and a transverse cross-piece extending therebetween, and the second recess includes a second H-shaped groove having a pair of legs in spaced relation to each other and a transverse cross-piece extending therebetween, the second groove being smaller than the first groove and configured such that the second groove is disposed within the first groove.

44. The partition system according to claim 43 wherein one of the legs of the first groove cooperates with one of the legs of the second groove to define an integral shear wall that extends between the first face and the second face.

45. The partition system according to claim 44 wherein the cross-piece of the first groove cooperates with the cross-piece of the second groove to define an integral shear wall that extends between the first face and the second face.

46. The partition system according to claim 42 wherein the first face of the panel includes a pair of first recesses.

47. The partition system according to claim 46 wherein the second face of the panel includes a pair of second recesses.

48. The partition system according to claim 41 wherein the insert comprises an accessory surface having an aperture therethrough.

49. The partition system according to claim 48 wherein the accessory insert has a plurality of apertures therethrough, the first recess includes a waffle surface that defines a plurality of depressions, the apertures of the accessory insert configured such that when the insert is mounted to the first recess, each aperture respectively aligns with one of the depressions.

50. The partition system according to claim 41 wherein the insert comprises a tack surface for releasably retaining a tack.

51. The partition system according to claim 50 wherein the tack surface includes a plurality of dimples.

52. The partition system according to claim 50 wherein the insert comprises closed-cell foam.

53. The partition system according to claim 41 wherein the insert comprises an inlay surface.

54. The partition system according to claim 53 wherein the inlay surface comprises wood.

55. The partition system according to claim 53 wherein the inlay surface comprises plastic.

56. The partition system according to claim 41 wherein the insert is mountable to the panel by a screw.

57. The partition system according to claim 41 wherein the insert is mountable to the panel by a hook-and-loop fastener.

58. The partition system according to claim 1 wherein the first and second retaining elements of the connector link member each include a pair of tapered keyways.

59. The partition system according to claim 1 wherein the connector link member includes first and second connecting surfaces in spaced relationship to each other, a face extending therebetween, a pair of bevel surfaces flanking the face and extending between the connecting surfaces, a pair of ends respectively extending form the bevel surfaces and extending between the connecting surfaces, and a mating surface opposing the face.

60. The partition system according to claim 59 wherein the connector link member has a central, longitudinal axis, the first and second connecting surfaces being symmetrical to each other about the longitudinal axis.

61. The partition system according to claim 59 wherein the first and second retaining elements of the connector link member each include a pair of tapered keyways, each pair of tapered keyways being disposed on the first and second connecting surfaces, respectively.

62. The partition system according to claim 61 wherein each keyway includes an angled wall surface.

63. The partition system according to claim 59 wherein the face of the connector link member includes a mounting hole.

64. The partition system according to claim 1 wherein the connector link member includes a latch mechanism for releasably engaging a second connector link member.

65. The partition system according to claim 64 wherein the latch mechanism includes a pair of fingers.

66. The partition system according to claim 1 wherein the connector link member includes a first latch mechanism and a second latch mechanism for releasably engaging a second connector link member.

67. The partition system according to claim 66 wherein the connector link member includes a central, longitudinal axis, the first latch mechanism is disposed a predetermined distance from the central axis in a first direction, the second latch mechanism is disposed an equal distance from the central axis in a second direction, the second direction opposing the first direction.

68. The partition system according to claim 67 wherein the first and second latch mechanisms are disposed on an interior surface of the connector link member adjacent the first and second ends, respectively.

69. The partition system according to claim 1 wherein the connector link member comprises plastic.

70. The partition system according to claim 1 further comprising:

a pair of connector link members, each connector link member configured to mate to the other connector link member to define a connector link assembly.

71. The partition system according to claim 70 wherein each connector link member is substantially identical to the other connector link member.

72. The partition system according to claim 70 wherein the connector link assembly includes a first connector side, a second connector side, a first retaining assembly and a second retaining assembly, a pair of chamfered ends, and a pair of mounting holes, the mounting holes being axially aligned with each other to receive a screw therethrough.

73. The partition system according to claim 72 wherein the first retaining assembly includes a pair of retaining enclosures respectively disposed on the first and second connector sides, and the second retaining assembly includes a pair of retaining enclosures respectively disposed on the first and second connector sides.

74. The partition system according to claim 73 wherein the connecting element of the panel includes a pair of posts, and each retaining enclosure is in the form of a socket configured to retentively engage one of the posts of the connecting element.

75. The partition system according to claim 70 wherein each connector link member includes a latch mechanism for releasably engaging the other connector link member.

76. The partition system according to claim 75 wherein each connector link includes a central, longitudinal axis, and each latch mechanism includes a pair of fingers disposed at an offset position with respect to the longitudinal axis such that when mating surfaces of the connector link members are aligned, the latch mechanisms engage each other to retain the connector link members.

77. The partition system according to claim 72 wherein the connector link assembly includes a screw mounted in the mounting holes.

78. The partition system according to claim 1 further comprising:

a friction ring, the friction ring mounted to the post of the connecting element of the panel; and a connector link assembly mountable to the post of the connecting element with the friction ring disposed thereon, the friction ring operable to rotatively fix the connector link assembly with respect to the connecting element when the connector link assembly is mounted to the connecting element.

79. The partition system according to claim 1 further comprising:

a trim element, the trim element including a retaining element configured to be removably mountable to the connecting element of the panel.

80. The partition system according to claim 79 wherein the trim element includes first and second connecting surfaces, an end extending between the connecting surfaces, a curved face extending between the connecting surfaces and contiguous with the end, a mating surface, and an interior surface.

81. The partition system according to claim 80 wherein the retaining element includes a first and a second retaining notch, the retaining notches being disposed on the first and second connecting surfaces, respectively.

82. The partition system according to claim 80 wherein the trim element includes a tab extending from the end thereof, the tab being configured such that when the trim element is mounted to the connecting element, the tab engages the panel.

83. The partition system according to claim 80 wherein the trim element includes a mounting hole disposed in the face of the trim element for mounting the trim element to a second trim element to define a trim assembly.

84. The partition system according to claim 80 wherein the trim element includes a latch mechanism for mounting the trim element to a second trim element to define a trim assembly.

85. The partition system according to claim 79 further comprising:

a friction ring, the friction ring configured to mount to the connecting element of the panel, the trim element mountable to the connecting element with the friction ring disposed thereon.

86. The partition system according to claim 79 further comprising:

a pair of trim elements, each trim element configured to mate to the other trim element to define a trim assembly.

87. The partition system according to claim 86 wherein the trim elements are mountable together with the connecting element disposed therebetween, each trim element including a tab extending therefrom, the tabs being configured such that when the trim elements are mounted to the connecting element, the tabs engage the panel to prevent the trim assembly from rotating with respect to the panel.

88. The partition system according to claim 1 further comprising:

a leveling member, the leveling member adjustably mountable to the panel for orienting the panel with respect to a floor surface in a desired position.

89. The partition system according to claim 88 wherein the panel includes a leveler-receiving structure for receiving the leveler member therein, the leveler-receiving structure disposed adjacent the bottom of the panel.

90. The partition system according to claim 89 wherein the leveling member includes a stud, the leveler-receiving structure includes a leveler bore opening to the bottom for receiving the stud of the leveling member therein.

91. The partition system according to claim 90 wherein the leveler bore includes a countersink area adjacent the bottom.

92. The partition system according to claim 90 wherein the panel includes a pair of support bores adjacent the leveler bore and integral therewith, the support bores respectively extending from the first and second faces.

93. The partition system according to claim 1 further comprising:

a pair of leveling members, each leveling member adjustably mountable to the panel for orienting the panel with respect to a floor surface in a desired position; and wherein the panel includes a pair of leveler-receiving structure for respectively receiving the leveler members therein, the leveler-receiving structure disposed in the bottom of the panel and respectively adjacent the ends of the panel.

* * * * *

UNITED STATES PATENT AND TRADEMARK OFFICE

CERTIFICATE OF CORRECTION

PATENT NO. : 6,955,204 B1
DATED : October 18, 2005
INVENTOR(S) : Gilbert et al.

It is certified that error appears in the above-identified patent and that said Letters Patent is hereby corrected as shown below:

Column 2,
Line 53, “line 6” should read -- line 6-6 --.

Column 18,
Lines 2 and 4, “abottom rail” should read -- a bottom rail --; “abody rail” should read -- a body rail --; and “stilesl 104” should read -- stiles 1104 --.

Column 19,
Line 26, “elements 1254” should read -- elements 1254 --.

Signed and Sealed this

Seventh Day of February, 2006

JON W. DUDAS
*Director of the United States Patent and Trademark Office*